US009259936B2

(12) United States Patent
Iwamuro et al.

(10) Patent No.: US 9,259,936 B2
(45) Date of Patent: Feb. 16, 2016

(54) STORAGE UNIT HOLDING MEMBER AND HOLDING MEMBER

(71) Applicant: SEIKO EPSON CORPORATION, Tokyo (JP)

(72) Inventors: Takeshi Iwamuro, Matsumoto (JP); Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/011,099

(22) Filed: Aug. 27, 2013

(65) Prior Publication Data

US 2014/0063145 A1 Mar. 6, 2014

(30) Foreign Application Priority Data

Aug. 31, 2012 (JP) ..... 2012-192658
Nov. 12, 2012 (JP) ..... 2012-248729

(51) Int. Cl.

| | |
|---|---|
| ***B41J 2/175*** | (2006.01) |
| ***B65D 85/00*** | (2006.01) |
| ***B65D 85/86*** | (2006.01) |
| ***B65D 85/90*** | (2006.01) |

(52) U.S. Cl.
CPC ..... *B41J 2/17503* (2013.01); *B41J 2/175* (2013.01); *B41J 2/17546* (2013.01)

(58) Field of Classification Search
CPC ..... B41J 2/175; B41J 2/17503; B41J 2/17546
USPC ..... 206/307
See application file for complete search history.

(56) References Cited

U.S. PATENT DOCUMENTS

| | | | | |
|---|---|---|---|---|
| 2003/0095386 | A1* | 5/2003 | Le et al. | 361/737 |
| 2008/0049080 | A1* | 2/2008 | Hayashi et al. | 347/86 |
| 2010/0321451 | A1 | 12/2010 | Bianco et al. | |
| 2012/0056955 | A1 | 3/2012 | Kodama et al. | |

FOREIGN PATENT DOCUMENTS

| | | | |
|---|---|---|---|
| CN | 102407675 | A | 4/2012 |
| DE | 202009003839 | U1 | 7/2009 |
| EP | 0997297 | A1 | 5/2000 |
| EP | 1547782 | A2 | 6/2005 |
| EP | 1857285 | A2 | 11/2007 |
| EP | 1547782 | A3 | 10/2008 |
| EP | 1857285 | A3 | 8/2009 |
| EP | 2316656 | A1 | 5/2011 |
| EP | 2431184 | A1 | 3/2012 |
| GB | 2354202 | A | 3/2001 |
| GB | 2431722 | A | 5/2007 |
| JP | 2002120382 | A | 4/2002 |

(Continued)

OTHER PUBLICATIONS

Extended European Search Report issued on May 15, 2015 in European Application No. 13182193.6.

*Primary Examiner* — Stephen Meier
*Assistant Examiner* — Alexander D Shenderov
(74) *Attorney, Agent, or Firm* — Stroock & Stroock & Lavan LLP

(57) ABSTRACT

A circuit board holder holding a circuit board which is not fixed to a liquid container containing an ink and stores information relating to the ink includes a support portion configured to have an inclined surface supporting the circuit board. The circuit board supported by the support portion is inclined to a horizontal direction.

8 Claims, 27 Drawing Sheets

(56) References Cited

FOREIGN PATENT DOCUMENTS

| | | | |
|---|---|---|---|
| JP | 2008-254395 | A | 10/2008 |
| JP | 2008254395 | A | 10/2008 |
| JP | 3173565 | U | 1/2012 |
| WO | 2011/023058 | A1 | 3/2011 |
| WO | 2011/155642 | A1 | 12/2011 |

* cited by examiner

STORAGE UNIT HOLDING MEMBER AND HOLDING MEMBER

Priority is claimed under 35 U.S.C. §119 to Japanese Application No. 2012-192658 filed on Aug. 31, 2012 and No. 2012-248729 filed on Nov. 12, 2012 which are hereby incorporated by reference in its entirety.

BACKGROUND

1. Technical Field

The present invention relates to a storage unit holding member which holds a storage unit used together with a liquid receptacle, and to a holding member.

2. Related Art

In the related art, a technology has been known where an information providing medium (storage unit) which has recorded therein ink information of an ink bottle (liquid receptacle) is separate from the ink bottle (for example, refer to JP-A-2008-254395).

In JP-A-2008-254395, if a user inserts an information providing medium to a medium insertion opening of a printing apparatus (liquid consuming apparatus), a reading device (communication section) provided in the printing apparatus reads ink information stored in the information providing medium. Based on the information read, a controller provided in the printing apparatus performs a predetermined control.

However, the information providing medium disclosed in JP-A-2008-254395 does not include a structure for positioning with or fixing to the reading device. Therefore, displacement occurs between the information providing medium and the reading device, and this leads to a possibility that the reading device may not read the ink information stored in the information providing medium.

In addition, if the reading device is located deep inside the medium insertion opening, that is, if the distance between the reading device and the medium insertion opening is longer than the length of information providing medium, the information providing medium might not reach the reading device even though the user inserts the information providing medium into the medium insertion opening. Accordingly, the reading device may not read the ink information stored in the information providing medium.

In addition, the information providing medium is separate from an ink bottle. Therefore, when replenishing ink from the ink bottle to the printing apparatus, in some cases, the user may erroneously spill ink on the information providing medium, or place the information providing medium on ink that was spilled from the ink bottle. If ink clings to the information providing medium in this way, the reading device may not be able read the ink information stored in the information providing medium.

SUMMARY

An advantage of some aspects of the invention is to provide a suitable unit for allowing a communication section provided in a liquid consuming apparatus to properly read information stored in a storage medium which is a separated body from a liquid container.

Hereinafter, means and operation effects thereof according to the invention will be described.

According to an aspect of the invention, there is provided a storage unit holding member which is not fixed to a liquid receptacle containing a liquid and holds a storage unit storing information relating to the liquid, including a support portion which supports the storage unit. The storage unit supported by the support portion is inclined to a horizontal direction.

In this case, even if a user erroneously spills ink on the storage unit supported by the storage unit holding member, since the storage unit is supported to be inclined to the horizontal direction, it is possible to decrease a possibility that the ink adhered to the storage unit may be stagnant on the storage unit. As a result, it is possible to reduce the possibility of a disadvantage that a communication section included in a liquid consuming apparatus can no longer properly read information stored in the storage unit.

It is preferable that the storage unit holding member further include a plurality of walls. Even if the storage unit holding member is mounted on a plane in any posture, it is preferable that the walls be further protruded in a direction of gravity than the storage unit.

In this case, even if the storage unit holding member is mounted on the plane in any posture, the wall is further protruded in the direction of gravity than the storage unit. Accordingly, even if the storage unit holding member is mounted on the ink overflowed on the plane, it is possible to decrease a possibility that the ink may adhere to the storage unit. As a result, it is possible to suppress a disadvantage that the communication unit included in the liquid consuming apparatus can no longer properly read the information stored in the storage unit.

It is preferable that the information stored in the storage unit be read by a communication section included in a liquid consuming apparatus in such a manner that the storage unit holding member is inserted to the liquid consuming apparatus, and the storage unit supported by the support portion be inclined to a direction of the insertion.

In this case, even if a user does not notice that the user erroneously overflows the ink to the storage unit supported by the storage unit holding member, since the storage unit is supported to be inclined to the direction of the insertion, it is possible to decrease a possibility that the ink adhered to the storage unit may be stagnant on the storage unit, during the insertion immediately before the information is read by the communication section. As a result, it is possible to reduce the possibility of a disadvantage that the communication section included in the liquid consuming apparatus can no longer properly read the information stored in the storage unit.

It is preferable that the storage unit holding member have an engagement portion included in the liquid consuming apparatus and engaging with the communication section which reads the information stored in the storage unit, and the engagement portion be a concave portion.

In addition, on a surface of the storage unit side in surfaces of the walls configuring the storage unit holding member, an engagement portion can also be formed.

In this case, since the engagement portion is the concave portion, it is possible to decrease a possibility of damaging the communication section included in the liquid consuming apparatus. As a result, it is possible to reduce the possibility of a disadvantage that the communication section included in the liquid consuming apparatus can no longer properly read the information stored in the storage unit. In particular, it is remarkably advantageous when a user has a difficulty in visually confirming whether or not the holding member which is not fixed to the liquid receptacle has been properly inserted to the liquid consuming apparatus.

In addition, the engagement portion is formed on a surface close to the storage unit in the surfaces of the walls configuring the storage unit holding member. Accordingly, it is possible to accurately determine a position of the communication section and the storage unit compared to a case where the engagement portion is formed on a surface far from the storage unit in the surfaces of the walls configuring the storage unit holding member.

As a result, it is possible to reduce the possibility of a disadvantage that the communication section included in the liquid consuming apparatus can no longer properly read the information stored in the storage unit.

It is preferable that a label of the same color as a color of the liquid contained in the liquid receptacle be attached to the storage unit holding member.

In this case, the storage unit holding member to which the label is attached can be compared with the liquid receptacle containing the liquid of the same color as the label. Accordingly, it is possible to decrease a possibility that the storage unit holding member which is caused to hold the storage unit storing the information relating to the liquid of a different color from a planned color may be erroneously inserted to the liquid consuming apparatus. As a result, it is possible to decrease a disadvantage that the communication section included in the liquid consuming apparatus erroneously reads the information stored in the storage unit.

It is preferable that the information stored in the storage unit be read by a communication section included in the liquid consuming apparatus in a state in which the storage unit holding member is mounted on a subsidiary holding member, and in a state in which the information stored in the storage unit is read by the communication section, the storage unit holding member be located inside the liquid consuming apparatus and a portion of the subsidiary holding member be located outside the liquid consuming apparatus.

In this case, in a state in which the information stored in the storage unit is read by the communication section, even if the ink has been overflowed, it is possible to decrease a possibility that the ink may adhere to the storage unit. As a result, it is possible to decrease a disadvantage that the communication section included in the liquid consuming apparatus erroneously reads the information stored in the storage unit. In addition, since a part of the subsidiary holding member is located outside the liquid consuming apparatus, a user easily takes out the storage section holding member.

In addition, it is preferable that the liquid receptacle be a liquid filler source containing the liquid to be injected to a liquid container mounted on a liquid consuming apparatus.

According to another aspect of the invention, there is provided a holding member which is not fixed to a liquid receptacle containing a liquid and holds a circuit board having a storage section, including a support portion which supports the circuit board. The circuit board supported by the support portion is inclined to a horizontal direction.

In this case, even if a user erroneously overflows the ink to the circuit board supported by the holding member, since the circuit board is supported to be inclined to the horizontal direction, it is possible to decrease a possibility that the ink adhered to the circuit board may be stagnant on the circuit board. As a result, it is possible to reduce the possibility of a disadvantage that a communication section included in a liquid consuming apparatus can no longer properly read information stored in the storage section.

It is preferable that the holding member further include a plurality of walls, and even if the holding member is mounted on a plane in any posture, the walls be further protruded in a direction of gravity than the circuit board.

In this case, even if the holding member is mounted on the plane in any posture, the walls are further protruded in the direction of gravity than the circuit board. Accordingly, even if the holding member is mounted on the ink overflowed on the plane, it is possible to decrease a possibility that the ink may adhere to the circuit board. As a result, it is possible to reduce the possibility of a disadvantage that the communication section included in the liquid consuming apparatus can no longer properly read the information stored in the storage section.

It is preferable that the information stored in the storage section be read by the communication section included in the liquid consuming apparatus in such a manner that the holding member is inserted to the liquid consuming apparatus, and the circuit board supported by the support portion be inclined to a direction of the insertion.

In this case, even if a user does not notice that the user erroneously overflows the ink to the circuit board supported by the holding member, since the circuit board is supported to be inclined to the direction of the insertion, it is possible to decrease a possibility that the ink adhered to the circuit board may be stagnant on the circuit board, during the insertion immediately before the information is read by the communication section. As a result, it is possible to reduce the possibility of a disadvantage that the communication section included in the liquid consuming apparatus can no longer properly read the information stored in the storage section.

It is preferable that the holding member include an engagement portion included in the liquid consuming apparatus and engaging with the communication section which reads information stored in the storage section, and the engagement portion be a concave portion.

In addition, on a surface of the circuit board side in surfaces of the walls configuring the holding member, the engagement portion can also be formed.

In this case, since the engagement portion is the concave portion, it is possible to decrease a possibility of damaging the communication section included in the liquid consuming apparatus. As a result, it is possible to reduce the possibility of a disadvantage that the communication section included in the liquid consuming apparatus can no longer properly read the information stored in the storage section. In particular, it is remarkably advantageous when a user has a difficulty in visually confirming whether or not the holding member which is not fixed to the liquid receptacle has been properly inserted to the liquid consuming apparatus.

In addition, the engagement portion is formed on a surface close to the circuit board in the surfaces of the walls configuring the holding member. Accordingly, it is possible to accurately determine a position of the communication section and the storage section compared to a case where the engagement portion is formed on a surface far from the circuit board in the surfaces of the walls configuring the holding member.

As a result, it is possible to reduce the possibility of a disadvantage that the communication section included in the liquid consuming apparatus can no longer properly read the information stored in the storage section.

It is preferable that a label of the same color as a color of the liquid contained in the liquid receptacle be attached to the holding member.

In this case, the holding member to which the label is attached can be compared with the liquid receptacle containing the liquid of the same color as the label. Accordingly, it is possible to decrease a possibility that the holding member which is caused to hold the storage section storing the information relating to the liquid of a different color from a planned color may be erroneously inserted to the liquid consuming apparatus. As a result, it is possible to decrease a disadvantage that the communication section included in the liquid consuming apparatus erroneously reads the information stored in the storage section.

It is preferable that the information stored in the storage section be read by the communication section included in the liquid consuming apparatus in a state in which the holding member is mounted on a subsidiary holding member, and in a state in which the information stored in the storage section is read by the communication section, the holding member be located inside the liquid consuming apparatus and a part of the subsidiary holding member be located outside the liquid consuming apparatus.

In this case, in a state in which the information stored in the storage section is read by the communication section, even if the ink has been overflowed, it is possible to decrease a possibility that the ink may adhere to the circuit board. As a result, it is possible to decrease a disadvantage that the communication section included in the liquid consuming apparatus erroneously reads the information stored in the storage section. In addition, since a part of the subsidiary holding member is located outside the liquid consuming apparatus, a user easily takes out the holding member.

According to still another aspect of the invention, there is provided a holding member which is not fixed to a liquid receptacle containing a liquid and holds a storage unit, and in which the storage unit includes a terminal portion to be connected to an external terminal, and the terminal portion is arranged to be inclined to a horizontal direction.

In this case, even if a user has erroneously overflowed the ink to the terminal portion supported by the holding member, since the terminal portion is supported to be inclined to the horizontal direction, it is possible to decrease a possibility that the ink adhered to the terminal portion may be stagnant on the terminal portion. As a result, it is possible to reduce the possibility of a disadvantage that the communication section included in the liquid consuming apparatus can no longer properly read the information stored in the storage section.

It is preferable that the holding member further include a plurality of walls, and even if the holding member is mounted on the plane in any posture, the walls are further protruded in a direction of gravity than the terminal portion.

In this case, even if the holding member is mounted on the plane in any posture, the walls are further protruded in the direction of gravity than the terminal portion. Accordingly, even if the holding member is mounted on the ink overflowed on the plane, it is possible to decrease a possibility that the ink may adhere to the terminal portion. As a result, it is possible to reduce the possibility of a disadvantage that the communication section included in the liquid consuming apparatus can no longer properly read the information stored in the storage section.

It is preferable that the information stored in the storage section be read by the communication section included in the liquid consuming apparatus in such a manner that the holding member is inserted to the liquid consuming apparatus, and the terminal portion be inclined to a direction of the insertion.

In this case, even if a user does not notice that the user erroneously overflows the ink to the terminal portion supported by the holding member, since the terminal portion is supported to be inclined to the direction of the insertion, it is possible to decrease a possibility that the ink adhered to the terminal portion may be stagnant on the terminal portion, during the insertion immediately before the information is read by the communication section. As a result, it is possible to reduce the possibility of a disadvantage that the communication section included in the liquid consuming apparatus can no longer properly read the information stored in the storage section.

It is preferable that the holding member include an engagement portion engaging with an apparatus side engagement portion disposed in the communication section of the liquid consuming apparatus, and the engagement portion be a concave portion.

In addition, on a surface of the terminal portion side in surfaces of the walls configuring the holding member, the engagement portion can also be formed.

In this case, since the engagement portion is the concave portion, it is possible to decrease a possibility of damaging the communication section included in the liquid consuming apparatus. As a result, it is possible to reduce the possibility of a disadvantage that the communication section included in the liquid consuming apparatus can no longer properly read the information stored in the storage section. In particular, it is remarkably advantageous when a user has a difficulty in visually confirming whether or not the holding member which is not fixed to the liquid receptacle has been properly inserted to the liquid consuming apparatus.

In addition, the engagement portion is formed on a surface close to the terminal portion in the surfaces of the walls configuring the holding member. Accordingly, it is possible to accurately determine a position of the communication section and the storage section compared to a case where the engagement portion is formed on a surface far from the terminal portion in the surfaces of the walls configuring the holding member.

As a result, it is possible to reduce the possibility of a disadvantage that the communication section included in the liquid consuming apparatus can no longer properly read the information stored in the storage section.

It is preferable that a label of the same color as a color of the liquid contained in the liquid receptacle be attached to the holding member.

In this case, the holding member to which the label is attached can be compared with the liquid receptacle containing the liquid of the same color as the label. Accordingly, it is possible to decrease a possibility that the holding member which is caused to hold the storage section storing the information relating to the liquid of a different color from a planned color may be erroneously inserted to the liquid consuming apparatus. As a result, it is possible to decrease a disadvantage that the communication section included in the liquid consuming apparatus erroneously reads the information stored in the storage section.

It is preferable that the information stored in the storage section be read by a communication section included in a liquid consuming apparatus in a state in which the holding member is mounted on a subsidiary holding member, and in a state in which the information stored in the storage section is read by the communication section, the holding member be located inside the liquid consuming apparatus and a part of the subsidiary holding member be located outside the liquid consuming apparatus.

In this case, in a state in which the information stored in the storage section is read by the communication section, even if the ink has been overflowed, it is possible to decrease a possibility that the ink may adhere to the terminal portion. As a result, it is possible to decrease a disadvantage that the communication section included in the liquid consuming apparatus erroneously reads the information stored in the storage section. In addition, since a part of the subsidiary holding member is located outside the liquid consuming apparatus, a user easily takes out the holding member.

BRIEF DESCRIPTION OF THE DRAWINGS

The invention will be described with reference to the accompanying drawings, wherein like numbers reference like elements.

FIG. 9A is a perspective view illustrating a state in which a filler port is covered by a covering body, and FIG. 9B is a perspective view illustrating a state in which the covering body is removed from the filler port.

FIG. 12A is a cross-sectional view taken along the line XIIA-XIIA in FIG. 10, and FIG. 12B is a cross-sectional view taken along the line XIIB-XIIB in FIG. 10.

DESCRIPTION OF EXEMPLARY EMBODIMENTS

Hereinafter, an embodiment of a liquid container and an ink jet type printer (hereinafter, referred to as a "printer") which is an example of a liquid consuming apparatus which consumes a liquid supplied from the liquid container will be described with reference to the drawings.

Figure 1:
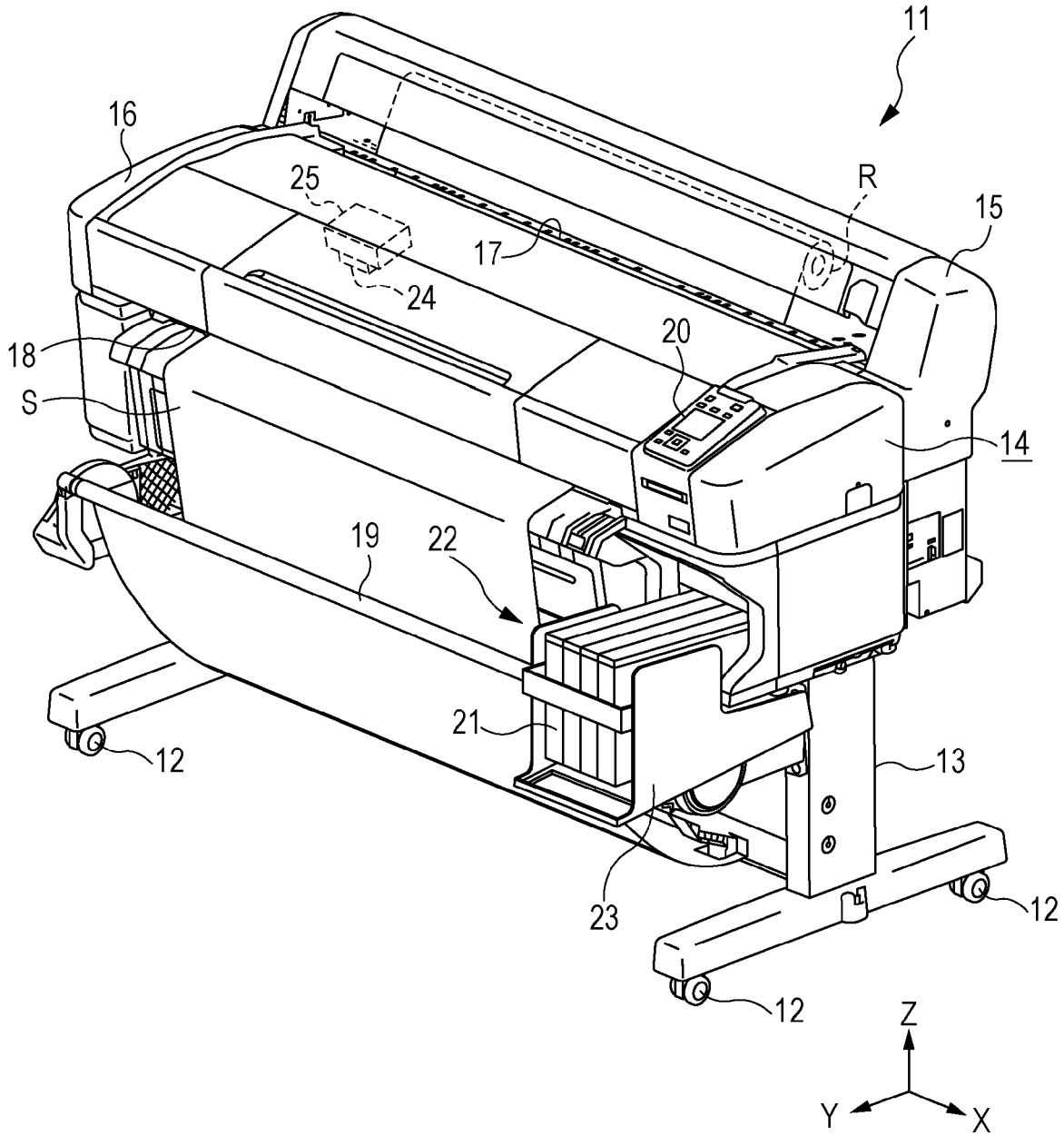
FIG. 1 is a perspective view of a printer to which a liquid container of an embodiment is fixed.

As illustrated in FIG. 1, a printer 11 of the present embodiment includes legs 13 to the lower ends of which wheels 12 are attached, and an apparatus main body 14 that is assembled on the legs 13 and that has a substantially rectangular parallelepiped shape. In the embodiment, a direction following the direction of gravity is referred to as a vertical direction Z, and a longitudinal direction of the apparatus main body 14, which intersects with (is orthogonal to, in the embodiment) the vertical direction Z, is referred to as a left/right direction X. In addition, a direction which intersects with (is orthogonal to, in the embodiment) both of the vertical direction Z and the left/right direction X is referred to as a front/rear direction Y.

As illustrated in FIG. 1, a feed unit 15 protruding upward is disposed at the rear of the apparatus main body 14. A roll paper R is loaded in which a sheet S, as a long medium, is wound and overlapped in a cylindrical shape inside the feed unit 15. In a housing 16 configuring an exterior of the apparatus main body 14, an insertion opening 17 is formed at a front side of the feed unit 15, for introducing the sheet S fed from the feed unit 15 into the housing 16.

On the other hand, a discharge opening 18 is formed at a front surface side of the apparatus main body 14 in order to discharge the sheet S outward from the housing 16. A medium transportation mechanism (not illustrated) which transports the sheet S fed from the feed unit 15, from the insertion opening 17 side to the discharge opening 18 side, is accommodated inside the housing 16. Incidentally, a medium receiving section 19 which receives the sheet S discharged from the discharge opening 18 is disposed at a position below the discharge opening 18 in the front surface side of the apparatus main body 14.

In addition, in the upper part of the apparatus main body 14, at one end side (right end side in FIG. 1) which is to the outside of a transportation route of the sheet S in the left/right direction X, an operation panel 20 is provided in order to perform a setting operation or input operation. Furthermore, in the lower part of the apparatus main body 14, a liquid container 21 which can contain ink as an example of a liquid is fixed to one end side (right end side in FIG. 1), which is to the outside of the transportation route of the sheet S in the left/right direction X.

Corresponding to a type or color of the ink, multiple (four in the embodiment) liquid containers 21 are provided. The multiple liquid containers 21 are aligned in the left/right direction X so as to form a liquid containing unit 22. In other words, it is possible to refer to the direction in which the multiple liquid containers 21 are aligned as an X direction. In a state in which each of the liquid containers 21 is fixed to the apparatus main body 14, the liquid containing unit 22 has a portion exposed to a forward side (outward side) from the apparatus main body 14. The exposed portion of the liquid containing unit 22 is covered on both left/right direction X sides and on the lower side in the vertical direction Z by a frame member 23, which has a substantially U-shaped cross section whose apparatus main body 14 side is fixed.

In addition, a carriage 25 on which a liquid ejecting head 24 is mounted is accommodated inside the housing 16 in a reciprocally movable state in the left/right direction X, which is a main scanning direction. A liquid supply mechanism (not illustrated) is accommodated inside the housing 16 in order to supply the ink contained in the liquid container 21 to the liquid ejecting head 24. Then, recording (printing) is performed by ejecting ink droplets from the liquid ejecting head 24 onto the sheet S transported by the medium transportation mechanism, and thereby the ink inside the liquid container 21 is consumed through this ejection of the ink droplets.

Figure 2:
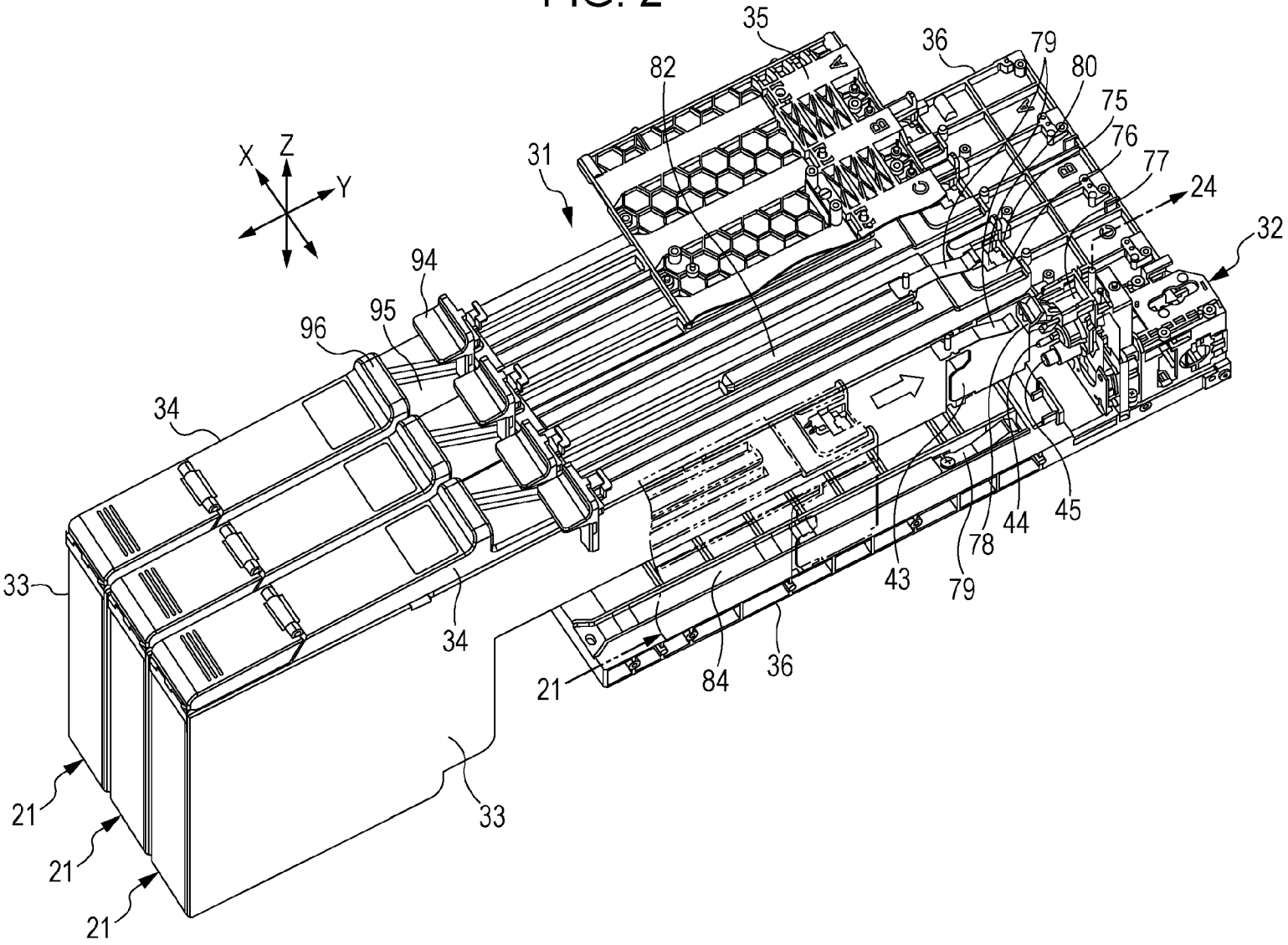
FIG. 2 is a perspective view illustrating a state in which a liquid container is mounted on a mounting section.

Next, a mounting section 31, which fixedly mounts the liquid container 21 on the apparatus main body 14, and the liquid container 21, which is to be fixed to the apparatus main body 14 via the mounting section 31, will be described. In FIG. 2, in order to avoid complication of the drawing, only one supply unit 32 is illustrated which is a part of the liquid supply mechanism supplying the ink from each of the liquid containers 21 to the liquid ejecting head 24 side. The liquid container 21 corresponding to the one illustrated supply unit 32 is illustrated in a prior state of being mounted on the mounting section 31, as illustrated by the two-dot chain line and white arrow. In addition, in FIG. 3, a liquid containing body 33 configuring the liquid container 21 and a slider 34 as an example of a subsidiary holding member are separately illustrated.

As illustrated in FIG. 2, the mounting section 31 is disposed in the printer 11 and has an upper frame 35 and a lower frame 36, which are arranged with a predetermined space in a vertical direction (vertical direction Z). In addition, supply units 32, which is a part of the liquid supply mechanism, are attached to the mounting section 31 in correspondence with each of the liquid containers 21. In FIG. 2, the upper frame 35 is illustrated with a portion cut away and removed in the left/right direction X.

The liquid container 21 is immovably fixed to the printer 11 in a state in which one end side (right end side in FIG. 2) in the longitudinal direction is located inside the mounting section 31. In the fixed state to the printer 11, the ink contained in the liquid containers 21 is supplied to the liquid ejecting head 24 side through the supply units 32, which are attached in the mounting section 31 in correspondence with an end side of the respective liquid containers 21. Therefore, in the embodiment, the orientation of the liquid containers 21 when mounted on the mounting section 31 of the printer 11 and in an immovably fixed state in the printer 11 is the orientation in which the liquid containers 21 are used. The fixed state can be referred to as a state in which a user cannot detach the liquid containers 21 from the printer 11. For example, the fixed state represents a state in which the liquid containers 21 are screwed to the printer 11 or a state in which in a printing operation is occurring and ink is being supplied from the liquid containers 21 to the printer 11.

Figure 3:
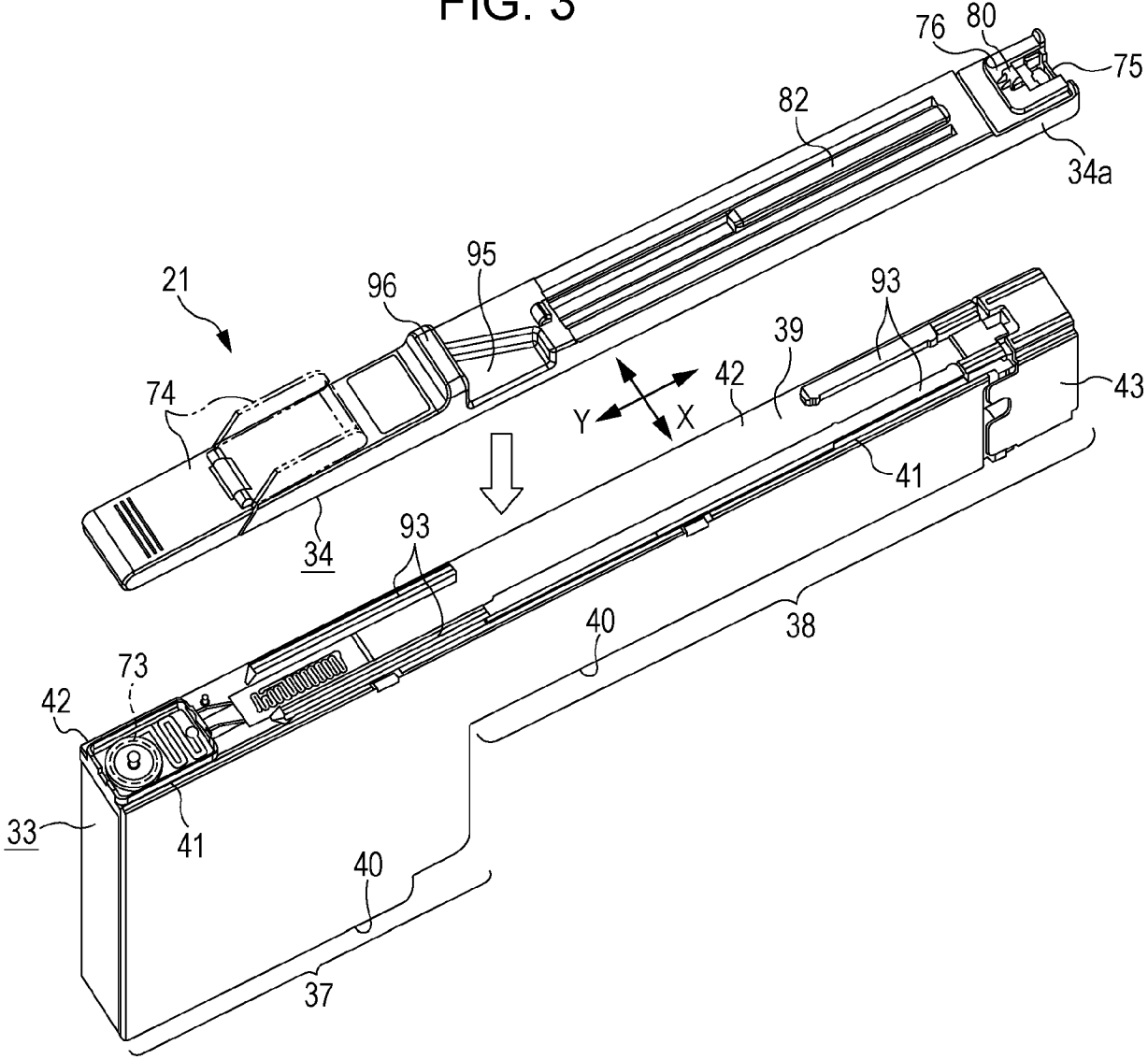
FIG. 3 is a perspective view illustrating a state in which a slider is separated from a liquid container.

As illustrated in FIGS. 2 and 3, the liquid container 21 of the embodiment includes the liquid containing body 33, which contains ink, and the slider 34. The slider 34 is arranged to overlap the liquid containing body 33 from upper side, which is in the direction opposite to the direction of gravity in the vertical direction.

The liquid containing body 33 has a rectangular parallelepiped shape, with a substantially L-shape in side view, which has a constant width in a short direction (left/right direction X) thereof. The longitudinal direction (front/rear direction Y) of the liquid containing body 33 is a substantially horizontal direction that is orthogonal to the longitudinal direction of the apparatus main body 14, and the short direction (left/right direction X) of the liquid containing body 33 is a substantially horizontal direction that is orthogonal to the longitudinal direction of the liquid containing body 33. That is, the liquid containing body 33 includes a first containing body portion 37 that has a substantially square shape when viewed from the side in the short direction (left/right direction X), and a second containing body portion 38 that has a substantially long rectangular shape in the front/rear direction Y. The second containing body portion 38 is located to the rear of the first containing body portion 37 and is formed with an outlet port 52 (to be described later). Flat surface portions 41 and 42 are formed near the short direction edges of the upper surface 39 of the liquid containing body 33 and extend in a continuous manner, without a step, in the longitudinal direction (front/rear direction Y). That is, it can be said that among the various surfaces configuring the first containing body portion 37 and the various surfaces configuring the second containing body portion 38, their upper surfaces (which can also be referred to as the upper parts or the top surfaces) have the same height in the height direction (vertical direction). The slider 34 is slidable along the flat surface portions 41 and 42. On the other hand, a lower surface 40 of the liquid containing body 33 has a shape with a stepped surface where the first containing body portion 37 is located lower than the second containing body portion 38, in the longitudinal direction (front/rear direction Y). That is, it can be said that the bottom surface (bottom portion) of the various surfaces configuring the first containing body portion 37 is located at a lower position in the height direction (vertical direction) than the bottom surface (bottom portion) of multiple surfaces configuring the second containing body portion 38. Furthermore, the volume of the first containing body portion 37 is greater than the volume of the second containing body portion 38. It should be noted that in an embodiment which does not adopt the slider 34, for the reason described below, the upper surfaces (which can be alternately referred to as the upper parts or the top surfaces) of the first and second containing body portions 37, 38 may or may not have the same heights in the height direction (vertical direction). However, it is preferable that the upper surface of the first containing body portion 37 should be a lower height from the upper surface of the second containing body portion 38 than the height of the bottom surface of the second containing body portion 38 from the bottom surface of the first containing body portion 38.

In the embodiment, the first containing body portion 37 is configured to have at least a first surface (which can alternately be referred to as a first side surface or a first side portion) in a mounting direction side of the liquid container 21(direction in which the liquid container 21 is inserted), and a second surface (which can be alternately referred to as a second side surface or a second side portion) opposite from the first surface. Although defined by the insertion or mounting direction in this way, the liquid container 21 is immovably fixed to the printer 11, by a fixed portion 37*a* (refer to FIGS. 13, 14, 20A and 20B) disposed on the first surface being screwed to a fixing portion (not illustrated), which is disposed in the apparatus main body 14 side, by using a screw 37*b* (refer to FIG. 20A). In the embodiment, while the liquid containing body 33 is fixed in a mounted state in the printer 11 using the screw, at least a part of the second containing body portion 38 is located inside the apparatus main body 14 of the printer 11. This part is referred to as a second section (which can be alternately referred to as a section to be mounted on or to be inserted in the printer 11 or the apparatus main body 14). In contrast, the remaining portion except for the second section of the second containing body portion 38 and the first containing body portion 37 is located outside the apparatus main body 14 of the printer 11, exposed from the front of the apparatus main body 14. This remaining portion is referred to as a first section. The first surface, which is a surface in the mounting direction of the first containing body portion 37, can be referred to as "the second containing body portion 38 side surface", among the surfaces configuring the first containing body portion 37.

As described above, the bottom surface of the first containing body portion 37 is located at a lower position in the height direction than the bottom surface of the second containing body portion 38. Accordingly, at least a part of the bottom surface (bottom portion) of the first section is located at a lower position than the bottom surface (bottom portion) of the second section.

As described above, the volume of the first containing body portion 37 is greater than the volume of the second containing body portion 38. Accordingly, the volume of the first section is greater than the volume of the second section.

As described above, the outlet port 52 is formed at the second containing body portion 38. Accordingly, it can be said that the outlet port 52 is formed at the second section.

As described above, the heights in the height direction (vertical direction) are equal to each other between the upper surface among multiple surfaces configuring the first containing body portion 37 and the upper surface among multiple surfaces configuring the second containing body portion 38. Accordingly, the heights in the height direction (vertical direction) are equal to each other between the upper surface among multiple surfaces configuring the first section and the upper surface among multiple surfaces configuring the second section.

As described above, the liquid containing body 33 has a rectangular parallelepiped shape with a substantially L-shape in a side view, and has a substantially constant width in the short direction (left/right direction X), which is in the substantially horizontal direction and which is orthogonal to the longitudinal direction (front/rear direction Y), which is the mounting direction on the mounting section 31. Accordingly, the length of the first section in the short direction is equal to the length of the second section in the short direction.

The second containing body portion 38 includes a connection member 43 at the rear end side thereof, which is the opposite side from the first containing body 37 side in the longitudinal direction. The connection section 43 is a separate member from the housing member configuring the liquid containing body 33 (that is, separate from the containing body case 130 illustrated in FIG. 13) and is attached so as to be movable relative to the second containing body portion 38. The connection section 43 includes an ink flow channel which introduces the ink contained inside the liquid containing body 33 to an ink supply needle 44 provided in the supply unit 32 attached to the mounting section 31 side, and a transmission mechanism which transmits whether ink is present or not inside the liquid containing body 33, to an ink remaining amount detection rod 45 similarly provided in the supply unit 32.

Figure 4:
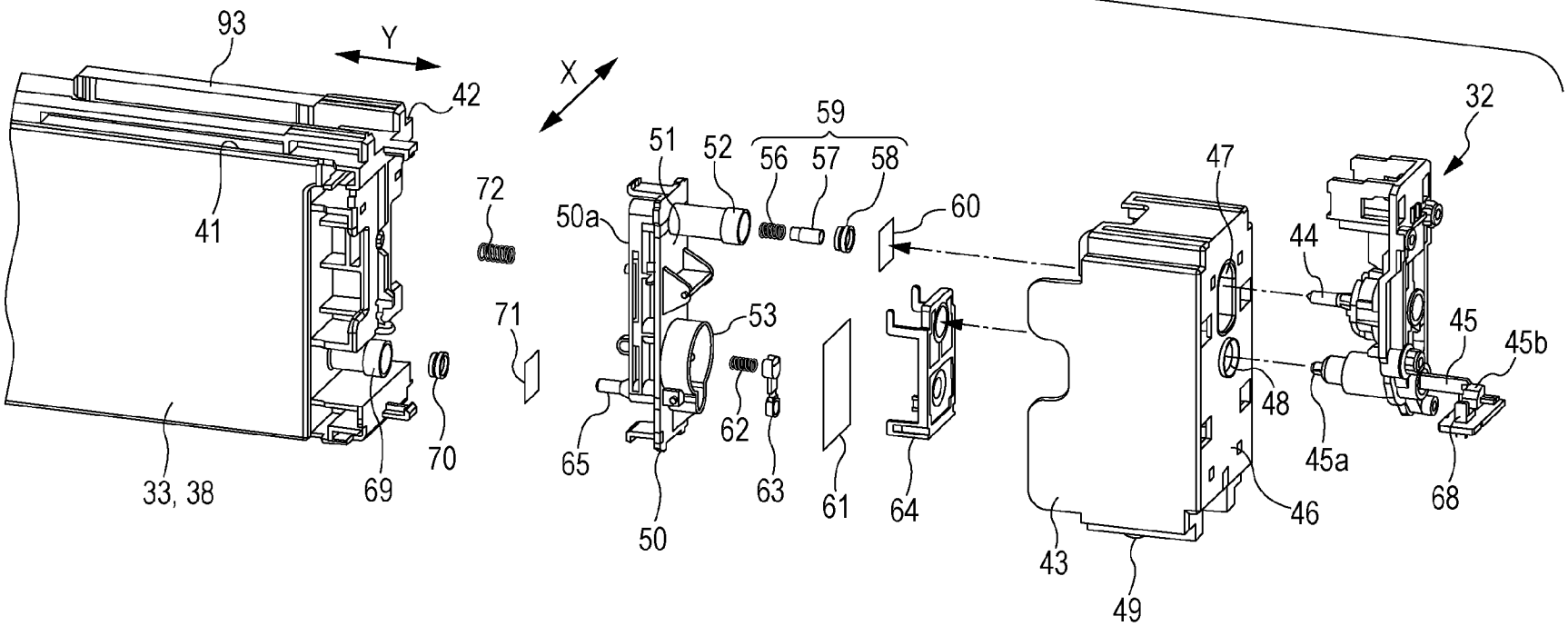
FIG. 4 is an exploded perspective view illustrating a configuration of a connection section included in a liquid container.
Figure 5:
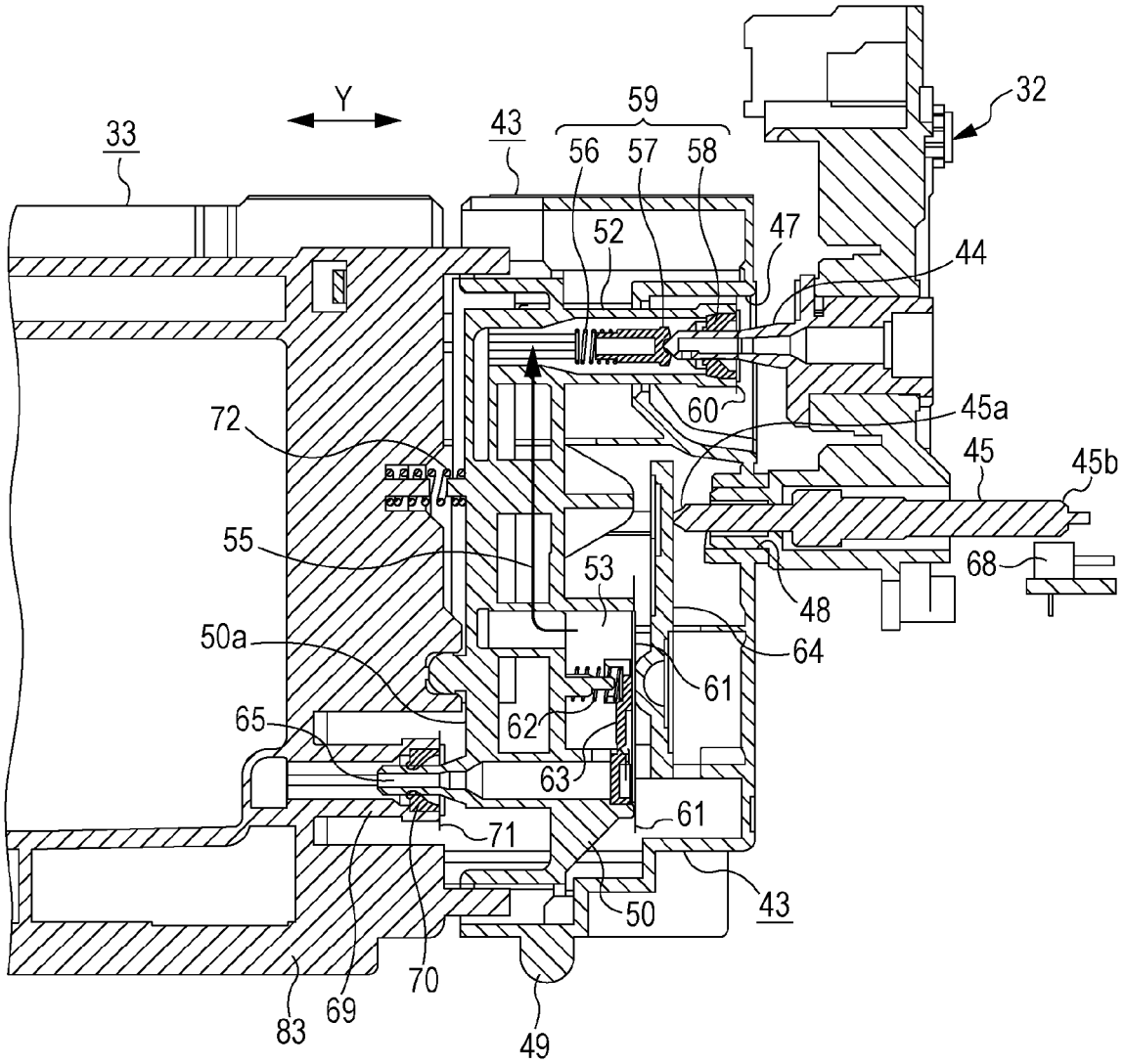
FIG. 5 is a cross-sectional view illustrating a configuration of a connection section included in a liquid container.

Referring to FIGS. 4 and 5, configuration of the connection section 43 in which the ink flow channel and the transmission mechanism are formed will be described. FIGS. 4 and 5 show those members of the supply unit 32 that relate to the supply needle 44 and the remaining amount detection rod 45, while other members are omitted as appropriate.

As illustrated in FIGS. 4 and 5, the connection section 43 provided in the second containing body portion 38 has a substantially box shaped housing having an open side and a bottom wall portion. The bottom wall portion configures an end surface 46 at the supply unit 32 side of the second containing body portion 38 of the liquid containing body 33. A needle insertion hole 47 to which the supply needle 44 of the supply unit 32 is inserted is formed on the end surface 46 of the connection section 43, and a rod insertion hole 48 to which the remaining amount detection rod 45 is inserted is formed at a position adjacent to the needle insertion hole 47. A projection portion 49 whose surface is a substantially cylindrical shape is formed at the lower surface side of the connection section 43.

An attachment-purpose member 50 is provided inside the housing of the connection section 43. The attachment-purpose member 50 has a substantially flat plate shape with a predetermined thickness in a direction in which the supply needle 44 is inserted to the needle insertion hole 47. The attachment-purpose member 50 includes a substantially cylindrical outlet port 52 and a substantially cylindrical liquid chamber 53, both on an end surface 51, which is the supply unit 32 side in the thickness direction. The substantially cylindrical outlet port 52 is for receiving the supply needle 44 via the needle insertion hole 47. As illustrated by a thick solid arrow in FIG. 5, a flow channel 55 which brings the liquid chamber 53 and the outlet port 52 into communication with each other is formed through the attachment-purpose member 50. In addition, the attachment-purpose member 50 is attached to be swingable with respect to the liquid containing body 33.

Because the supply needle 44 is inserted into the outlet port 52 via the needle insertion hole 47, an opening and closing valve 59 is provided in the outlet port 52. The opening and closing valve 59 includes a spring 56, a valve member 57, and a packing 58, and inhibits the ink supplied from the liquid containing body 33 side from flowing out. To prevent ink from flowing of the outlet port 52 before the supply needle 44 is inserted, a seal 60 is welded on the outlet port 52 to cover the opening of the outlet port 52.

In addition, a flexible film 61 is welded to the liquid chamber so as to cover the opening of the liquid chamber 53. Therefore, the volume of the liquid chamber 53 varies as change in the internal pressure deforms the film 61. A spring 62 which biases the film 61 outward from the liquid chamber 53 is disposed inside the liquid chamber 53. A pressure receiving plate 63 which transmits a biasing force of the spring 62 to the film 61 is inserted to between the spring 62 and the film 61.

A movement member 64 is attached to the outer surface of the liquid chamber 53 of the attachment-purpose member 50. The movement member 64 is configured to be pivotable about the center of a predetermined pivot fulcrum extending in the horizontal direction (left/right direction X) that is orthogonal to the longitudinal direction (front/rear direction Y) of the liquid containing body 33. The movement member 64 contacts the film 61, which configures a part of the inner surface of the liquid chamber 53, from the outside of the liquid chamber 53.

On the other hand, a substantially cylindrical inlet port 65 protrudes in the thickness direction of the attachment-purpose member 50 from an end surface 50*a*, which is at the other side in the thickness direction of the attachment-purpose member 50 than the end surface 51. A substantially cylindrical outlet port (outlet port portion) 69 into which the inlet port 65 is inserted is disposed in the liquid containing body 33 (second containing body portion 38) side at a position corresponding to the inlet port 65. Insertion of the inlet port 65 into the outlet port 69 brings the inside of the liquid containing body 33 (second containing body portion 38) and the liquid chamber 53 into communication with each other. The outlet port 69 is internally provided with a packing 70 which inhibits the ink contained in the liquid containing body 33 from leaking and flowing out. A seal 71 is welded onto the outlet port 69 to cover the opening of the outlet port 69 so that ink does not flow out from the liquid containing body 33 before the inlet port 65 is inserted to the liquid containing body 33 (second containing body portion 38).

The attachment-purpose member 50 is biased toward the mounting section 31 within the connection section 43 by a compression spring 72, which is inserted in between the liquid containing body 33 (second containing body portion 38) and the attachment-purpose member 50. This is, for example, in order to stabilize the insertion of the supply needle 44 to the outlet port 52 or contact of the remaining amount detection rod 45 with the movement member 64.

Here, the transmission mechanism will be described with reference to FIG. 5.

As illustrated in FIG. 5, the connection section 43 is configured so that the film 61 of the liquid chamber 53 is pressed out by the spring 62 via the pressure receiving plate 63 so as to increase the volume of the liquid chamber 53. In association with this increase in the volume of the liquid chamber 53, the ink inside the liquid containing body 33 flows into the liquid chamber 53 through the inlet port 65. On the other hand, if the ink is drawn from the outlet port 52 to the supply needle 44 by the supply unit 32, the ink inside the liquid chamber 53 flows out from the liquid chamber 53 through the flow channel 55. In the embodiment, the inner diameter of the flow channel 55 is set to be larger than the inner diameter of the inlet port 65. Accordingly, the amount of ink flowing from the liquid chamber 53 does not keep up with the amount of ink flowing into the liquid chamber 53, so the inside of the liquid chamber 53 has a negative pressure. Therefore, the film 61 is deformed and drawn into the liquid chamber 53 against the biasing force of the spring 62. Incidentally, FIG. 5 illustrates a state in which the film 61 is drawn toward the liquid chamber 53.

The negative pressure occurring in the liquid chamber 53 is gradually eliminated as the ink inside the liquid containing body 33 flows into the liquid chamber 53 through the inlet port 65. As a result, the film 61 is again pressed outward from the liquid chamber 53 by the force of the spring 62, so that the volume of the liquid chamber 53 is restored. Therefore, after the elapse of a predetermined time from when the supply unit 32 stops supplying the ink to the liquid ejecting head 24, the liquid chamber 53 returns to the original state prior to the start of the ink supply to the liquid ejecting head 24. In addition, if the ink is supplied again from the supply unit 32 to the liquid ejecting head 24 side, the inside of the liquid chamber 53 is at a negative pressure and thereby the film 61 is drawn toward the liquid chamber 53 side. On the other hand, if the ink inside the liquid containing body 33 is all consumed, even if the inside of the liquid chamber 53 is at a negative pressure, no ink will flow into the liquid chamber 53. That is, even after the elapse of a predetermined time from when the supply unit 32 stops supplying the ink, the negative pressure inside the liquid chamber 53 will not be eliminated, and the film 61 will be maintained in its state of being drawn into the liquid chamber 53.

A spring (not illustrated) is attached to the remaining amount detection rod 45 for biasing the remaining amount detection rod 45 into pressurizing contact with the movement member 64. One end portion 45*a* of the remaining amount detection rod 45 comes into contact with the movement member 64. The other end portion 45*b*, which is at the opposite side of the remaining amount detection rod 45 to one end portion 45*a*, serves as the detection target for a concave-shaped sensor 68. The sensor 68 is a transmission type photosensor and is provided with a light receiving portion and the light emitting portion (not illustrated) which oppose each other. Presence or absence of the ink inside the liquid containing body 33 is detected by a detection signal output from the sensor 68.

That is, if the ink inside the liquid containing body 33 is all exhausted, ink will not flow from the inside of the liquid containing body 33 into the liquid chamber 53. Accordingly, the film 61 remains deformed so as to decrease the volume of the liquid chamber 53. Therefore, the pressure against the movement member 64 from the one end portion 45*a* of the remaining amount detection rod 45, as biased by the spring (not illustrated), pivots the movement member 64 about the pivot fulcrum, so that the remaining amount detection rod 45 moves in the direction of the liquid containing body 33. Accordingly, the other end portion 45*b* of the remaining amount detection rod 45 moves to a position between the light emitting portion and the light receiving portion of the sensor 68. Therefore, the sensor 68, based on the fact that a light blocked state is maintained, detects that the ink inside the liquid containing body 33 is all exhausted.

Next, returning to FIGS. 2 and 3, the slider 34 will be described.

As illustrated in FIG. 3, the first section located outside the printer 11 in the liquid containing body 33 has a filler port (filler port portion) 73, on the upper surface 39 of the liquid containing body 33, through which the ink is injected into the liquid containing body 33. More specifically, the filler port 73 is formed at a position closer to the second surface of the first section than to the first surface. In the embodiment, the first containing body portion 37 corresponds to the first section and the filler port 73 is disposed in the first containing body portion 37. The filler port 73, which is located outside the printer 11, is covered by the slider 34 so as not to be exposed except when the ink is injected.

That is, the slider 34 has a substantially rectangular shape in the longitudinal direction, and is formed with an outer shape that substantially overlaps the upper surface 39 of the liquid containing body 33. When one end side of the slider 34 is inserted into the mounting section 31, and thereby substantially overlaps the upper surface 39 of the liquid containing body 33, the upper portion of the ink filler port 73, which is disposed in the liquid containing body 33, is covered by an opening/closing cover 74, which is capable of freely opening and closing. Specifically, the slider 34 is provided at one end portion in the longitudinal direction with the opening/closing cover 74, which is displaced between the position to cover the filler port 73 and the position to uncover it. In the following description, unless otherwise specified, the "insertion direction" represents the "insertion direction" of the slider 34 with respect to the mounting section 31.

In the embodiment, while the opening/closing cover 74 is in a state of covering the filler port 73, in the position that is closer to the second containing body portion 38 (second section) than to the filler port 73, the opening/closing cover 74 is axially supported to be pivotable on the slider 34 about an axial line that extends in the short direction of the liquid containing body 33 as a rotational center. Therefore, as illustrated by the two-dot chain line in FIG. 3, to open the filler port 73, a user can lift the front side of the opening/closing cover 74, which is the front end side of the slider 34 in the longitudinal direction, and can pivot the opening/closing cover 74 approximately 180 degrees in the direction of the printer 11, which is in the direction of the second containing body portion 38.

As a result, the opening/closing cover 74 can be displaced to the rear of the filler port 73 by changing the covered state of the filler port 73 illustrated by the solid line in FIG. 3 to the open state of the filler port 73 as illustrated by the two-dot chain line in FIG. 3. In the embodiment, the filler port 73 is disposed near the front side end portion of the first containing body portion 37 of the liquid containing body 33. In this manner, the length in the front/rear direction Y that is needed to cover the filler port 73 using the opening/closing cover 74 is not excessively long.

The slider 34 is provided with an attached holder 76 at an end portion 34*a* at the rear side in the insertion direction to the mounting section 31. The holder 76 is an example of a storage unit holding member on which a circuit board 75 (storage unit) can be mounted. The circuit board 75 (storage unit) includes a board (which could be a flexible board) mounted with a memory that stores relevant information relating to the ink poured into the liquid containing body 33 from the filler port 73. When the slider 34 is inserted into the mounting section 31 in the overlapped state with the upper surface 39 of the liquid containing body 33, the circuit board 75 attached to the holder 76 can engage with the communication section 77 disposed in the mounting section 31 of the printer 11. This engagement with the communication section 77 brings contact portions included in terminals of the circuit board 75, which is mounted on the holder 76, into contact and electrical connection with electric terminals 78 (external terminals) provided in the communication section 77. As a result, the relevant information stored in the memory mounted on the circuit board 75 is transmitted to the printer 11.

In the printer 11 of the embodiment, the slider 34, when inserted into the mounting section 31 of the printer 11 while in the overlapped state with the upper surface 39 of the liquid containing body 33, is positioned inside the printer 11 together with the connection section 43 by a pair of leaf springs 79 that are attached to the mounting section 31.

That is, as illustrated in FIG. 2, the leaf springs 79 are fixed to the upper frame 35 and the lower frame 36 by screws and each slants so that a mutual distance between corresponding pairs in the vertical direction becomes narrower toward the insertion direction. The leaf spring 79 of the upper frame 35 is in a biasing state in contact with a projection portion 80 disposed on the circuit board holder 76 provided in the slider 34. In contrast, the leaf spring 79 of the lower frame 36 is in a biasing state in contact with a projection portion 49 (refer to FIG. 5) disposed in the connection section 43. As a result, the slider 34 (circuit board holder 76) and the connection section 43 are positioned in the vertical direction Z by a pair of the leaf springs 79.

The slider 34, which is inserted in the overlapped state with the liquid containing body 33, and the second containing portion 38 of the liquid containing body 33 are both in a positioned state in the mounting section 31. That is, as illustrated in FIG. 2, a convex portion 82 extends along the longitudinal direction on the upper surface side of the slider 34. The convex portion 82 is inserted in sliding contact with a guide groove (not illustrated) on the lower surface of the upper frame 35 of the mounting section 31. In addition, a guide groove 84 is formed in the upper surface of the lower frame 36 of the mounting section 31 and engages with which a convex portion 83 (refer to FIGS. 5 and 23) which extends in the longitudinal direction along the lower surface side of the liquid containing body 33. Therefore, the slider 34 and the second containing body portion 38 are respectively positioned in the short direction by way of the respective engagements of the convex portions with the guide grooves. As a result, the slider 34 (and the circuit board holder 76 attached to the slider 34) and the connection section 43 provided in the second containing body portion 38 are respectively positioned in the short direction. That is, in a state in which the liquid container 21 is mounted on the printer 11 (mounting section 31) (that is, a state in which the ink is supplied from the liquid container 21 to the printer 11), the circuit board 75 and the circuit board holder 76 are located in the second section.

In the liquid container 21 of the embodiment, the circuit board holder 76 and the opening/closing cover 74 which are provided in the slider 34 are detachably attached to the slider 34. The slider 34 is configured to be slidable with respect to the upper surface 39 of the liquid containing body 33 while the circuit board holder 76 and the opening/closing cover 74 are attached to the slider 34. In other words, the slider 34 is configured to be removably inserted to the mounting section 31 while the liquid containing body 33 is fixed to the printer 11.

Furthermore, a configuration of the slider 34 will be described in detail with reference to FIGS. 6A and 6B.

Figure 6A:
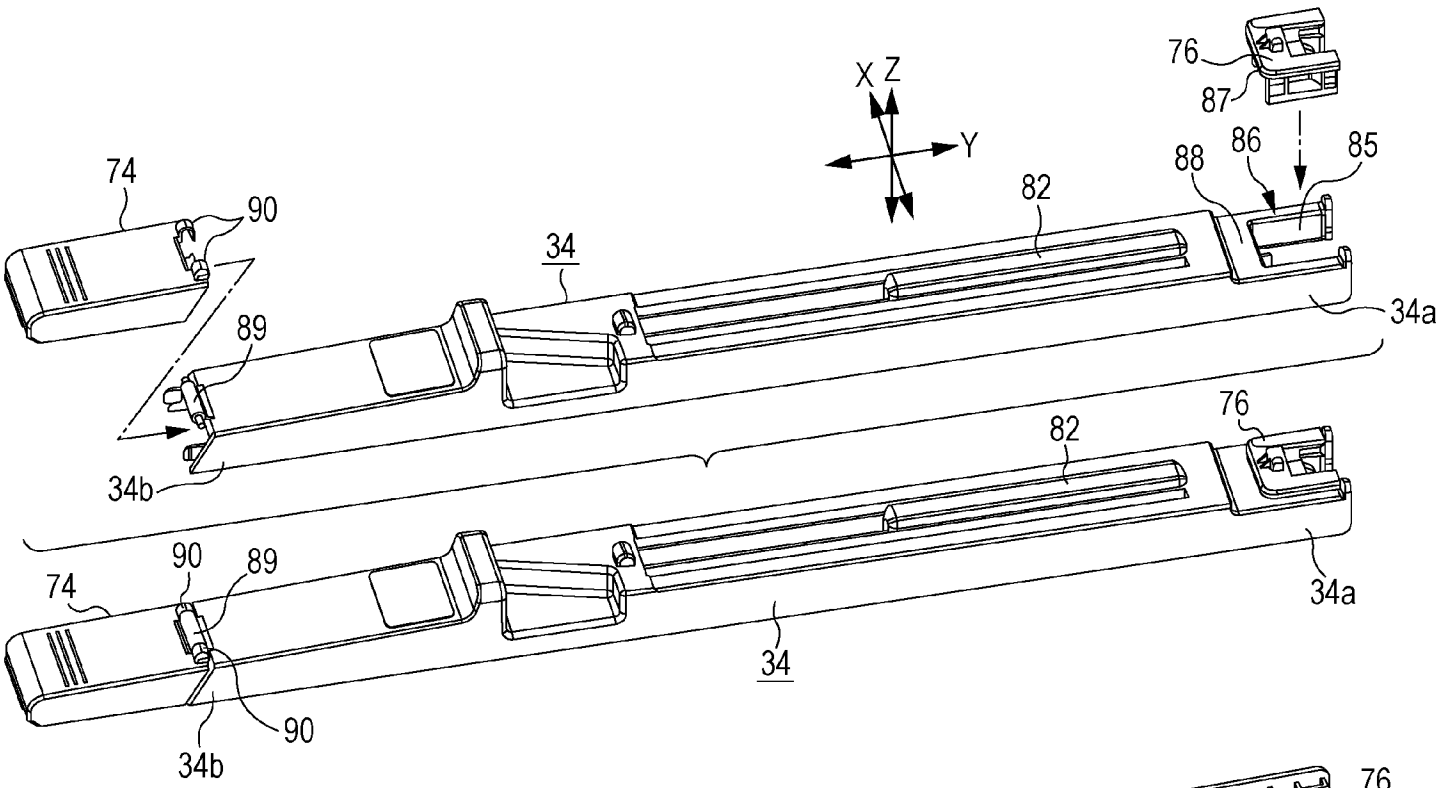
FIG. 6A is an exploded perspective view illustrating a configuration of a slider.

As illustrated in FIG. 6A, the slider 34 has a holder attachment portion 86 provided in the end portion 34*a* at the side further in the direction of insertion to the mounting section 31. The holder attachment portion 86 has a substantially U-shaped opening 85, wherein the side further in the insertion direction is open. Therefore, the holder attachment portion 86 is located in the second section in a state in which the liquid container 21 to which the slider 34 is attached is mounted on the printer 11. The circuit board holder 76 can be inserted into and removed from the opening 85 in a direction intersecting the insertion direction of the slider 34, that is, in a direction intersecting the sliding direction. In the embodiment, the circuit board holder 76 is inserted and attached into the opening 85 from the top, which is the opposite side of the slider 34 from the liquid containing body 33, so that a flange-shaped portion 87 at the upper side in the circuit board holder 76 abuts a substantially C-shaped upper surface 88 having the opening 85 of the holder attachment portion 86. The circuit board holder 76 is detached from the slider 34 by being pulled out upward from the holder attachment portion 86.

On the other hand, the slider 34 has a rotary shaft 89 in the end portion 34*b* at the opposite side of the direction of insertion into the mounting section 31. The bearing portions 90 formed in the opening/closing cover 74 are fitted to the rotary shaft 89, so that the opening/closing cover 74 is pivotably (swingably) attached to the slider 34.

The slider 34 of the embodiment, attached with the circuit board holder 76 and the opening/closing cover 74 in this manner, can be slid in the overlapped state with the liquid containing body 33 along the upper surface 39 of the liquid containing body 33 in the longitudinal direction (front/rear direction Y) of the liquid containing body 33, while abutting both edges of the liquid containing body 33 in the width direction, which is the short direction (left/right direction X).

Figure 6B:
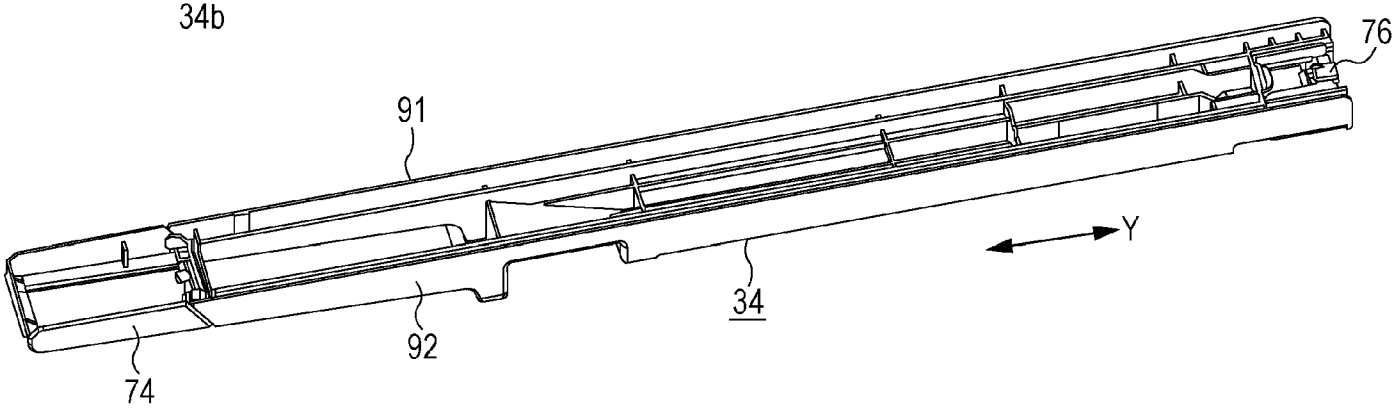
FIG. 6B is a perspective view illustrating a rear side of the slider.

Specifically, as illustrated in FIG. 6B, linear rib-shaped side wall portions 91 and 92 are respectively formed in the lower surface of the slider 34, which lies on top of the upper surface 39 of the liquid containing body 33. The rib-shaped side wall portions 91 and 92 extend in the longitudinal direction on both side edges in the width direction, which intersects the longitudinal direction. On the other hand, the linear flat surface portions 41 and 42 are formed near both side edges in the width direction, which intersects with the longitudinal direction, on the upper surface 39 of the liquid containing body 33. The linear flat surface portions 41 and 42 extend along the longitudinal direction and serve as contact surfaces with which the side wall portions 91 and 92 respectively come into contact. Therefore, the side wall portions 91 and 92 formed on the slider 34 can be moved (slid) following the longitudinal direction, while respectively abutting the flat surface portions 41 and 42 formed on the upper surface 39 of the liquid containing body 33.

That is, as illustrated in FIGS. 2 and 3, multiple convex portions 93 are formed on the upper surface 39 of the liquid containing body 33 following the longitudinal direction, adjacently inward from the flat surface portions 41 and 42. Therefore, since the movement of the slider 34 in the width direction (left/right direction X) is regulated by the multiple convex portions 93, the slider 34 stably moves (slides) along the longitudinal direction (front/rear direction Y) of the liquid containing body 33.

Incidentally, slide knobs 94 are disposed in the printer 11 of the embodiment, so as to be slidingly movable in the vertical direction at a position above the liquid container 21 when the liquid container 21 is fixed to the printer 11 in a state in which at least a part of the second containing body portion 38 is located inside the mounting section 31. If the slide knobs 94 disposed in the printer 11 are displaced downward, the slide knobs 94 engage in the concave portions 95 on the upper surface of the slider 34, thereby regulating the movement (slide) of the slider 34 in a direction of removal from the mounting section 31 of the longitudinal direction. Therefore, if a user moves the slide knobs 94 upward, the engagement with the concave portions 95 is disengaged and the slider 34 can be removed from the mounting section 31. Accordingly, the user can insert and remove the slider 34 to and from the mounting section 31 by sliding the slider 34 with respect to the liquid containing body 33. In the embodiment, finger-hooking portions 96 protrude from the upper side of the slider 34 following the short direction, and the finger-hooking portions 96 simplify insertion and removal of the slider 34 by the user.

Figure 7A:
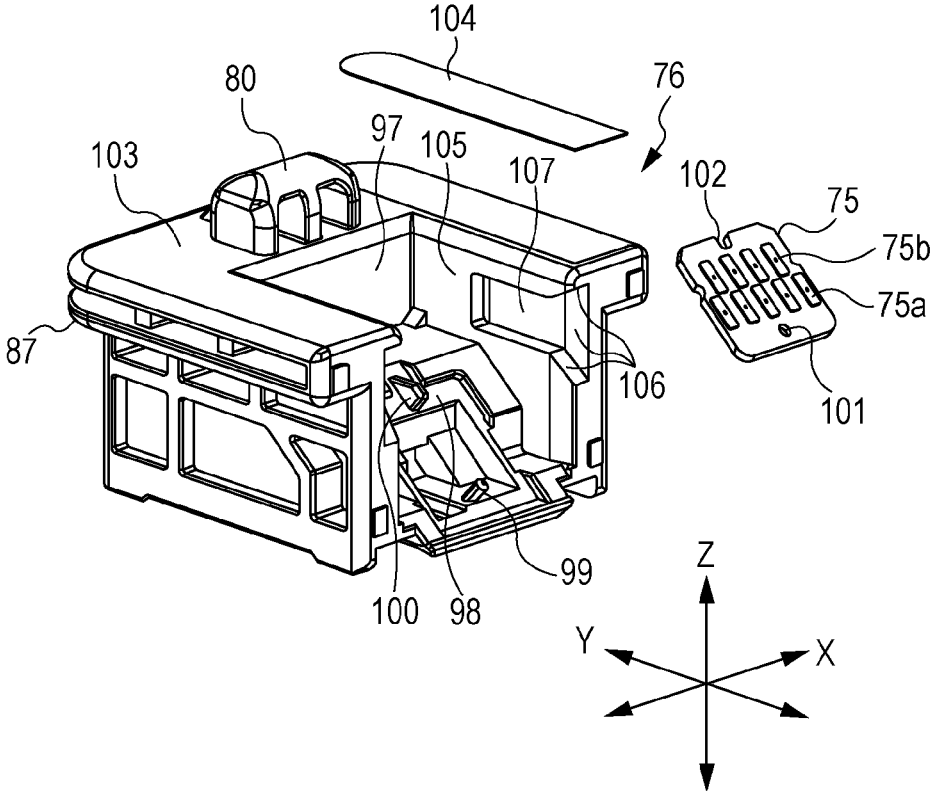
FIG. 7A is an exploded perspective view illustrating a configuration of a circuit board holder.
Figure 7B:
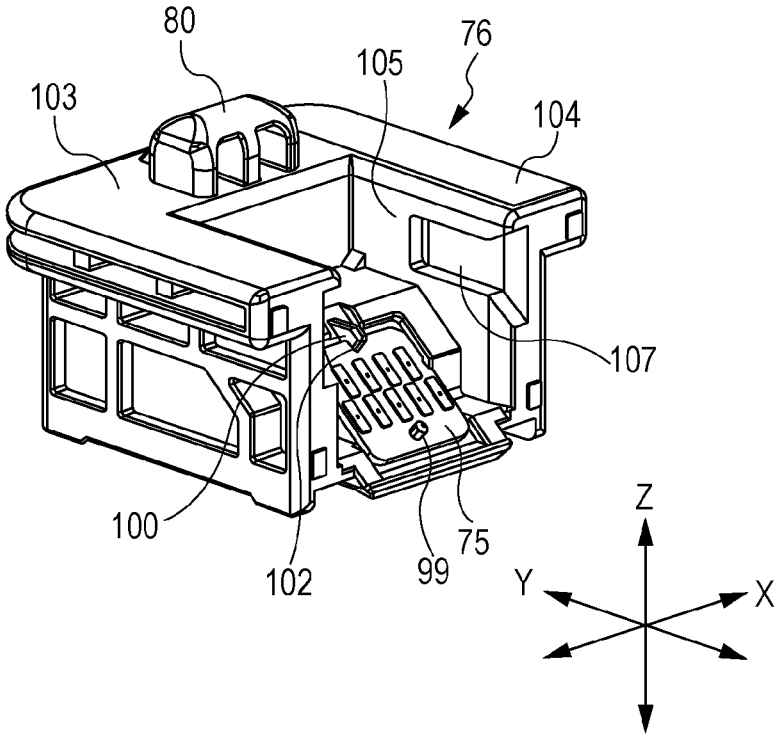
FIG. 7B is a perspective view of the circuit board holder on which a circuit board is mounted.

In the embodiment, the circuit board 75 mounted on the circuit board holder 76 is mounted so as to be replaceable. This configuration will be described with reference to FIGS. 7A and 7B. FIGS. 7A and 7B illustrate a state in which the circuit board holder 76 is detached from the slider 34.

As illustrated in FIG. 7A, the circuit board holder 76 is configured from a plurality of walls. The circuit board holder 76 has a concave portion 97 which opens both to the rear side and the upper side in the insertion direction of the slider 34 into the mounting section 31, while the circuit board holder 76 is in a state of being assembled to the slider 34. An inclined surface 98 which is inclined downward in the insertion direction is disposed in the concave portion 97. A cylindrical boss 99 is formed at the lower end side of the inclined surface 98, and a plate-shaped rib 100 is formed at the upper end side of the inclined surface 98. The plate-shaped rib 100 is inserted into the mounting section 31 in the longitudinal direction. Any one or all of these inclined surfaces 98, cylindrical boss 99 and the rib 100 are referred to as a support portion.

On the other hand, in the embodiment, the circuit board 75 mounted on the circuit board holder 76 has a substantially rectangular shape, and multiple (here, nine) terminals (including contact portions 75*b*) 75*a* are disposed on the surface thereof, wherein the insertion direction serves as the longitudinal direction. The circuit board 75 has a round hole 101 at one end portion and a slit 102 at the other end portion which are the front and rear portions in the insertion direction of the multiple terminals (including the contact portions 75*b*) 75*a*. The boss 99 of the circuit board holder 76 is inserted into the round hole 101 of the circuit board 75, and in accordance with this insertion, the rib 100 of the circuit board holder 76 is inserted into the slit 102 of the circuit board 75. In this manner, the circuit board 75 is mounted on the inclined surface 98 of the circuit board holder 76 in an inclined state with respect to the horizontal direction. The circuit board 75 is supported by the circuit board holder 76 such that the wall protrudes further in a direction of gravity than the circuit board 75 regardless of the orientation (optional orientation) that the circuit board holder 76 is mounted on the plane. An identification seal 104 (identification label) which identifies the mounted circuit board 75 is adhered to at least a part of an upper surface 103 of the circuit board holder 76 in the embodiment. The identification seal 104 has the same color as the color of the liquid contained in the liquid container 21 corresponding to the circuit board holder 76 or as the color of the liquid contained in a liquid filler source 126 described below.

As illustrated in FIG. 7B, in a state in which the circuit board 75 is mounted in the circuit board holder 76, the circuit board 75 is in a state in which the rotation about the boss 99 within the inclined surface 98 is regulated by the rib 100. Small gaps are respectively provided between the round hole 101 and the boss 99, and between the slit 102 and the rib 100, and thus the mounted circuit board 75 can be detached from the circuit board holder 76.

Although only one is illustrated in FIGS. 7A and 7B, groove-shaped portions 107 are formed in side wall portions 105 respectively at both sides in the concave portion 97 of the circuit board holder 76 in the left/right direction X, which intersects the insertion direction to the mounting section 31. The groove-shaped portions 107 extend in the insertion direction and each has a chamfer portion 106 at the ends in the insertion direction. The projection portion 80, which abuts against the leaf spring 79 in the upper frame 35, is formed on the upper surface 103 of the circuit board holder 76.

Next, configuration of the opening/closing cover 74 will be described with reference to FIGS. 8A, 8B and 8C. In the embodiment, the opening/closing cover 74 is detachably attached to the slider 34, and while the opening/closing cover 74 is in the position that closes the filler port 73, a load is applied to the rotation around the rotary shaft 89, whereby the rotation is suppressed.

Figure 8A:
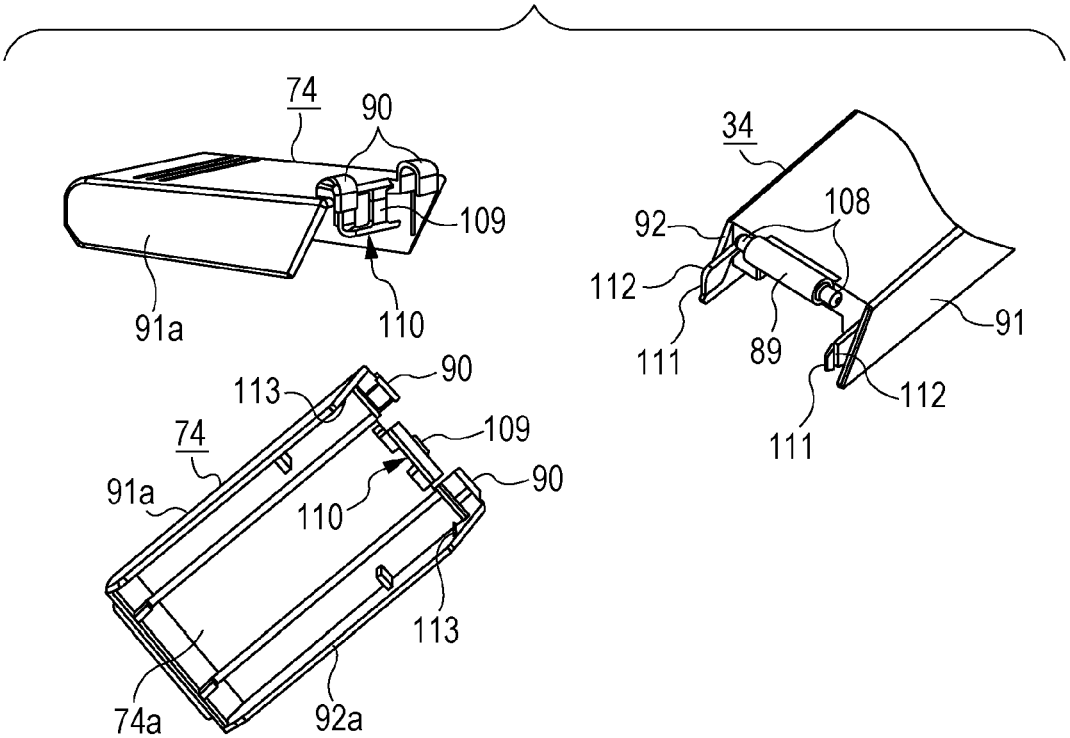
FIG. 8A is a perspective view illustrating a configuration of an opening/closing cover.

As illustrated in FIG. 8A, the opening/closing cover 74 has two substantially semi-cylindrical bearing portions 90 for engaging with both side shaft end portions 108 of the rotary shaft 89 of the slider 34, and an abutment portion 109 which abuts the rotary shaft 89 at the substantially central portion thereof in the axial direction, and from the opposite direction than do the bearing portions 90. The abutment portion 109 is provided at a hook-shaped tip of a hook portion 110. The hook portion 110 has a substantially J-shape when viewed from the short direction, and has two flexible plate-shaped portions formed to protrude from the opening/closing cover 74 at the inner surface (rear surface 74*a*) side thereof, which opposes the filler port 73. During engagement of the two bearing portions 90 with the shaft end portions 108 of the rotary shaft 89, the abutment portion 109 is temporarily displaced by the rotary shaft 89 following the flexural displacement of the hook portion 110. Then, in a state in which the bearing portions 90 are engaged with the shaft end portions 108 of the rotary shaft 89, the hook portion 110 recovers from its flexural displacement condition so the abutment portion 109 is engaged with the rotary shaft 89 in a substantially abutting state. In this manner, the opening/closing cover 74 is configured to be pivotally supported with respect to the rotary shaft 89.

Extended portions 111 are respectively provided in the side wall portions 91 and 92 of the slider 34 at both short direction sides of the slider 34 so as to extend in the longitudinal direction. Groove portions 112 are formed in the extended portions 111 following the vertical direction. On the other hand, convex portions 113 capable of locking with the groove portions 112 are formed in cover side wall portions 91*a* and 92*a*, which configure a portion of the side wall portions 91 and 92 of the slider 34 in the opening/closing cover 74, at positions corresponding to the groove portions 112 in a state in which the opening/closing cover 74 attached to the liquid containing body 33 covers the filler port 73.

Figure 8B:
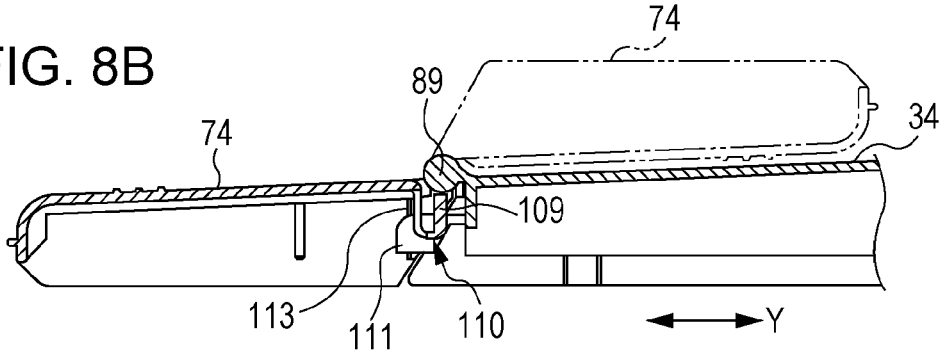
FIG. 8B is a cross-sectional view illustrating a state in which the opening/closing cover is attached to a slider.
Figure 8C:
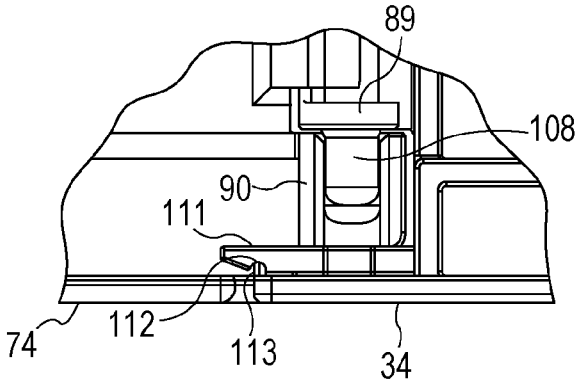
FIG. 8C is a partially enlarged view illustrating a configuration of an engagement portion.

That is, as illustrated in FIGS. 8B and 8C, the opening/closing cover 74 is incorporated into the slider 34 in such a manner that the bearing portions 90 and the abutment portion 109 are engaged with the rotary shaft 89 of the slider 34. When the incorporated opening/closing cover 74 is in the closed position to cover the filler port 73, the convex portions 113 formed on the cover side wall portions 91*a* and 92*a* overlap with the groove portions 112 as viewed in the short direction, and enter into and engage with the groove portions 112. Therefore, as illustrated by the two dot chain line in FIG. 8B, when the opening/closing cover 74 is rotated about the rotary shaft 89 and displaced to the position for opening up the filler port 73, a rotation load is applied to the opening/closing cover 74. In this regard, the groove portions 112 of the slider 34 function as an example of an engagement portion which suppresses the displacement from the closing position to the opened position by engaging with the opening/closing cover 74.

Next, a peripheral configuration of the filler port 73 in the liquid container 21 will be described.

Figure 9A:
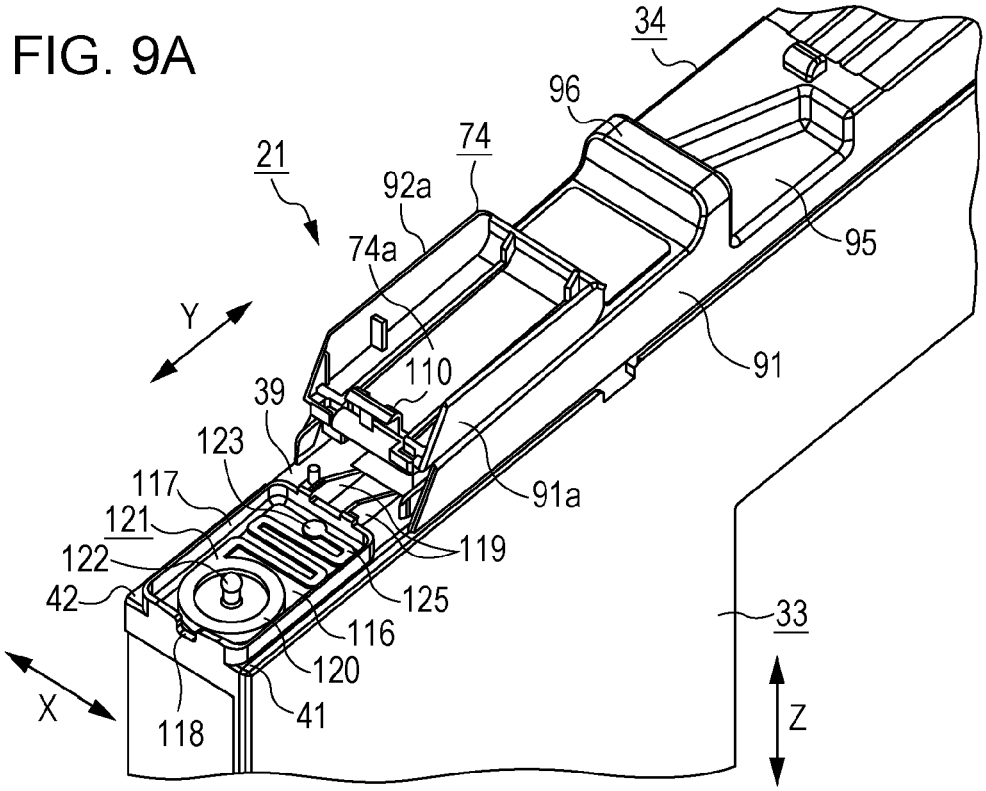
FIGS. 9A and 9B are views illustrating a liquid container in a state in which an opening/closing cover is located at a cover opened position.

As illustrated in FIG. 9A, a liquid receiving surface 116, which is an example of the liquid receiving portion, is formed at the front side portion on the upper surface 39 of the liquid containing body 33, extending in a direction intersecting with the vertical direction Z. The liquid receiving surface 116 has a substantially rectangular shape in a plan view, and the width dimension thereof in the left/right direction X is slightly smaller than the width dimension of the liquid containing body 33 in the left/right direction X.

A peripheral wall portion 117 on the upper surface 39 of the liquid containing body 33 protrudes in the upward direction (i.e., the direction opposite to the pull of gravity), which intersects the liquid receiving surface 116, so as to surround the periphery of the liquid receiving surface 116. A notched groove 118 is formed at the substantial center in the left/right direction X on the front side wall portion of the peripheral wall portion 117 so as to be further recessed downward than the other portions of the peripheral wall portion 117. That is, in the embodiment, the notched groove 118, which is an example of a concave portion, is formed on the peripheral wall portion 117, which is an example of a peripheral position of the filler port 73. On the other hand, a pair of reinforcing ribs 119 is formed on the rear side portion of the peripheral wall portion 117, so as to extend in a rearward direction intersecting with the rear side portion of the peripheral wall portion 117.

A covering member 121 is mounted on the liquid receiving surface 116. The covering member 121 is provided with a covering body 120 having a substantially cylindrical shape and capable of covering or opening the filler port 73 (refer to FIG. 9B). A knob portion 122 having a substantially cylindrical shape protruding upward from the upper side surface thereof is formed at the covering body 120. The knob portion 122 is a portion gripped by a user when the user either detaches the covering body 120 from the filler port 73 or covers the filler port 73 using the covering body 120.

The covering member 121 includes a fixing portion 123 for fixing the covering member 121 to the liquid receiving surface 116. The fixing portion is at the rear side which is the opposite side to the front side provided with the covering body 120, in the state illustrated in FIG. 9A. The fixing portion 123 is fixed to a fixing hole 124 (refer to FIG. 10), which is an opening formed in the liquid receiving surface 116, so as to be capable of rotating about the axial line of the fixing hole 124 and unable to be separated from the liquid receiving surface 116. Therefore, the covering member 121, while being rotatable about the fixing portion 123 with respect to the liquid receiving surface 116, is configured not to be easily detached from the liquid receiving surface 116. However, the covering member 121 can be replaced with a new covering member 121, including the fixing portion 123.

The covering member 121 includes a connection portion 125 which connects the covering body 120 and the fixing portion 123 and, while in a state of being mounted on the liquid receiving surface 116, bends multiple times (in the embodiment, three times in the left/right direction) in a direction that intersects with the vertical direction Z. The connection portion 125 has a rectangular shape in cross-section taken across the direction in which it extends. The rectangular cross-sectional shape has a longer length in the direction following the liquid receiving surface 116 than the length in the direction (vertical direction Z) intersecting with the liquid receiving surface 116. Therefore, when the connection portion 125 is mounted on the liquid receiving surface 116, a contact area with the liquid receiving surface 116 is increased and the connection portion 125 is stably mounted on the liquid receiving surface 116.

The covering body 120, the connection portion 125 and the fixing portion 123, which configure the covering member 121, are formed of an elastomer such as rubber or resin and are elastically deformable. Therefore, in the state illustrated in FIG. 9A, the covering body 120 is fitted into the filler port 73 in an elastically deformed state, whereby the filler port 73 is covered so that there is no gap between the covering body 120 and the filler port 73.

As illustrated in FIG. 9A, the covering body 120 when detached from the filler port 73 can be mounted on a rear surface 74*a* (an example of the bottom surface) of the opening/closing cover 74 when the opening/closing cover 74 is in the opened position. The area of the rear surface 74*a* of the opening/closing cover 74 is larger than a projection area in a case where the covering body 120 is projected in a direction in the vertical direction Z. Thus, the covering body 120 can be stably mounted.

Furthermore, the rear surface 74*a* of the opening/closing cover 74 forms a downward sloping surface to the front portion where the filler port 73 is located, when the opening/closing cover 74 is in the opened position (the state illustrated in FIG. 9A). When the opening/closing cover 74 is in the opened position, the cover side wall portions 91*a* and 92*a* face upward at both side ends of the rear surface 74*a* of the opening/closing cover 74. Therefore, when the covering body 120 to which ink clings is mounted on the rear surface 74*a* of the opening/closing cover 74 while the opening/closing cover 74 is in the opened position, the cover side wall portions 91*a* and 92*a* function as an example of a blocking portion, which reduces the possibility of ink leaking out from the opening/closing cover 74.

Figure 9B:
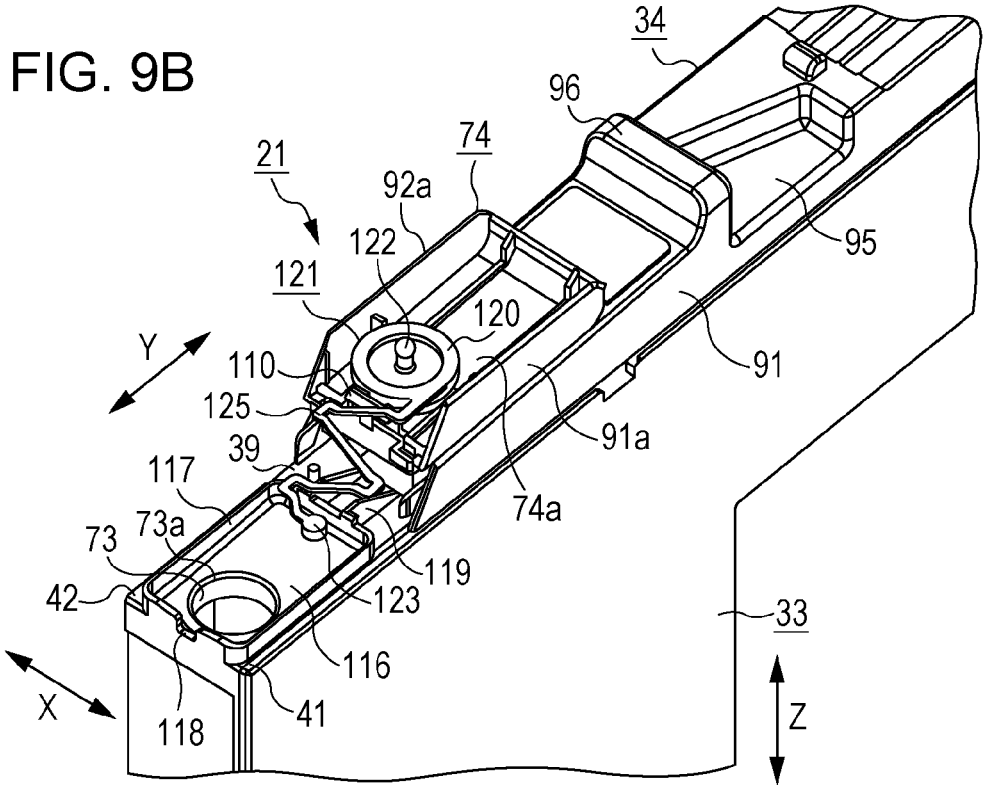

FIG. 9B illustrates the liquid container 21 in a state in which the covering body 120 is detached from the filler port 73, and is mounted on the rear surface 74*a* of the opening/closing cover 74. As illustrated in FIG. 9B, by exposing the filler port 73, which is an opening formed on a portion of the liquid receiving surface 116, a user can pour ink into the liquid containing body 33 (first ink chamber 151, refer to FIG. 14) through the filler port 73. In addition, an opening edge 73*a* serving as the upper end edge of the filler port 73 is chamfered in an inclined shape, so that when the ink is poured it easily flows into the filler port 73.

As illustrated in FIG. 9B, the length of the connection portion 125 of the covering member 121 is just long enough to enable the covering body 120 to be mounted on the rear surface 74*a* of the opening/closing cover 74, while the opening/closing cover 74 is in the opened position. In the state illustrated in FIG. 9B, the connection portion 125 is in a slightly stretched state, and the covering body 120 is placed on the rear surface 74*a* of the opening/closing cover 74 and in abutment with the hook portion 110 of the opening/closing cover 74.

Figure 10:
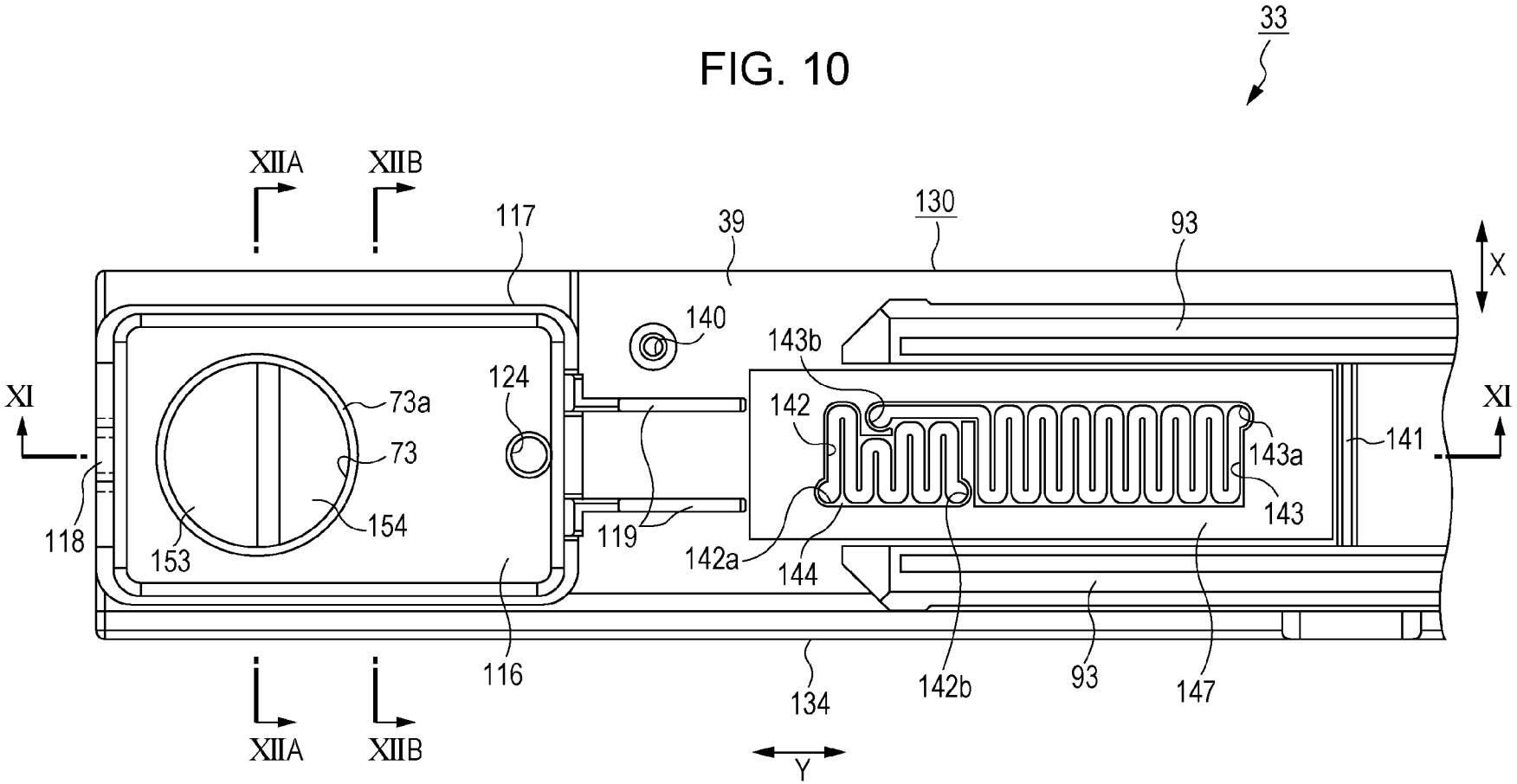
FIG. 10 is a plan view of a liquid container.

As illustrated in FIG. 10, in the vicinity of the wall portion at the rear side (right side in FIG. 10) of the peripheral wall portion 117 on the liquid receiving surface 116, the fixing hole 124 to which the fixing portion 123 of the covering member 121 is inserted and fixed is formed to open in the direction intersecting with the liquid receiving surface 116. The fixing hole 124 is provided such that the central position of the fixing hole 124 in the left/right direction X substantially coincides with the central position of the filler port 73 in the left/right direction X. The fixing hole 124 is formed to open on the liquid receiving surface 116 in the same manner as the filler port 73, but does not communicate with the first ink chamber 151.

Figure 11:
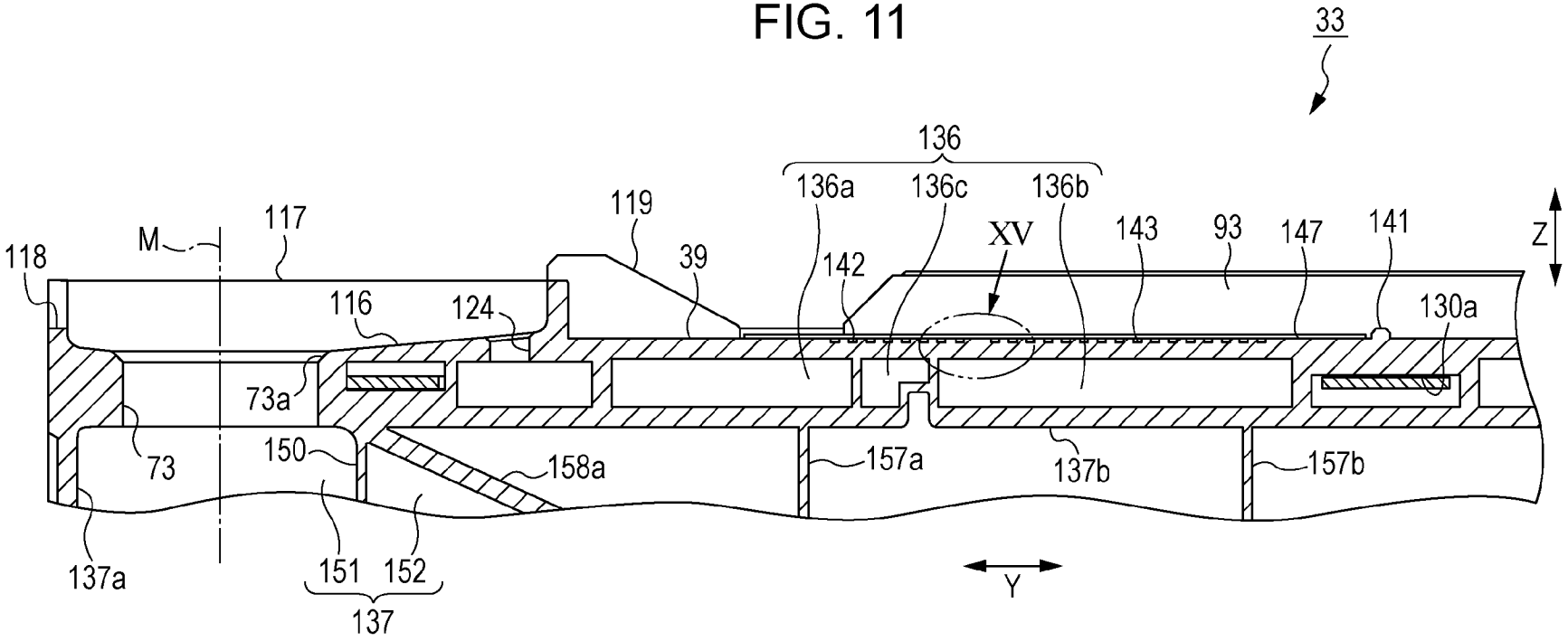
FIG. 11 is a view illustrating a cross-sectional structure of a liquid container, and is a cross-sectional view taken along the line XI-XI in FIG. 10.

As illustrated in FIG. 11, the liquid receiving surface 116 is formed so as to be inclined downward (in the direction of gravity) in the front/rear direction Y toward the filler port 73. Therefore, the vicinity of the fixing hole 124, which is remote from the filler port 73, is the highest location on the liquid receiving surface 116. That is, the fixing portion 123 of the covering member 121 when fixed in the fixing hole 124 is located on the liquid receiving surface 116 at a higher position than the periphery of the filler port 73. Thus, even if ink flows onto the liquid receiving surface 116 when the ink is poured into the filler port 73, the ink is unlikely to adhere thereto.

Figure 12A:
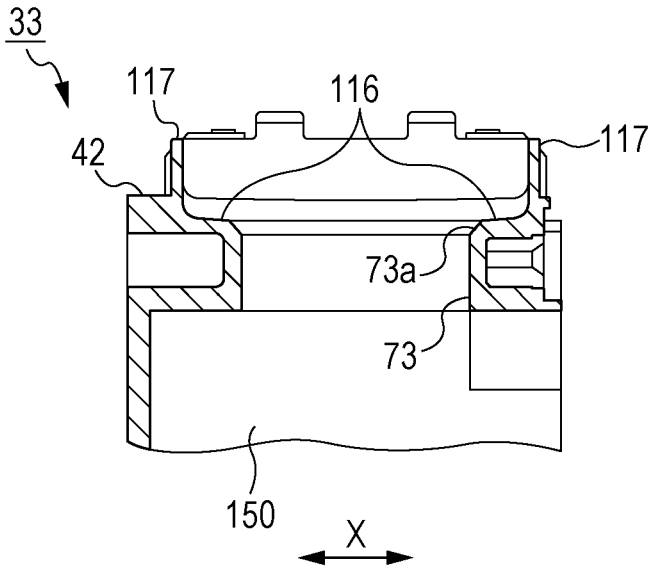
FIGS. 12A and 12B are views illustrating a cross-sectional structure of a liquid container.
Figure 12B:
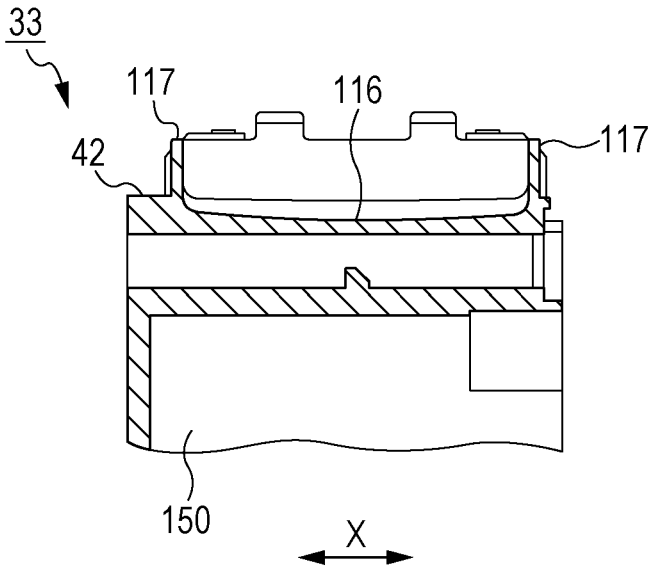

As illustrated in FIG. 12A, the liquid receiving surface 116 is formed to incline downward toward the filler port 73 also in the left/right direction X. As illustrated in FIG. 12B, at a position that is near the fixing hole 124 and that is remote from the filler port 73, the liquid receiving surface 116 is formed to incline downward to the center in the left/right direction X.

Next, an internal configuration of the liquid containing body 33 will be described.

Figure 13:
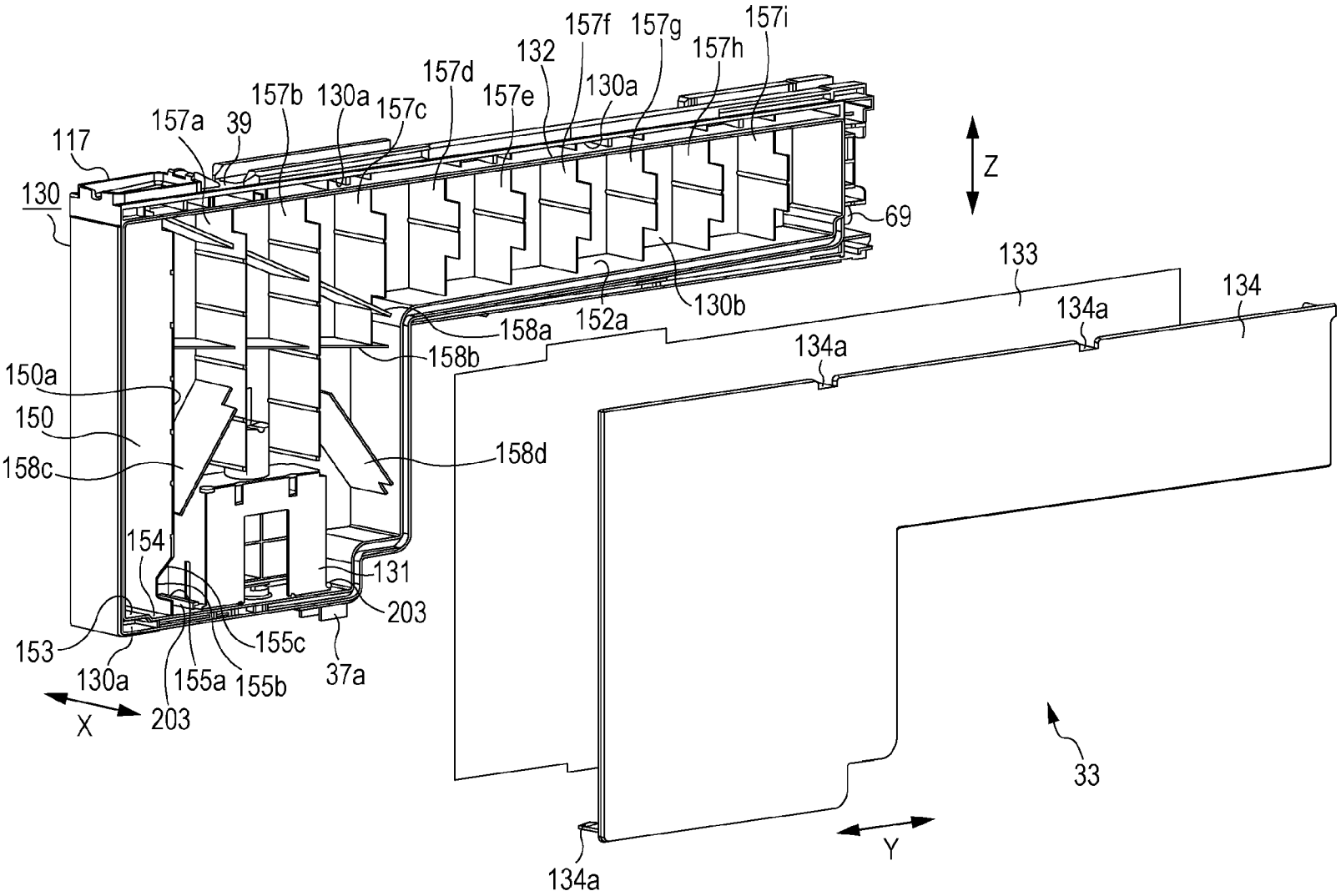
FIG. 13 is an exploded perspective view of a liquid container.

As illustrated in FIG. 13, the liquid containing body 33 includes a containing body case 130 which has a substantially L-shape in a side view when viewed from the left/right direction X, a float valve 131 which is a type of valve mechanism contained inside the containing body case 130, a film 133 bonded (for example, subjected to heat welding) to a case opening portion 132 of the containing body case 130, and a cover 134 made of the resin, which covers the case opening portion 132 crossing over the film 133. The containing body case 130 is integrally molded so as to be open at the right side surface. Locking portions 130*a*, which lock with claw portions 134*a* formed in a cover 134, are formed outside the annular case opening portion 132.

Figure 14:
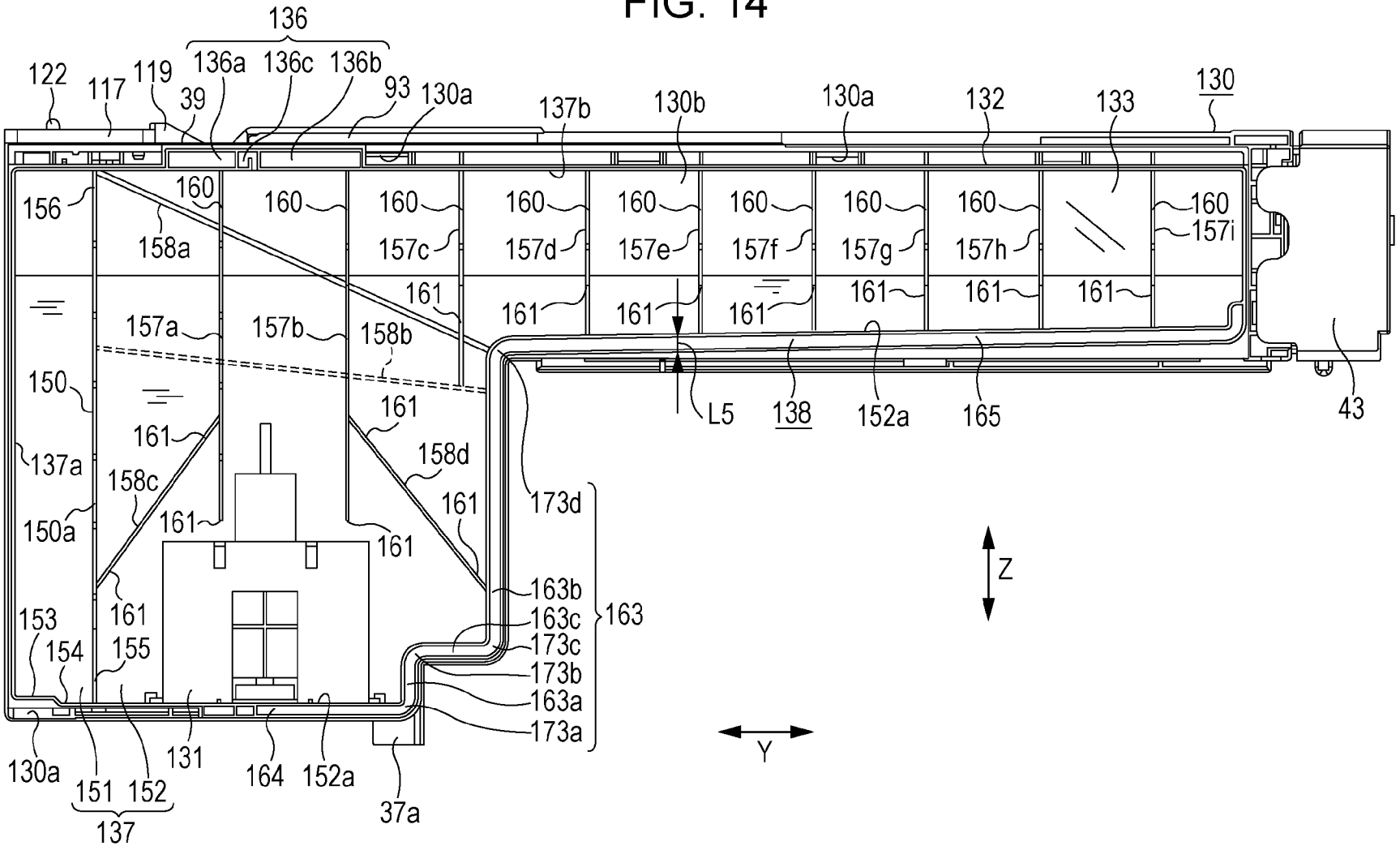
FIG. 14 is a side view of a containing body case to which a film is bonded.

As illustrated in FIG. 14, when the film 133 is adhered to the case opening portion 132 of the containing body case 130, a space area enclosed by the containing body case 130 and the film 133 functions as an air chamber 136, an ink chamber 137, and an outlet flow channel 138. The air chamber 136 communicates with atmosphere. The ink chamber 137 is an example of a liquid containing chamber containing ink. The outlet flow channel 138 is an example of a liquid flow channel. In the outlet flow channel 138, one end thereof communicates with the ink chamber 137, and the other end side is the outlet port 69 (refer to FIGS. 4 and 5) which introduces the ink contained in the ink chamber 137 into the liquid ejecting head 24 (printer 11 side).

Next, a configuration of the air chamber 136 and a configuration for incorporating air to the air chamber 136 will be described.

As illustrated in FIG. 10, an atmosphere communication hole 140, which is in communication with atmosphere, and a positioning rib 141, which extends in the left/right direction X, are formed on the upper surface 39, in which the filler port 73 of the containing body case 130 is formed. One or more (two in the present embodiment) meandering grooves 142 and 143, which are formed in a meandering shape, and a meandering convex portion 144, which surrounds the periphery of the meandering grooves 142 and 143, are formed between the above-described reinforcing ribs 119 and the positioning rib 141.

Figure 15:
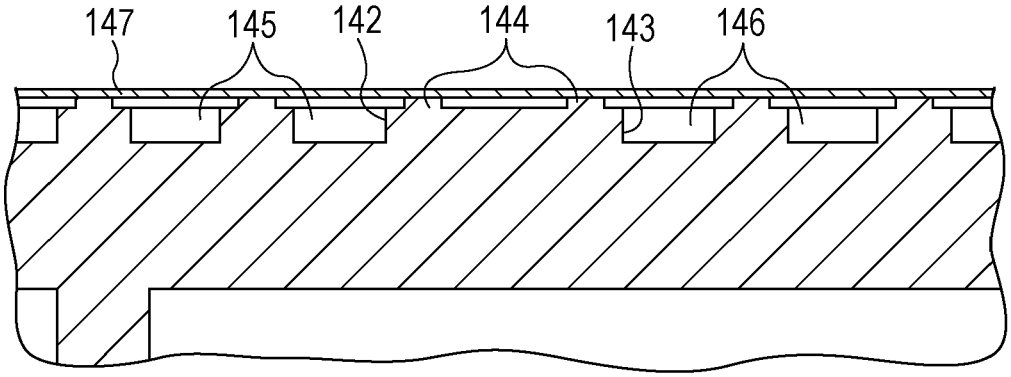
FIG. 15 is an enlarged view of a "D" section in FIG. 11.

As illustrated in FIGS. 10 and 15, an air passage forming film 147 is adhered (for example, heat welded) to the upper surface 39 of the containing body case 130, forming air passages 145 and 146 by covering the meandering grooves 142 and 143. That is, when the air passage forming film 147 is adhered to the meandering convex portion 144 as positioned by the reinforcing ribs 119 and the positioning rib 141, the first meandering groove 142 and the air passage forming film 147 form a first air passage 145. Further, the second meandering groove 143 and the air passage forming film 147 form a second air passage 146.

As illustrated in FIGS. 10 and 11, the atmosphere communication hole 140 is formed in the first section at a position between the filler port 73 and the second section, and is in communication with the first air chamber 136*a*. One end 142*a* of the first meandering groove 142 communicates with the first air chamber 136*a*, and the other end 142*b* communicates with the second air chamber 136*b*. One end 143*a* of the second meandering groove 143 communicates with the second air chamber 136*b*, and the other end 143*b* communicates with a third air chamber 136*c*.

Figure 16:
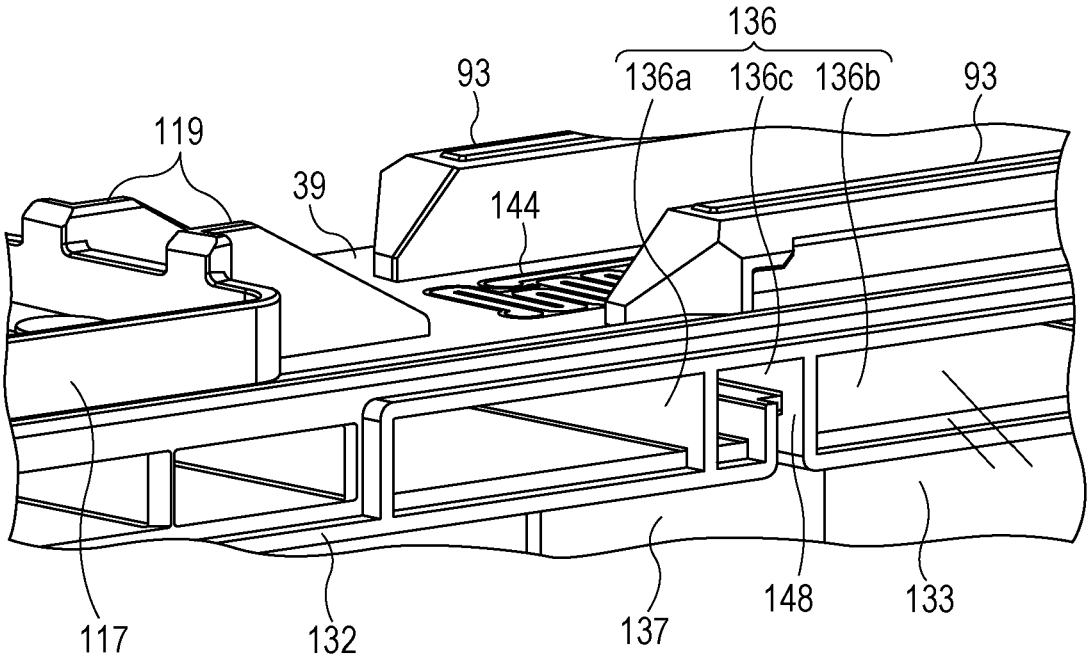
FIG. 16 is an enlarged view of a containing body case to which a film is bonded.

As illustrated in FIG. 16, an air intake port 148 is formed at the third air chamber 136*c*, and the third air chamber 136*c* and the ink chamber 137 communicate with each other through the air intake port 148. Therefore, for example, if the ink contained in the ink chamber 137 is drawn out so that the pressure inside the ink chamber 137 decreases, the outside air taken in from the atmosphere communication hole 140 is drawn into the ink chamber 137 through the first air chamber 136*a*, the first air passage 145, the second air chamber 136*b*, the second air passage 146, and the third air chamber 136*c*.

Next, the ink chamber 137 will be described.

As illustrated in FIG. 14, the ink chamber 137 is shaped in the same way as the liquid containing body 33, such that the height dimension in the front side in the vertical direction Z is higher than the height dimension in the rear side in the vertical direction Z. The ink chamber 137 is divided into the first ink chamber 151, which is an example of the first liquid containing chamber, and the second ink chamber 152, which is an example of the second liquid containing chamber, by a partition wall 150, which intersects with a ceiling surface 137*b*, which is an example of the filler port forming surface in which the filler port 73 is formed in the ink chamber 137.

The partition wall 150 extends in the vertical direction Z and intersects with an opposing surface (bottom surface) 153, which opposes the ceiling surface 137*b*. In addition, the width of the partition wall 150 in the left/right direction X is approximately equal to the width from a side wall 130*b* at the left side of the containing body case 130 to the case opening portion 132. The partition wall 150 is integrally molded with the containing body case 130 and located near the front side where the height in the vertical direction Z in the ink chamber 137 is large. The partition wall 150 is orthogonal to the side wall 130*b* of the containing body case 130, and protrudes from the side wall 130*b* toward the case opening portion 132 (front side in FIG. 14). Therefore, the vertical direction Z height of the second ink chamber 152 at the first ink chamber 151 side of the second ink chamber 152 is approximately equal to the vertical direction Z height of the first ink chamber 151, and is greater than the height in the vertical direction Z at the rear side, which is remote from the first ink chamber 151. The volume of the first ink chamber 151 is smaller than the volume of the second ink chamber 152.

Specifically, as illustrated in FIG. 11, the partition wall 150 is formed to be substantially line-symmetrical with a front wall surface 137*a* in the first ink chamber 151 about an imaginary filler line M that passes through the center of the opening of the filler port 73 and extends in the vertical direction Z. That is, the filler port 73 is formed on the ceiling surface 137*b* of the first ink chamber 151 at the further front side than the partition wall 150.

Figure 17:
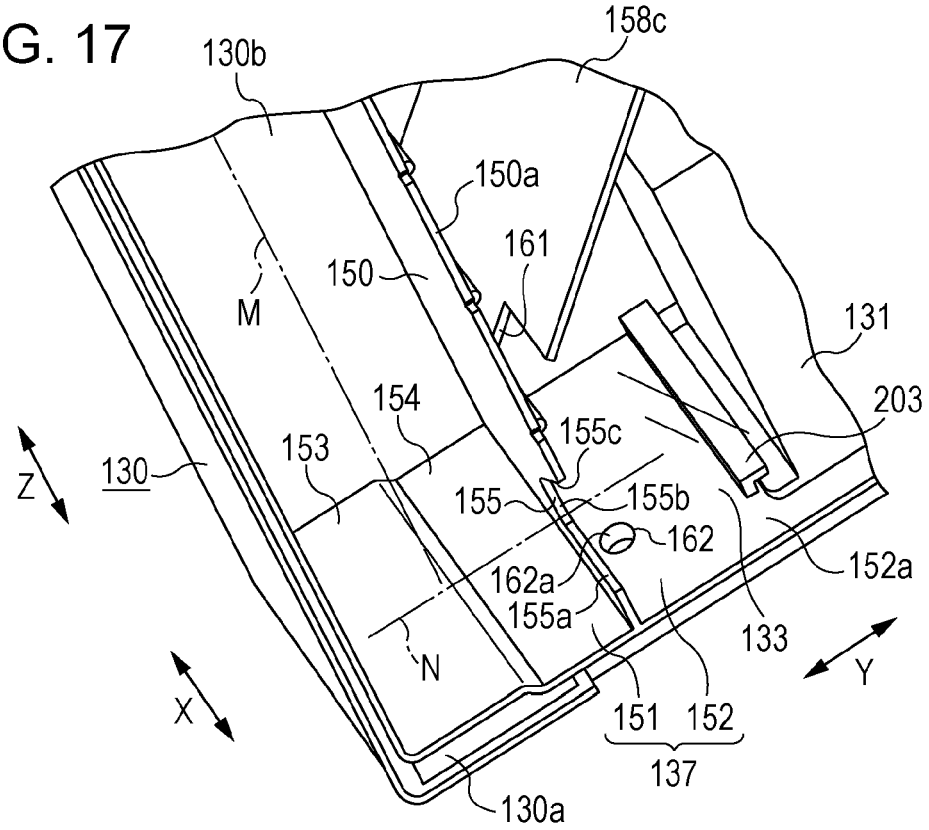
FIG. 17 is an enlarged view of a containing body case to which a film is bonded.

As illustrated in FIG. 17, a concave portion 154, which is recessed in the direction of gravity and away from the filler port 73, is disposed at a position nearer the partition wall 150 than the opposing surface 153 in the first ink chamber 151, and shifted from the filler port 73 in a direction that intersects the direction of gravity. That is, the concave portion 154 is disposed following the left/right direction X at a position shifted from the imaginary filler line M in the front/rear direction Y.

As illustrated in FIGS. 14 and 17, when the film 133 is adhered to the partition wall 150, a recessed portion from an adhesion surface 150*a* to the side wall 130*b* side functions as a wall communication opening (wall communication opening portion) 155, which is an example of a communication opening, and also functions as a wall ventilation opening (wall ventilation opening portion) 156, which is an example of a ventilation opening. That is, the first ink chamber 151 and the second ink chamber 152 communicate with each other through the wall communication opening 155 and the wall ventilation opening 156. The wall ventilation opening 156 is formed at the upper end of the partition wall 150 adjacent with the ceiling surface 137*b*, and is located further up than the wall communication opening 155.

On the other hand, the wall communication opening 155 is located at the opposing surface 153 side further down than the wall ventilation opening 156, and is formed at a position separated upward from the concave portion 154. The wall communication opening 155 is formed such that a lower surface 155*a* located at the lower side of the wall communication opening 155 is itself substantially horizontal, and substantially orthogonal with respect to a rear surface 155*b* at the left side. In contrast, an upper surface 155*c* located at the upper side (direction opposite to the pull of gravity) is non-orthogonal with respect to the rear surface 155*b*. That is, the upper surface 155*c* is inclined in a direction that intersects the horizontal direction, and separates from the lower surface 155*a* as it separates from the rear surface 155*b*. In addition, the wall communication opening 155 has a relationship where a communication opening axial line N, which passes through the center of the opening of the wall communication opening 155 and is orthogonal to (in the embodiment, extending in the front/rear direction Y) the opening cross-section, is non-parallel to and does not intersect with the imaginary filler line M. That is, the wall communication opening 155 is formed at a position twisted with respect to the filler port 73.

The area of the wall communication opening 155 corresponds to the area of the recessed portion in the partition wall 150, is smaller than the area of the partition wall 150, and is smaller than the area of the filler port 73. The area of the wall ventilation opening 156 is smaller than the area of the wall communication opening 155.

As illustrated in FIG. 14, in the second ink chamber 152, one or more (nine in the embodiment) intersecting rib portions 157*a* to 157*i* which intersect with the ceiling surface 137*b* and extend following the vertical direction Z are formed separated by spacing in the front/rear direction Y. Further, one or more (four in the embodiment) laterally inclined rib portions 158*a* to 158*d*, which intersect with the vertical direction Z and the front/rear direction (horizontal direction) Y, are formed in the second ink chamber 152, as an example of an eave portions. The intersecting rib portions 157*a* to 157*i* and the laterally inclined rib portions 158*a* to 158*d* are integrally molded with the containing body case 130 so as to be orthogonal to the side wall 130*b* of the containing body case 130 and protrude from the side wall 130*b* toward the case opening portion 132 side (front side in FIG. 14).

The intersecting rib portions 157*a* to 157*i* have a in the left/right direction X that is approximately equal to the width from the side wall 130*b* of the containing body case 130 to the case opening portion 132. Further, the sections of the intersecting rib portions 157*a* to 157*i* at the upper end, which are adjacent the ceiling surface 137*b*, are recessed toward the side wall 130*b* side. Therefore, if the film 133 is adhered to an adhesion surface (right end surface) of the intersecting rib portions 157*a* to 157*i*, the recessed portions function as rib ventilation openings (rib ventilation opening portions) 160, which are examples of ventilation opening. The area of the rib ventilation openings 160 is larger than the area of the wall ventilation opening 156, and the sizes of the rib ventilation openings 160 in the vertical direction Z are larger than the size of the wall ventilation opening 156 in the vertical direction Z. That is, the lower side opening edge of the wall ventilation opening 156 is located at a position closer to the ceiling surface 137*b* than the lower side opening edges of the rib ventilation openings 160. Therefore, the wall ventilation opening 156 is formed nearer the ceiling surface 137*b* than the rib ventilation openings 160.

The first intersecting rib portion 157*a*, which is closest to the partition wall 150, and the second intersecting rib portion 157*b*, which is second closest to the partition wall 150, are formed at a position near the front where the size of the second ink chamber 152 in the vertical direction Z is large, so as to form a gap between themselves and a bottom surface 152*a*. Therefore, if the film 133 is adhered to the adhesion surfaces of the first intersecting rib portion 157*a* and the second intersecting rib portion 157*b*, the lower ends of the first intersecting rib portion 157*a* and the second intersecting rib portion 157*b* function as rib communication openings (rib communication opening portions) 161, as examples of communication openings through which ink can pass. The bottom surface 152*a* of the second ink chamber 152 is a surface located at the lower side of the second ink chamber 152 in the vertical direction Z, and is partially bent and inclined corresponding to the shape of the second ink chamber 152. The float valve 131 is contained in the space formed by the first intersecting rib portion 157*a*, the second intersecting rib portion 157*b* and the bottom surface 152*a*.

The third intersecting rib portion 157*c* to the ninth intersecting rib portion 157*i* are formed at positions nearer the rear of the second ink chamber 152. A section at the lower end of each of the third intersecting rib portion 157*c* to the ninth intersecting rib portion 157*i* is recessed toward the side wall 130*b*. Therefore, when the film 133 is adhered to the adhesion surfaces of the right end surface of third intersecting rib portion 157*c* to the ninth intersecting rib portion 157*i*, the recessed portions at the side wall 130*b* side at the lower end of the third intersecting rib portion 157*c* to the ninth intersecting rib portion 157*i* function as rib communication openings 161, which are examples of communication openings through which the ink can pass. That is, spaces in the second ink chamber 152 partitioned by the intersecting rib portions 157*a* to 157*i* are in communication with each other through the rib communication openings 161 and the rib ventilation openings 160, which are formed at the ceiling surface 137*b* side, rather than through the rib communication openings 161.

As illustrated in FIGS. 13 and 14, the first laterally inclined rib portion 158*a* located at the highest position is formed to incline downward from where it intersects the partition wall 150 and the ceiling surface 137*b* toward the rear. The second laterally inclined rib portion 158*b*, which is located at the second highest position, is formed to incline to the rear from a position lower than the first laterally inclined rib portion 158*a*, more gradually downward than the first laterally inclined rib portion 158*a* in the partition wall 150. That is, the first laterally inclined rib portion 158*a* and the second laterally inclined rib portion 158*b* are formed to intersect with the partition wall 150 and to intersect with the front/rear direction Y. The width of the first laterally inclined rib portion 158*a* and the second laterally inclined rib portion 158*b* in the left/right direction X is narrower than the width of the partition wall 150 and the intersecting rib portions 157*a* to 157*i*. Therefore, when the film 133 is adhered to the case opening portion 132, a gap is formed between the film 133, and the first laterally inclined rib portion 158*a* and the second laterally inclined rib portion 158*b*. Accordingly, the spaces partitioned by the first laterally inclined rib portion 158*a* and the second laterally inclined rib portion 158*b* communicate with each other through the gap.

The third laterally inclined rib portion 158*c*, which is an example of a first eaves portion, and the fourth laterally inclined rib portion 158*d*, which is an example of a second eaves portion, are formed at a position that is nearer the bottom surface 152*a* than the second laterally inclined rib portion 158*b* and that is to the upper side of the float valve 131. The third laterally inclined rib portion 158*c* is formed between the partition wall 150 and the first intersecting rib portion 157*a*, and the fourth laterally inclined rib portion 158*d* is formed at the further rear side than the second intersecting rib portion 157*b*. The third laterally inclined rib portion 158*c* and the fourth laterally inclined rib portion 158*d* are formed to be line-symmetrical with each other with respect to an axial line (not illustrated) that follows the direction of gravity and passes through the center of the float valve 131, and to be respectively inclined downward from the center of the float valve 131 toward their end portions. That is, the distance from the upper end of the third laterally inclined rib portion 158*c* to the upper end of the fourth laterally inclined rib portion 158*d* is shorter than the distance from the lower end of the third laterally inclined rib portion 158*c* to the lower end of the fourth laterally inclined rib portion 158*d*.

The width of the third laterally inclined rib portion 158*c* and the fourth laterally inclined rib portion 158*d* in the left/right direction X is approximately equal to the width of partition wall 150. Both ends of the third laterally inclined rib portion 158*c* and the fourth laterally inclined rib portion 158*d* are recessed toward the side wall 130*b* side. Therefore, when the film 133 is adhered to the adhesion surfaces (right end surfaces) of the third laterally inclined rib portion 158*c* and the fourth laterally inclined rib portion 158*d*, the recessed portions at the side wall 130*b* side function as the rib communication openings 161 through which ink can pass. Accordingly, the spaces partitioned by the third laterally inclined rib portion 158*c* and the fourth laterally inclined rib portion 158*d* communicate with each other via the rib communication openings 161.

Figure 18:
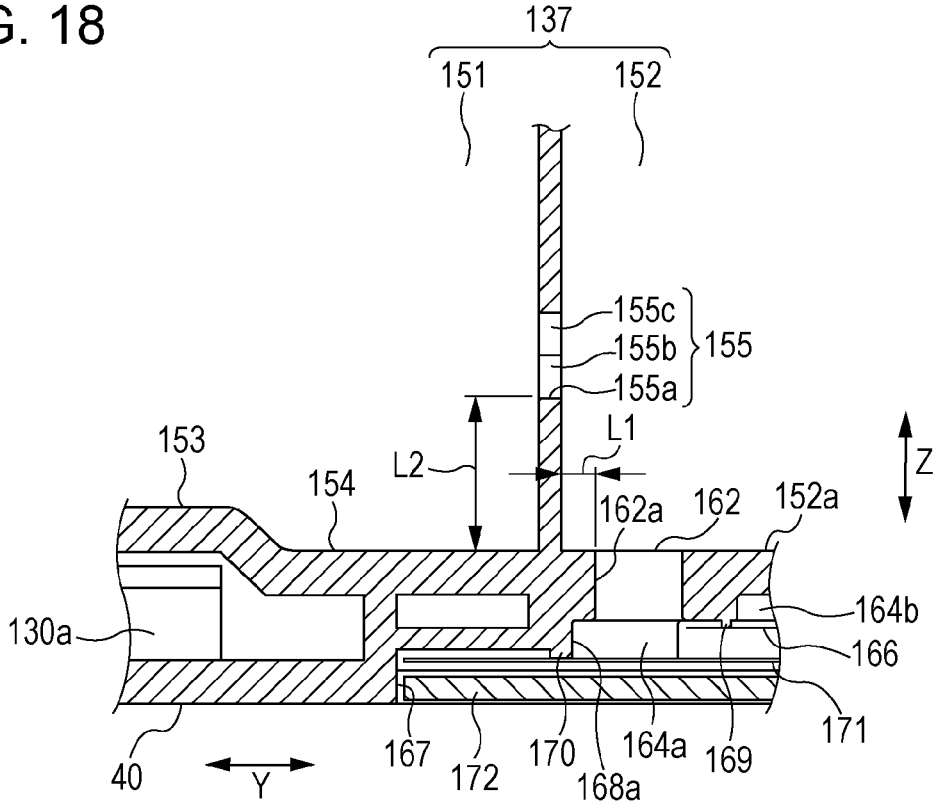
FIG. 18 is a partial cross-sectional view of a containing body case.

As illustrated in FIGS. 17 and 18, a flow channel opening (flow channel opening portion) 162 communicating with the outlet flow channel 138 is formed on the bottom surface 152*a* of the second ink chamber 152. That is, the laterally inclined rib portions 158*a* to 158*d* are located at the further upper side position than the flow channel opening 162 and the float valve 131 so as to cover the flow channel opening 162 and the float valve 131 from above. A distance L1 between the flow channel opening 162 and the partition wall 150 in the front/rear direction Y is shorter than a distance L2 between the opposing surface 153 and the wall communication opening 155 in the vertical direction Z. The distance L2 in the embodiment corresponds to a distance between the upper end of the concave portion 154 formed on the opposing surface 153 and the lower end of the wall communication opening 155. That is, the flow channel opening 162 is formed on the bottom surface 152*a* of the second ink chamber 152, at a position near the partition wall 150.

Next, the outlet flow channel 138 will be described.

As illustrated in FIG. 14, the outlet flow channel 138 is formed following the bottom surface 152*a* of the second ink chamber 152 at the lower side of the second ink chamber 152. The outlet flow channel 138 has a bent flow channel portion 163 which is formed so as to be bent to match the shape of the liquid containing body 33 so that the ink flows while changing flow direction (hereinafter, referred to as a "flowing direction") of the ink. The outlet flow channel 138 further has a connection flow channel portion 164 connecting the flow channel opening 162 and the bent flow channel portion 163, and an inclined flow channel portion 165 connecting the bent flow channel portion 163 and the outlet port 69.

Figure 19:
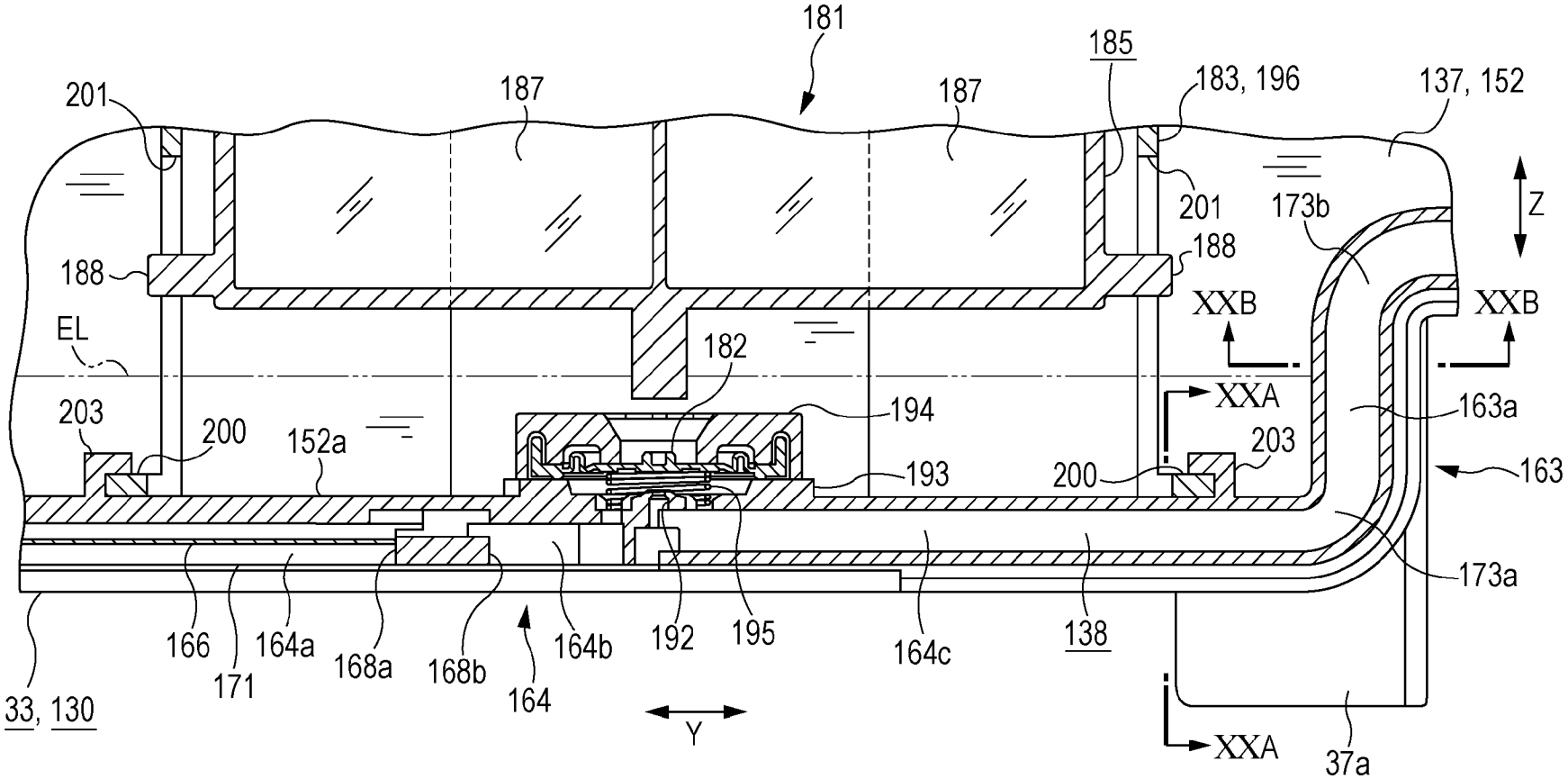
FIG. 19 is a partial cross-sectional view of a containing body case.

As illustrated in FIGS. 18 and 19, the connection flow channel portion 164 includes a filter 166 having a substantially rectangular shape in a bottom view when viewed from below. That is, the connection flow channel portion 164 is divided, by the filter 166, into a first connection flow channel portion 164*a* on the flow channel opening 162 side and a second connection flow channel portion 164*b*, which is further to the float valve 131 side than is the filter 166. The connection flow channel portion 164 further includes a third connection flow channel portion 164*c* which is located further to the outlet port 69 side than is the float valve 131 and is connected to the bent flow channel portion 163.

Figure 20A:
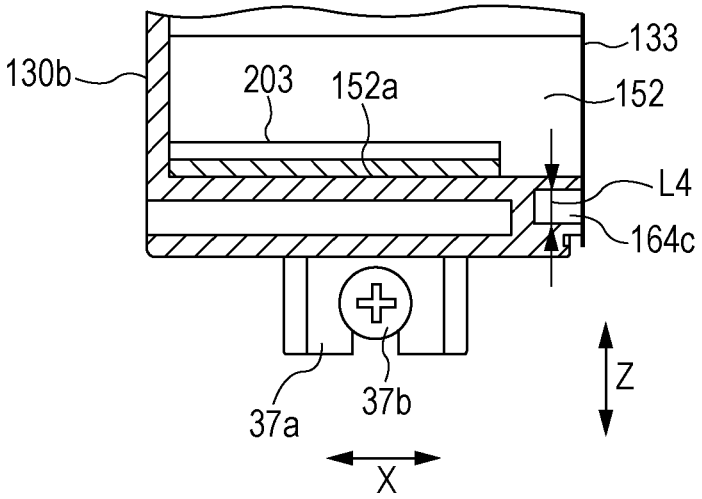
FIG. 20A is a cross-sectional view (in an arrow view) taken along the line XXA-XXA in FIG. 19.
Figure 20B:
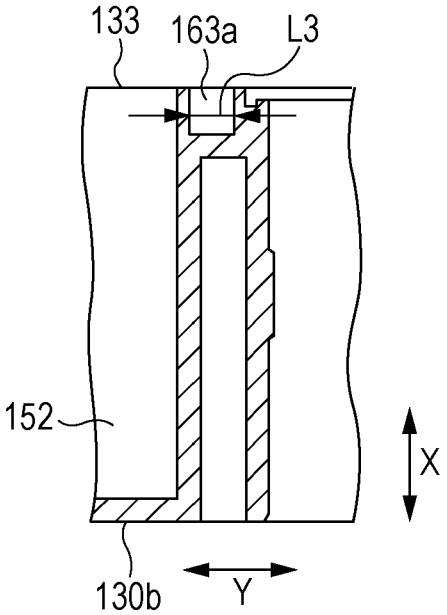
FIG. 20B is a cross-sectional view (in an arrow view) taken along the line XXB-XXB in FIG. 19.

As illustrated in FIGS. 20A and 20B, the cross-sectional area of the bent flow channel portion 163 is larger than the cross-sectional area of the third connection flow channel portion 164*c*. The outlet flow channel 138 has an approximately uniform width in the left/right direction X following the flowing direction. Therefore, a width L3 of the bent flow channel portion 163 (in FIG. 20B, a first upright flow channel portion 163*a*) in a direction (front/rear direction Y of the first upright flow channel portion 163*a*) that is orthogonal to the flowing direction and that is orthogonal to the left/right direction X, is wider than a width L4 of the third connection flow channel portion 164*c* in a direction (vertical direction Z) that is orthogonal to the flowing direction and that is orthogonal to the left/right direction X. Further, the cross-sectional area of the inclined flow channel portion 165 is approximately equal to the cross-sectional area of the bent flow channel portion 163. Accordingly, a width L5 (refer to FIG. 14) of the inclined flow channel portion 165 in a direction orthogonal to the flowing direction and orthogonal to the left/right direction X, is wider than the width L4 of the third connection flow channel portion 164*c*.

Figure 21:
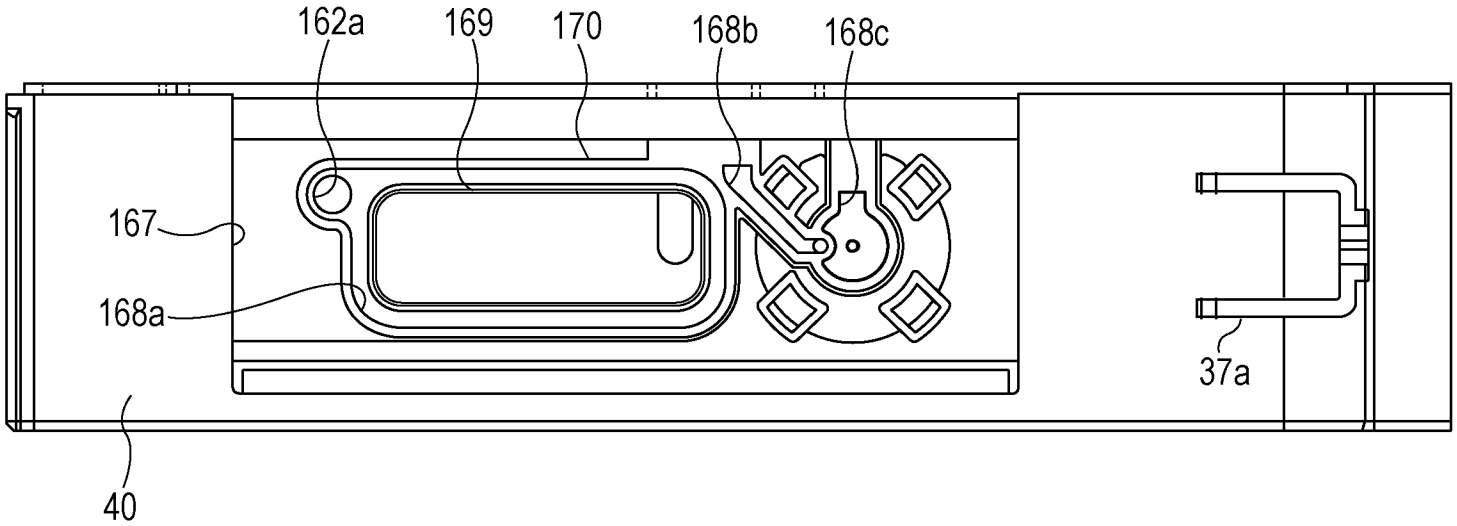
FIG. 21 is a bottom view of a containing body case.

As illustrated in FIGS. 18 and 21, a substantially rectangular-shaped stepped portion 167 recessed at the upper side, which is the ink chamber 137 side, is formed on the lower surface 40 near the front side, in which the height of the containing body case 130 in the vertical direction Z is high. First to third flow channel forming concave portions 168*a* to 168*c* are formed in the stepped portion 167 so as to be recessed in the direction of the ink chamber 137. The other end side of a through-hole 162*a*, which is formed through the bottom surface 152*a* of the second ink chamber 152 and whose one end becomes the flow channel opening 162, is open to the first flow channel forming concave portion 168*a*. The first flow channel forming concave portion 168*a* is formed in a different level such that the inner side of an annular convex portion 169, which has a substantially rectangular shape in a bottom view and to which the filter 166 is adhered, is deeper than the outer side. A flow channel convex portion 170 is formed at the periphery of the first to third flow channel forming concave portions 168*a* to 168*c*. That is, the through-hole 162*a* and the annular convex portion 169 are surrounded by the flow channel convex portion 170.

Accordingly, the connection flow channel portion 164 is formed by adhering the filter 166 to the annular convex portion 169 and adhering (for example, heat welding) a flow channel forming film 171 to the flow channel convex portion 170. That is, when the flow channel forming film 171 is adhered to the flow channel convex portion 170, the first flow channel forming concave portion 168*a* functions as the first connection flow channel portion 164*a* and the second connection flow channel portion 164*b*. In addition, the second flow channel forming concave portion 168*b* functions as the second connection flow channel portion 164*b*. Further, the third flow channel forming concave portion 168*c* functions as the third connection flow channel portion 164*c*. A protection member 172 protecting the flow channel forming film 171 and having a substantially rectangular shape is attached to the stepped portion 167.

As illustrated in FIG. 14, the bent flow channel portion 163 includes one or more (two in the embodiment) upright flow channel portions 163*a* and 163*b* which extend in the vertical direction Z, multiple (four in the embodiment) bent portions 173*a* to 173*d* which are formed at both ends of the upright flow channel portions 163*a* and 163*b*, and a horizontal flow channel portion 163*c* extending in the front/rear direction Y.

That is, the first bent portion 173*a* is located at the lowest position and connects the rear end of the third connection flow channel portion 164*c* and the lower end of the first upright flow channel portion 163*a*. The second bent portion 173*b* is located further upward than the first bent portion 173*a* and connects the upper end of the first upright flow channel portion 163*a* and the front end of the horizontal flow channel portion 163*c*. The third bent portion 173*c* connects the rear end of the horizontal flow channel portion 163*c* and the lower end of the second upright flow channel portion 163*b*. The fourth bent portion 173*d* connects the upper end of the second upright flow channel portion 163*b* and the front end of the inclined flow channel portion 165. Accordingly, the bent flow channel portion 163 is different from the inclined flow channel portion 165 in the flowing direction to which the ink flows, and is bent with respect to the inclined flow channel portion 165.

The inclined flow channel portion 165 is formed to extend in a direction intersecting with the front/rear direction (horizontal direction) Y, so that the rear side end, which is the outlet port 69 side, is at a higher position (in the direction opposite to the direction of gravity) than the front side end, which is the flow channel opening 162 side that is continuous with the fourth bent portion 173*d*. That is, the inclined flow channel portion 165 is continuously inclined upward from the flow channel opening 162 side to the outlet port 69 side. The rear end side of the inclined flow channel portion 165 bends upward into communication with the outlet port 69.

The outlet flow channel 138 is located at the direction of gravity side of the second ink chamber 152 and extends following the bottom surface 152*a*. Therefore, although the portion of the bottom surface 152*a* of the second ink chamber 152 that corresponds to the connection flow channel portion 164 and to the horizontal flow channel portion 163*c* is substantially horizontal, the portion of the bottom surface 152*a* of the second ink chamber 152 that corresponds to the inclined flow channel portion 165 slants downward toward the flow channel opening 162 side.

Next, the float valve 131 will be described.

Figure 22:
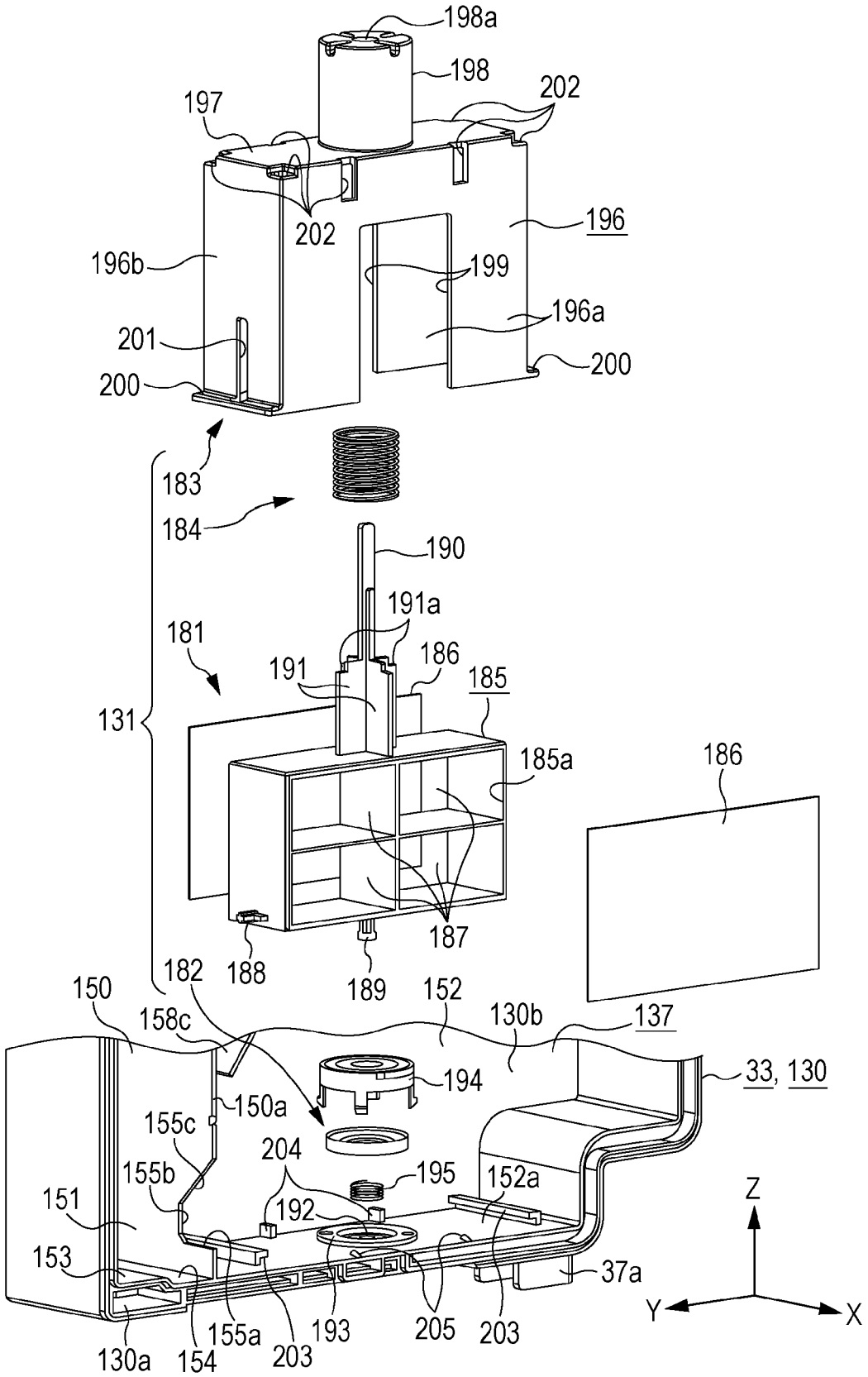
FIG. 22 is an exploded perspective view illustrating a part of a containing body case and each configuring member of a float valve.

As illustrated in FIG. 22, the float valve 131 includes a float member 181 arranged inside the ink chamber 137, a valve body 182 arranged below the float member 181, a regulating case 183 as an example of regulating member arranged at the upper side of the float member 181, and a coil spring 184 as an example of a biasing member arranged between the float member 181 and the regulating case 183. In order to simplify illustration of an attaching structure of the float valve 131 into the ink chamber 137, FIG. 22 illustrates a portion of the containing body case 130 in which the ink chamber 137 is formed, together with the above-described respective configuring members configuring the float valve 131.

Hereinafter, the respective configuring members of the float valve 131 each will be described.

The float member 181 has a rectangular-shaped frame body 185, the interior of which is partitioned into multiple (four in the embodiment) spatial regions. A thin film member 186 formed of a transparent film, for example, is adhered to an opening portion 185*a* of both the frame body's 185 left and right side surfaces, which follow the front/rear direction Y. Therefore, multiple (four in the embodiment) sealed air chambers 187 are formed in the float member 181 toward the inside of the thin film member 186 by closing the opening portion 185*a* of the frame body 185 using the thin film member 186. Accordingly, buoyancy generated by these air chambers 187 allows the float member 181 to be floatable in the vertical direction Z, in accordance with changes in the remaining amount of the ink inside the ink chamber 137.

On the other hand, convex portions 188 protruding in the front/rear direction Y are respectively formed at lower portions of both front and rear side surfaces, which follow the left/right direction X and in which the opening portion 185*a* is not formed in the frame body 185. A pressing portion 189 having a substantially cylindrical shape protrudes vertically downward from the central position of the lower surface in the frame body 185. A rod-shaped portion 190 arranged coaxially with the pressing portion 189 of the lower surface protrudes so as to extend vertically upward from the central position of the upper surface of the frame body 185.

Further, plate-shaped portions 191 forming a cross shape about the center of the rod-shaped portion 190 in a plan view as viewed from above are formed at the upper surface of the frame body 185, around the rod-shaped portion 190, such that they protrude from the upper surface of the frame body 185 to a length that is substantially half of the protruding length of the rod-shaped portion 190. The cross-sectional size of the cross shape of the plate-shaped portions 191 is larger than the outer diameter dimension of the coil spring 184. Spring seats 191*a* for mounting and supporting the coil spring 184 are formed as rectangular shaped notches in the radially leading edges from the rod-shaped portion 190 in the upper end portions of the plate-shaped portions 191 that form the cross-sectional cross shape.

The valve body 182 is a diaphragm valve that is formed of a flexible elastomer and that has a substantially disk shape, and is arranged above a valve port 192 (refer to FIG. 19), which is formed to open on the bottom surface 152*a* of the second ink chamber 152 at the boundary between the second connection flow channel portion 164*b* and the third connection flow channel 164*c* of the outlet flow channel 138. That is, an annular attachment seat 193 surrounding the valve port 192 is formed on the bottom surface 152*a* of the second ink chamber 152, and a similarly annular-shaped attachment fitting 194 is configured to engage with the attachment seat 193 from above. The valve body 182 is arranged above the valve port 192 and interposed between the attachment seat 193 and the attachment fitting 194.

Assuming that the above-described coil spring 184 is a first biasing member having a first biasing force, a coil spring 195 functioning as a second biasing member having a second biasing force is arranged inside the attachment seat 193 so as to constantly abut the valve body 182 from below. The valve body 182 is always biased upward to separate from the valve port 192 by the coil spring 195 into a valve opening position (the position illustrated in FIGS. 19 and 28) wherein the outlet flow channel 138 is open.

The force relationship between the first biasing force of the coil spring 184 and the second biasing force of the coil spring 195 is set to the following force relationship, under the assumption that the first biasing force of the coil spring 184 is stronger than the second biasing force of the coil spring 195.

Figure 28:
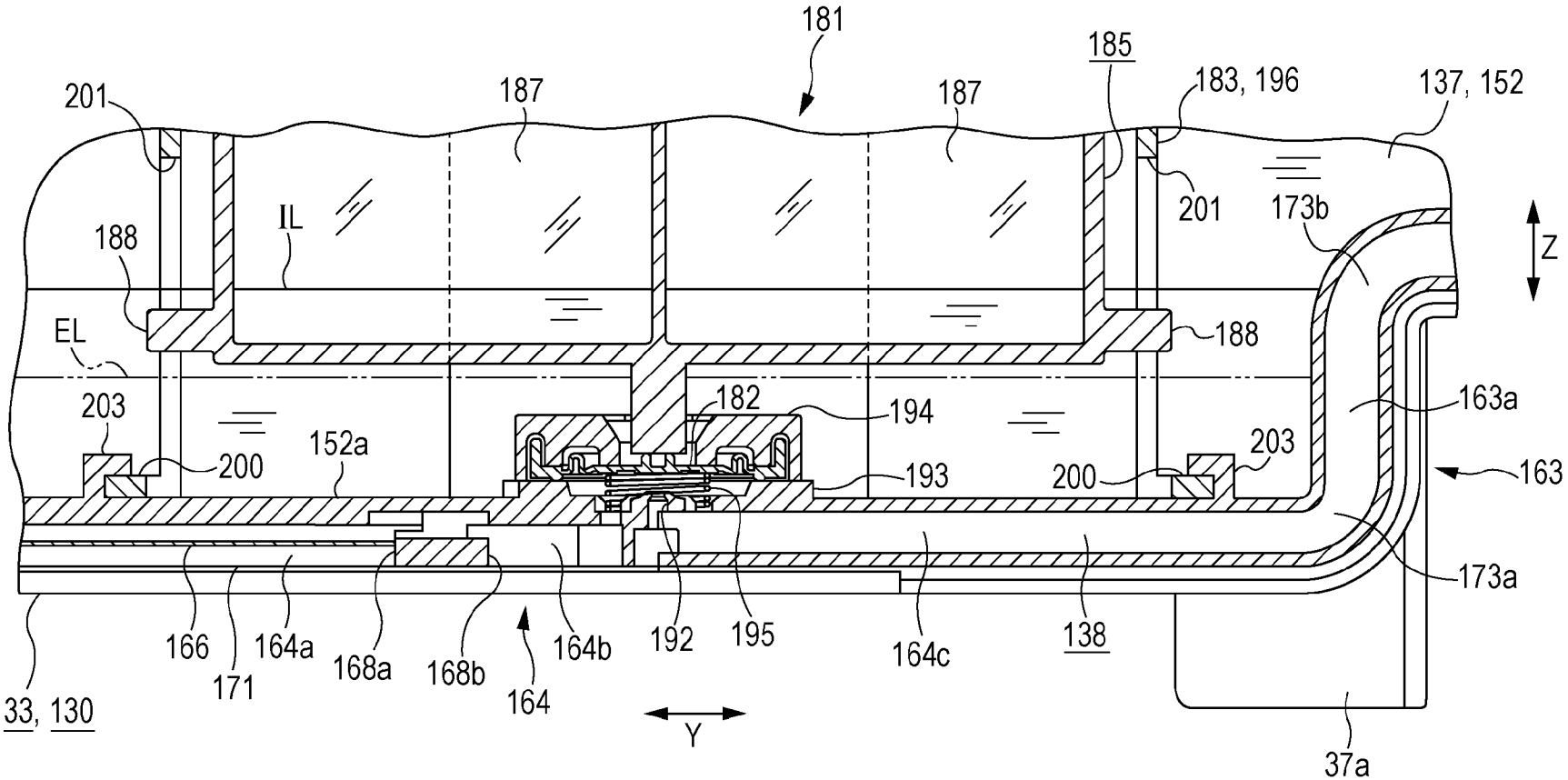
FIG. 28 is a partial cross-sectional view illustrating a state of a float valve when the ink remaining amount approaches a threshold value remaining amount.
Figure 29:
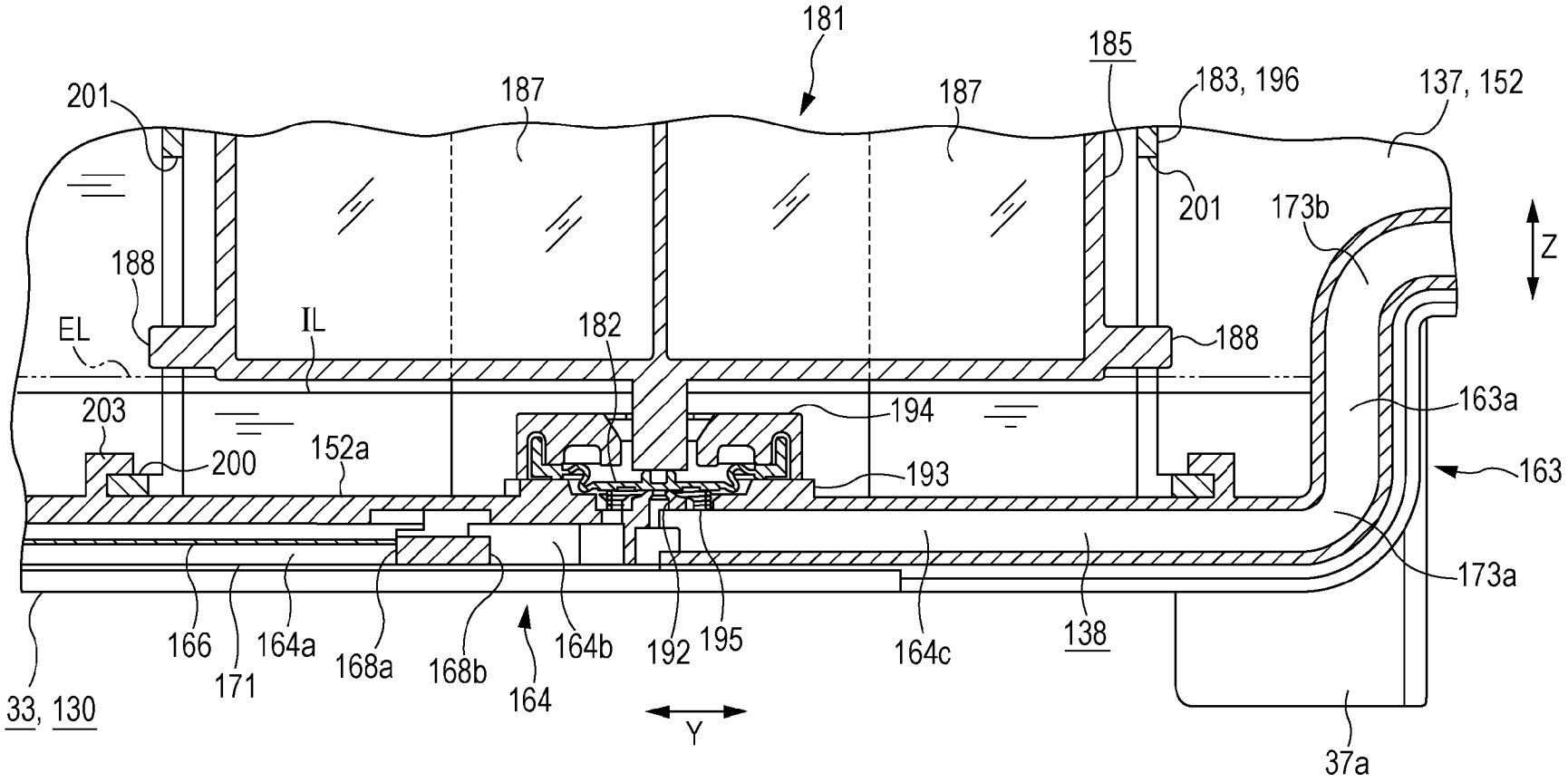
FIG. 29 is a partial cross-sectional view illustrating a state of a float valve when the ink remaining amount becomes less than a threshold value remaining amount.

That is, when the remaining amount of the ink inside the ink chamber 137 is, for example, as illustrated in FIG. 29, less than a threshold value remaining amount, which is a preset negligible remaining amount, the sum of the buoyancy of the float member 181 floating in the remaining ink at that time and the second biasing force of the coil spring 195 is set to be weaker than the first biasing force of the coil spring 184. On the other hand, when the remaining amount of the ink inside the ink chamber 137 is, for example, as illustrated in FIGS. 19 and 28, equal to or more than a threshold value remaining amount, the sum of the buoyancy of the float member 181 floating in the remaining ink at that time and the second biasing force of the coil spring 195 is set to be equal to or stronger than the first biasing force of the coil spring 184.

The regulating case 183 is formed in a box shape that has an annular wall portion 196, an upper wall portion 197, and an open lower end. The annular wall portion 196 has a square-annular shape into which the float member 181 can be inserted to and removed from in the vertical direction Z. The upper wall portion 197 closes the upper opening of the annular wall portion 196. That is, the annular wall portion 196 is formed in an annular shape which can enclose the periphery of the region within which the float member 181 floats in the vertical direction Z, with a gap opened between the annular wall portion 196 and the side surface of the float member 181.

A cylindrical portion 198 whose upper opening is closed is formed at the central position of the upper wall portion 197, so as to communicate with the internal space of the annular wall portion 196 via the lower opening of the cylindrical portion 198. An insertion hole 198*a* is formed through the upper wall portion of the cylindrical portion 198, and enables insertion therein of the rod-shaped portion 190, which protrudes upward from the upper surface of the float member 181. Spring seats (not illustrated) are formed to bulge downward from the upper wall portion of the cylindrical portion 198 at a portion that is cross shaped, centered on the insertion hole 198*a*, as viewed in plan from above. The spring seats oppose, in the vertical direction Z, the spring seats 191*a* which are notches in the float-member-181-side plate-shaped portions 191.

The annular wall portion 196 of the regulating case 183 is an opposing portion that opposes the thin film member 186 of the float member 181 when the left and right side walls 196*a*, which follow the front/rear direction Y, are assembled with the members that configure the float valve 131. Rectangular notched portions 199 are formed in each of the left and right side walls 196*a*, substantially at their centers in the back and forth direction Y. The rectangular notched portions 199 extend in the vertical direction Z in which the float member 181 floats upward from the bottom edge of the respective side walls 196*a*. The notched portions 199 are formed in a shape with a width dimension in the front/rear direction Y that is wider than the outer diameter dimension of the cylindrical portion 198 of the upper wall portion 197, and with a height dimension in the vertical direction Z that is higher than the height dimension of the frame body 185 in the float member 181 in the vertical direction Z.

Strip-shaped flange portions 200 having a predetermined width in the front/rear direction Y are formed to protrude horizontally forward and rearward, respectively, from the lower end portions of the respective front and rear side walls 196*b*, which follow the left/right direction X, of the annular wall portion 196 of the regulating case 183. Long guide slots 201 into which the convex portions 188 of the float member 181 can be inserted are formed following the vertical direction Z, from a position of the flange portions 200 which is its substantial center in the left/right direction X and its substantial center in the front/rear direction Y, to a position slightly below the substantial center of the respective side walls 196*b* in the vertical direction Z. Through holes 202 are formed in the regulating case 183 from two positions in each of the left and right long sides of the upper wall portion 197 to the upper end portions of the respective left and right side walls 196*a* of the annular wall portion 196, and at the four corners of the upper end portion of the annular wall portion 196. The through holes 202 bring the inside and outside of the regulating case 183 into communication with each other to allow the circulation of the ink.

The coil spring 184 is arranged between the float member 181 and the regulating case 183 to be contractible in the vertical direction Z. That is, the coil spring 184 is mounted on the spring seats 191*a*, which are formed on the upper ends of the plate-shaped portions 191 around the rod-shaped portion 190, by inserting the rod-shaped portion 190 of the float member 181 into the coil spring 184 from below. When the float member 181 in this state is inserted into the regulating case 183, that is, the rod-shaped portion 190 is inserted into the insertion hole 198*a* of the cylindrical portion 198 and the frame body 185 is inserted into the annular wall portion 196 from below, then the upper end of the coil spring 184 abuts against the spring seat (not illustrated), which is formed to bulge downward from the upper wall of the cylindrical portion 198 of the regulating case 183.

The float valve 131 is received into the containing body case 130 by pushing the float member 181 into the regulating case 183 so that the coil spring 184 is further compressed and, while maintaining this state, attaching the regulating case 183 to which the float member 181 is inserted to the bottom surface 152*a* of the second ink chamber 152 of the ink chamber 137.

Next, a structure for attaching the float valve 131 to the containing body case 130 will be described.

As illustrated in FIG. 22, locking rail portions 203 are formed on the bottom surface 152*a* of the second ink chamber 152 in the containing body case 130, at two front and rear positions, sandwiching the attachment seat 193 of the valve body 182 with a spaced distance that corresponds to the dimension of the regulating case 183 in the front/rear direction Y. The locking rail portions 203 have an inverted L-shaped in cross section, to which the respective front and rear flange portions 200 of the regulating case 183 can be slidingly inserted in the left/right direction X. Positioning portions 204 are formed at two front/rear positions, which are at the inner part of the containing body case 130, between the attachment seat 193 and the respective locking rail portion 203. The positioning portions 204 can abut the further back portions of both the left and right side walls 196*a*, which follow the front/rear direction Y, when the flange portions 200 are inserted into the locking rail portions 203 and the regulating case 183 is slidingly moved toward the rear side of the containing body case 130.

Projection portions 205 are formed in the bottom surface 152*a* of the second ink chamber 152, at two positions that correspond to forward of the rear side positioning portions 204 in the left/right direction X. The projection portions 205 can, when the regulating case 183 is in a state of abutment with the positioning portions 204, lock the lower end portion of the side wall 196*a* from in front, which is the open side of the containing body case 130. The projection portions 205 are elastically deformable structure bodies extending obliquely upward toward the interior of the containing body case 130. The projection portions 205 are disposed in a slanting posture so that when the flange portions 200 of the regulating case 183 are inserted into the locking rail portions 203 and the regulating case 183 is slidingly moved to the interior, the bottom edges of the respective side walls 196*a* can go over the projection portions 205 while sliding from the front to the interior. After the front-side side wall 196*a* goes over the projection portions 205, the projection portions 205 elastically return to the original oblique posture and lock the front side surface of the side wall 196*a*, so that the regulating case 183 does not slip out from the interior of the containing body case 130 to the front.

Next, operation of the liquid container 21 in the embodiment will be described. It should be noted that the slider 34 and the liquid containing body 33 are omitted from FIGS. 24A, 24B and 24C.

Figure 23:
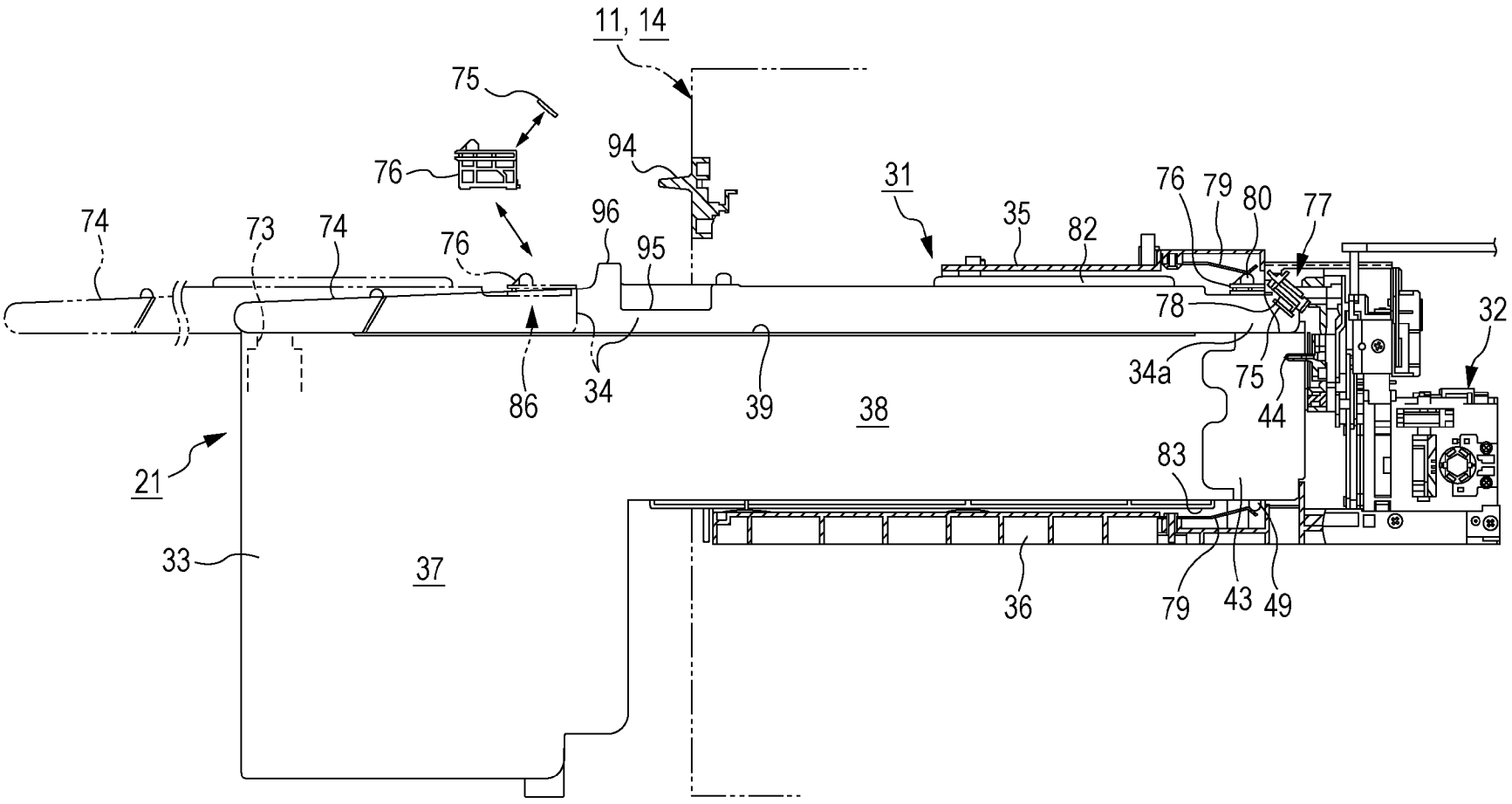
FIG. 23 is a view illustrating an operation of a slider in a liquid container mounted on a holder.

As illustrated in FIG. 23, when the slide knob 94 is displaced upward while the liquid container 21 is immovably fixed to the printer 11 with a portion of the second containing body portion 38 located inside the mounting section 31, then the engagement of the slide knob 94 with the concave portion 95 of the slider 34 is disengaged. If a user slides the slider 34 in the direction opposite to the insertion direction following the longitudinal direction, then the slider 34 can be pulled out from the printer 11 (mounting section 31).

By pulling out the slider 34, the portion of the slider 34 that is located inside the printer 11, that is, the portion that lies over a portion (second section) of the upper surface 39 of the second containing body portion 38, including the connection section 43, of the liquid containing body 33 that is located inside the printer 11, is moved out from the printer 11. In the embodiment, as illustrated by the two-dot chain line in FIG. 23, the slider 34 moves to a position where, outside the printer 11, a user can remove the circuit board holder 76, which is attached to the end portion 34*a* at the rear side in the insertion direction of the slider 34, from the holder attachment portion 86 of the slider 34. Accordingly, a portion of the slider 34 that overlaps the portion (second section) of the upper surface 39 of the second containing body portion 38, which includes the connection section 43, of the liquid containing body 33 that is located inside the printer 11 functions as a moving portion that moves between the inside of the printer 11 and the outside of the printer 11.

As a result, a user detaches and removes the circuit board holder 76, which has moved out from the printer 11, from the slider 34 (holder attachment portion 86). When, for example, a circuit board 75 is already mounted on the circuit board holder 76, the circuit board 75 is replaced with a circuit board that records relevant information (for example, color, colorfulness and brightness of the ink, viscosity of the ink, or type of ink solute) about the ink that was poured into the liquid containing body 33 through the filler port 73. After a user re-inserts and attaches to the slider 34 (holder attachment portion 86) the circuit board holder 76 mounted with the replacement circuit board 75, the user inserts the slider 34 into the printer 11 (mounting section 31) following the upper surface 39 of the liquid containing body 33.

By inserting the slider 34, terminals 75*a* or the contact portions 75*b* of the circuit board 75, which is mounted on the circuit board holder 76 at a slant with respect to the insertion direction, contact and electrically connect with the electrical terminals 78 of the communication section 77 provided in the supply unit 32, and relevant information recorded on the circuit board 75 is transmitted to the printer 11. During this connection, the circuit board 75 is positioned with respect to the electrical terminals 78. While the relevant information recorded in the circuit board 75 is being transmitted to (read by) the printer 11, the circuit board holder 76 is located inside the printer 11 and a portion (first section) of the slider 34 is located outside the printer 11. In other words, in a state in which the relevant information recorded on the circuit board 75 is read by the printer 11, the circuit board 75 and the circuit board holder 76 are located at a position where a user cannot touch them by hand.

Figure 24A:
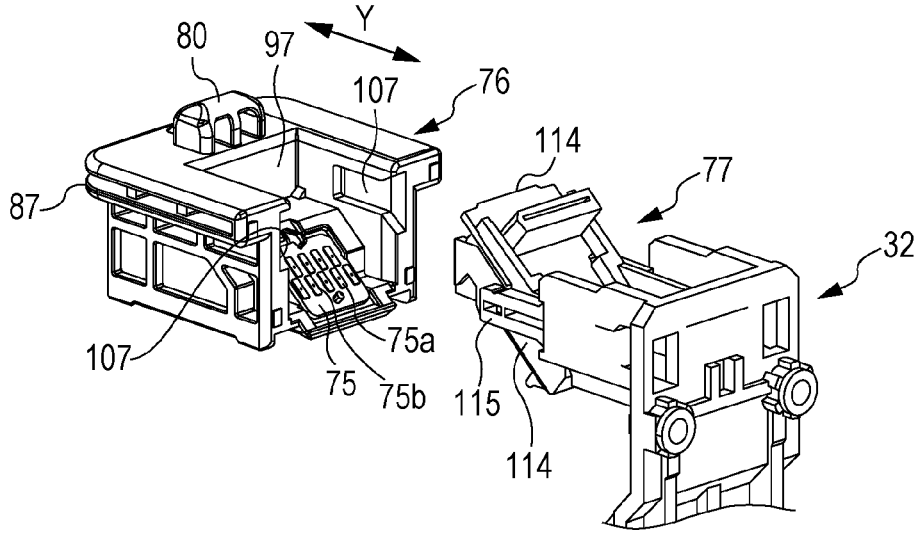
FIG. 24A is a perspective view illustrating a circuit board holder and a communication section before engagement.

That is, as illustrated in FIG. 24A, a terminal portion 114 and protrusion-shaped portions 115 are provided in the communication section 77, which is disposed in the supply unit 32. The terminal portion 114 is provided with the electrical terminals 78 that contact the multiple terminals (including the contact portions 75*b*) 75*a* formed on the circuit board 75. The protrusion-shaped portions 115 are provided on both sides in the short direction, and protrude in the short direction and extend in the insertion direction. The terminal portion 114 engages with the concave portion (engagement portion) 97 of the circuit board holder 76, and the protrusion-shaped portions 115 engage with the groove-shaped portion 107 of the circuit board holder 76. The concave portion 97 is a surface of the wall configuring the circuit board holder 76, and is formed on a circuit board 75 side surface (terminals 75*a* side surface).

Figure 24B:
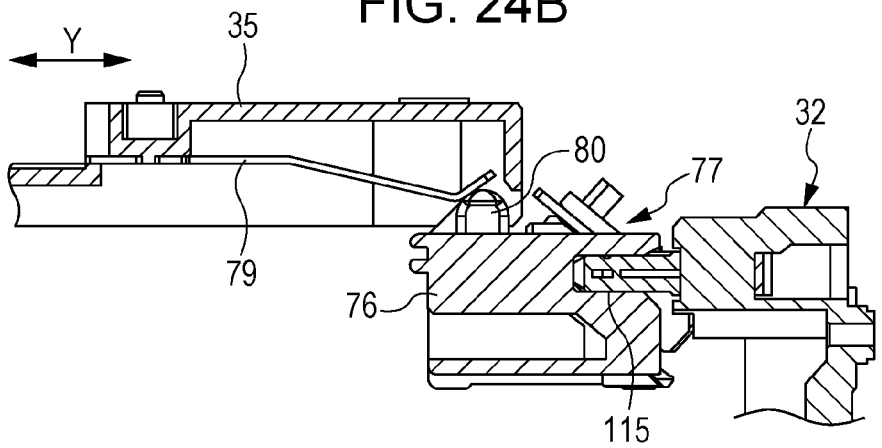
FIG. 24B is a side view illustrating an engagement state of the circuit board holder and the communication section using a partial cross-section.

As illustrated in FIG. 24B, when the slider 34 is inserted to the mounting section 31, the circuit board holder 76 is moved toward the communication section 77 while the projection portion 80 thereof is pressed down by the leaf spring 79 fixed to the upper frame 35 so the circuit board holder 76 does not separate from the slider 34. In this movement, the protrusion-shaped portions 115 of the communication section 77 of the circuit board holder 76 are guided by the chamfer portion 106, and inserted into and engage with the groove-shaped portion 107, and the circuit board holder 76 is positioned with respect to the communication section 77. In this regard, the groove-shaped portions 107 of the circuit board holder 76 function as an example of a positioning shape portion for positioning in the printer 11.

Figure 24C:
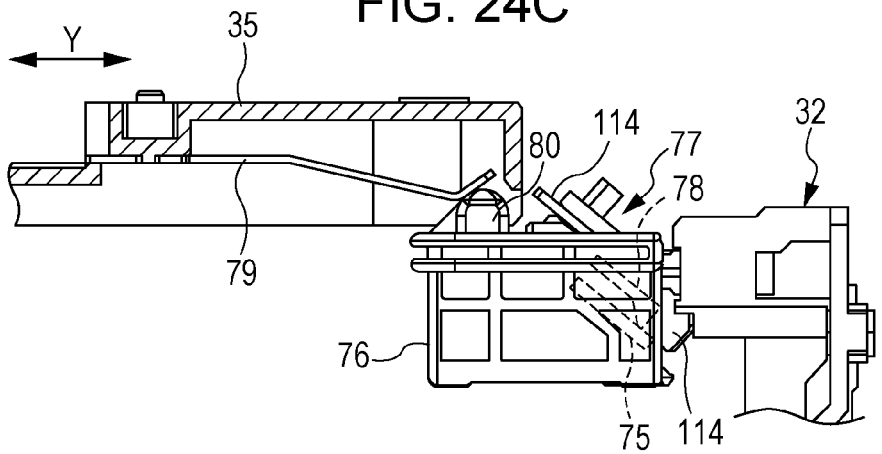
FIG. 24C is a side view illustrating the circuit board holder and the communication section after engagement.

As a result, as illustrated in FIGS. 24A and 24C, the circuit board 75 mounted on the circuit board holder 76 is positioned with respect to the terminal portion 114 of the communication section 77, and the multiple electrical terminals 78 provided in the terminal portion 114 properly come into contact with multiple (here, nine) terminals (including the contact portions 75*b*) 75*a* of the circuit board 75. During the contact, since the terminals (including the contact portions 75*b*) 75*a* of the circuit board 75 slant downward in the insertion direction, the electrical terminals 78 come into contact with the surface of the terminals (including the contact portions 75*b*) 75*a* while rubbing against them.

Next, an operation for pouring ink into the liquid container 21 will be described.

When pouring ink into the liquid containing body 33, the opening/closing cover 74 is displaced to the opened position as illustrated in FIG. 9A, and the covering body 120 is mounted on the rear surface 74*a* of the opening/closing cover 74 to expose the filler port 73 as illustrated in FIG. 9B.

At this time, after a user detaches the covering body 120 from the filler port 73, the user rotates the covering member 121 about the rotation center of the fixing portion 123 by an optional angle (180 degrees in the embodiment) with respect to the liquid receiving surface 116, and places the covering body 120 on the rear surface 74*a* of the opening/closing cover 74. In addition, in the state illustrated in FIG. 9B, the rear surface 74*a* of the opening/closing cover 74 is located at a higher position in the vertical direction Z than the liquid receiving surface 116. Thus, when the covering body 120 is placed on the rear surface 74*a* of the opening/closing cover 74, the connection portion 125 is slightly stretched. The resilient force caused by the elastic deformation (stretching) of the connection portion 125 pulls the covering body 120 frontward from the opening/closing cover 74. In the embodiment, since the covering body 120 abuts against the hook portion 110 of the opening/closing cover 74, the covering body 120 is suppressed from falling off the opening/closing cover 74. In addition, while the opening/closing cover 74 is in the opened position, the side of the rear surface 74*a* on which the hook portion 110 is formed is the lowest. Accordingly, for example, even if the covering body 120 has ink clinging to it when placed on the rear surface 74*a* of the opening/closing cover 74, the ink is less likely to spread over the entire surface of the opening/closing cover 74 (particularly, a surface area at the rear).

Figure 25:
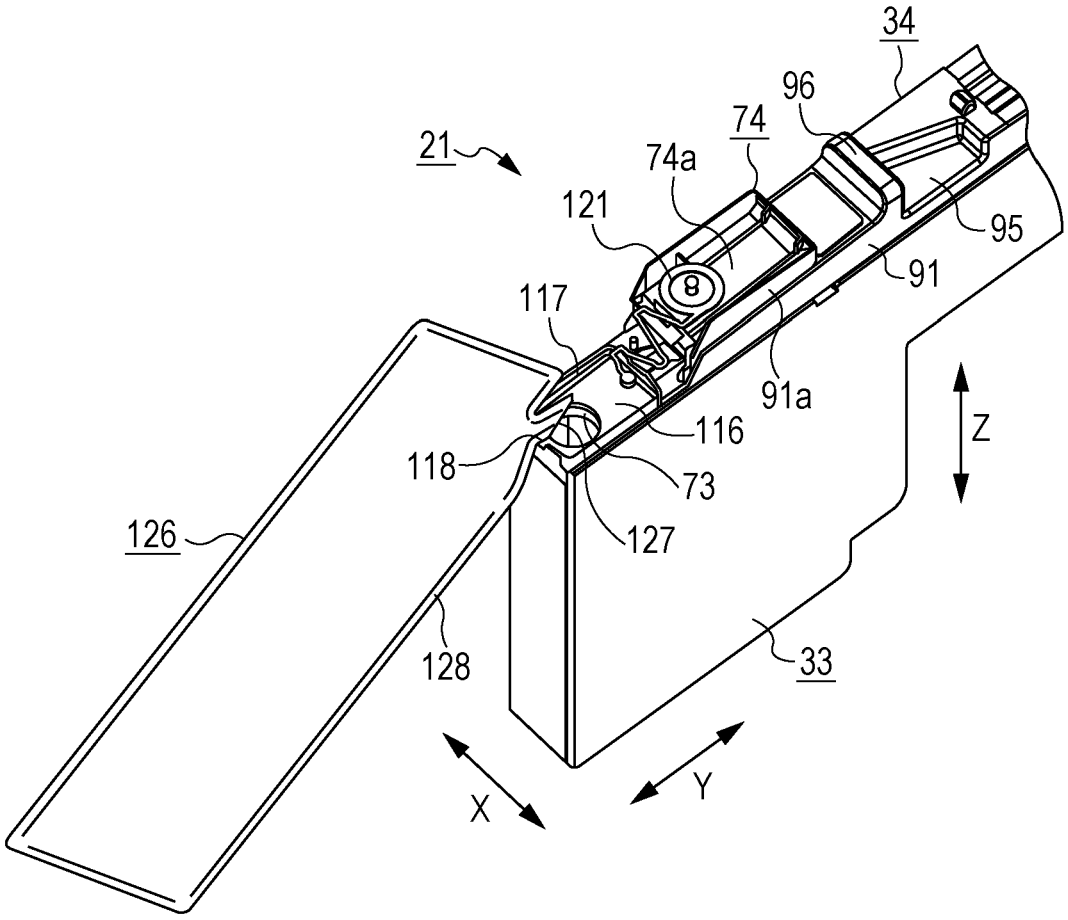
FIG. 25 is a perspective view illustrating a positional relationship between a liquid container and a liquid filler source when injecting an ink.
Figure 26:
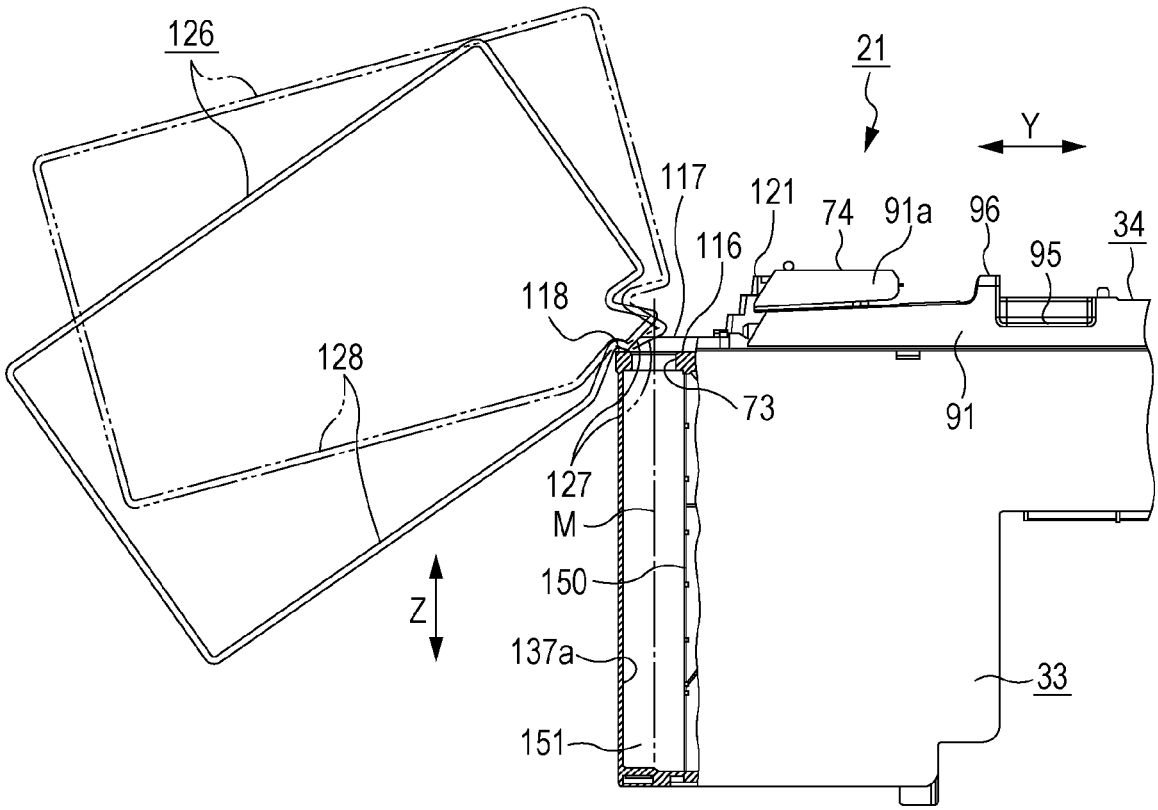
FIG. 26 is a partial cross-sectional side view illustrating a positional relationship between a liquid container and a liquid filler source when injecting an ink.

As illustrated in FIGS. 25 and 26, ink is poured into the liquid containing body 33 from a liquid filler source 126, which is formed by welding edge portions 128 of superimposed films together, and which has a spout 127. When injecting the ink, the liquid filler source 126 is positioned with respect to the liquid containing body 33 by inserting the edge portion 128 in the vicinity of the spout 127 of the liquid filler source 126, into and into abutment with the notched groove 118 formed on the peripheral wall 117 of the liquid containing body 33. Then, as illustrated in FIG. 26, by tilting the liquid filler source 126 about the tilting center at the point where the liquid filler source 126 and the liquid containing body 33 abut each other, such that the spout 127 of the liquid filler source 126 faces downward, the ink inside the liquid filler source 126 is poured into the first ink chamber 151 through the filler port 73 of the liquid containing body 33.

If at this time, the user tilts the liquid filler source 126 with excessive force, the ink flowing out from the spout 127 of the liquid filler source 126 might deviate from the filler port 73 and spill around the filler port 73 onto the liquid receiving surface 116. Even in this case, the peripheral wall portion 117 surrounding the periphery of the liquid receiving surface 116 blocks the ink that spilled onto the liquid receiving surface 116. Accordingly, the ink is less likely to flow outward from the liquid receiving surface 116. Thee liquid receiving surface 116 slants downward toward the filler port 73 in the left/right direction X and in the front/rear direction Y. Therefore, the ink clinging to the liquid receiving surface 116 is guided to the filler port 73 following the slant thereof.

When pouring of the ink is completed, the filler port 73 of the liquid containing body 33 is covered with the covering body 120, which is placed on the rear surface 74*a* of the opening/closing cover 74 as illustrated in FIG. 9A, and the opening/closing cover 74 is displaced to the closing position as illustrated in FIG. 2, whereby the pouring operation is completed.

Figure 27:
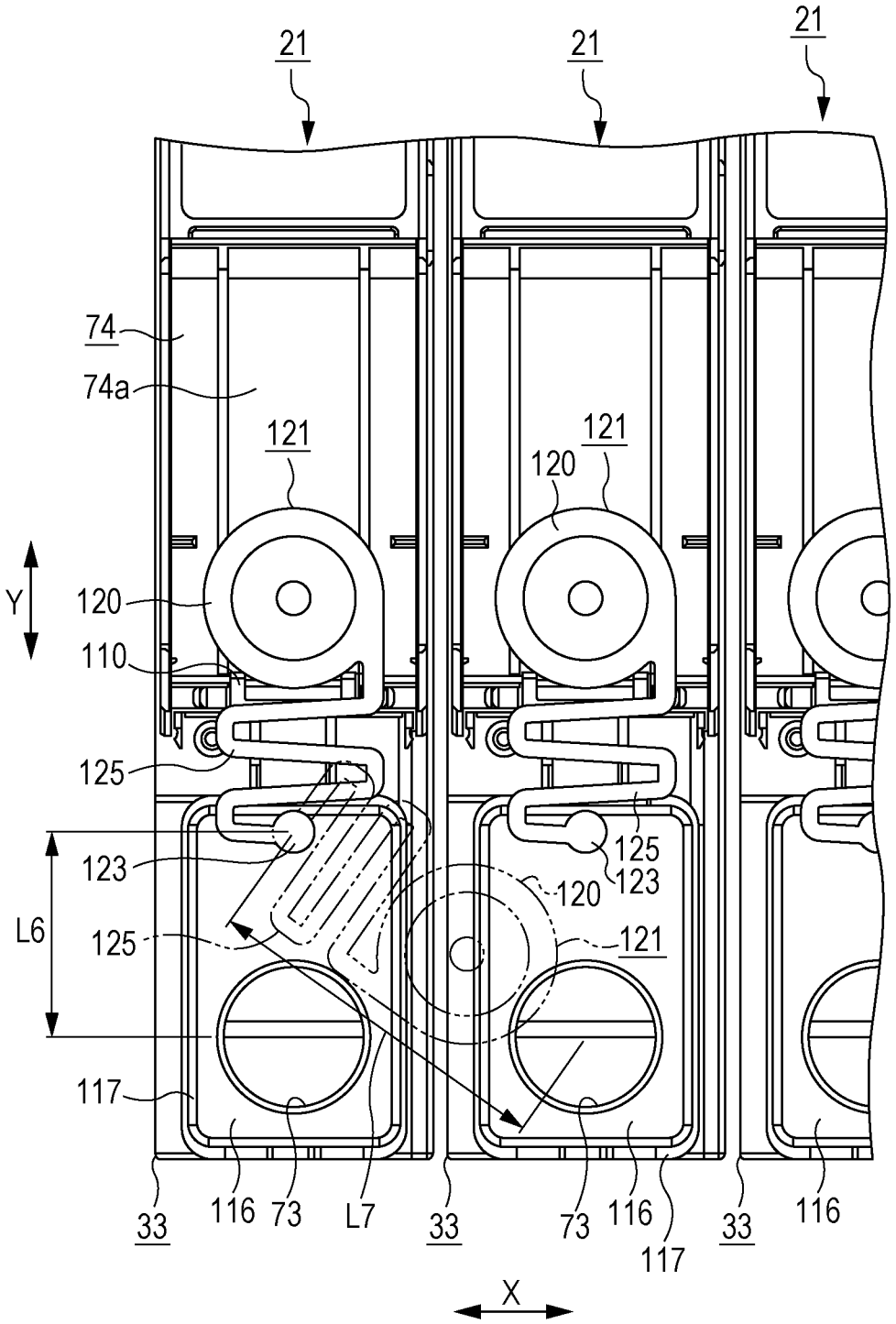
FIG. 27 is a plan view illustrating a rotation range centered on a fixing portion of a covering member included in a liquid container.

When multiple liquid containers 21 are used juxtaposed together as illustrated in FIG. 27, a distance L6 from the fixing portion 123 (fixing hole 124) of the covering member 121 to the filler port 73 in one liquid container 21 (for example, the left end container) is shorter than a distance L7 from the fixing portion 123 in the one liquid container 21 to the filler port in another liquid container 21, which is juxtaposed with the one liquid container 21. In this manner, as illustrated in FIG. 27, even if the covering body 120 of the covering member 121 corresponding to the liquid containing body 33 located at the left end, is turned toward the filler port 73 of the adjacent liquid containing body 33 (as illustrated by the two-dot chain line in FIG. 27) about the fixing portion 123 as the rotation center, the covering body 120 cannot cover the filler port 73. The distances L6 and L7 represent a distance connecting the central position of the fixing portion 123 (fixing hole 124) and the filler port 73 in a plan view as illustrated in FIG. 27.

Next, an operation inside the liquid containing body 33 at the time of pouring the ink through the filler port 73 will be described.

As illustrated in FIG. 14, when ink is poured through the filler port 73, the liquid surface in the first ink chamber 151 rises and the ink flows into the second ink chamber 152 through the wall communication opening 155. Because the concave portion 154 formed in the first ink chamber 151 is formed at a position shifted from the filler port 73 in the front/rear direction Y, even if foreign matter is deposited in the concave portion 154, the foreign matter is less likely to be stirred up.

The first ink chamber 151 and the second ink chamber 152 communicate with each other via the wall ventilation opening 156. Therefore, the pressure inside the first ink chamber 151 is approximately equal to the pressure inside the second ink chamber 152. Accordingly, the liquid surface in the ink in the first ink chamber 151 and the second ink chamber 152 rise to be approximately equal to each other in height in the vertical direction Z.

The rib communication openings 161 are formed in both ends of both the third laterally inclined rib portion 158*c* and the fourth laterally inclined rib portion 158*d*. Accordingly, the ink passes through the rib communication openings 161 and the liquid surface of the ink is located at approximately equal positions at both the third laterally inclined rib portion 158*c* and the fourth laterally inclined rib portion 158*d*. Further, the ink passes through the gap formed between the first laterally inclined rib portion 158*a*, the second laterally inclined rib portion 158*b* and the film 133, and the liquid surface of the ink moves to a position that is higher than the first laterally inclined rib portion 158*a* and the second laterally inclined rib portion 158*b*. If the liquid surface of the ink rises further, the ink spreads over the inclined bottom surface 152*a*, and passes through the rib communication openings 161 of the fourth to ninth intersecting rib portions 157*d* to 157*i*, whereby the liquid surface rises.

Furthermore, the rib ventilation openings 160 are respectively formed in the intersecting rib portions 157*a* to 157*i*. Therefore, the pressure in the spaces at both sides of the intersecting rib portions 157*a* to 157*i* in the second ink chamber 152 are approximately equal to each other. Accordingly, the liquid surface of the ink in the second ink chamber 152 rises to be approximately uniform in height in the vertical direction Z.

Incidentally, the liquid containing body 33 having the filler port 73 can accumulate therein foreign matter, such as dirt and dust mixed in through the filler port 73, and ink that dried at the gas-liquid interface and itself became foreign matter. This foreign matter accumulates on the opposing surface 153 and the concave portion 154 of the first ink chamber 151. Since the wall communication opening 155 is formed remote apart from the concave portion 154, the foreign matter is less likely to enter the wall communication opening 155, compared to the inflow of the ink into the second ink chamber 152. That is, of the foreign matter that enters from the filler port 73, particularly large sized foreign matter and heavy weight foreign matter tends to stay in the first ink chamber 151.

With the passage of time, foreign matter accumulates on the laterally inclined rib portions 158*a* to 158*d* in the front side region of the second ink chamber 152, and on the bottom surface 152*a* in the rear side region of the second ink chamber 152. Because the laterally inclined rib portions 158*a* to 158*d* and the bottom surface 152*a* on which the foreign matter accumulated are inclined so as to intersect with the front/rear direction Y, the deposited foreign matter moves unidirectionally (downward direction), following the movement of the liquid surface when the ink flows from the outlet port 69 and the liquid surface of the ink falls.

Furthermore, when ink is poured through the filler port 73, sometimes air bubbles may enter with the poured ink. When air bubbles enter the second ink chamber 152 or dissolved gas becomes air bubbles in the second ink chamber 152, the air bubbles move upward to reach the laterally inclined rib portions 158*a* to 158*d*. In this regard, in the embodiment, because the laterally inclined rib portions 158*a* to 158*d* intersect with the front/rear direction Y, the air bubbles move along the slanting laterally inclined rib portions 158*a* to 158*d* and are guided to the liquid surface.

Ink from the second ink chamber 152 flows through the flow channel opening 162 into the outlet flow channel 138 and out from the outlet port 69. That is, foreign matter or air bubbles are first captured by the filter 166 from the ink that exits from the flow channel opening 162. Thereafter, the ink flows to the bent flow channel portion 163 via the second connection flow channel portion 164*b* and the third connection flow channel portion 164*c*.

In the bent flow channel portion 163, since the flowing direction of the ink changes, the gas dissolved in the ink is likely to develop into air bubbles. In this regard, according to this configuration, because the cross-sectional area of the bent flow channel portion 163 is larger than the cross-sectional area of the third connection flow channel portion 164*c*, the generated air bubbles move toward the inclined flow channel portion 165 side following the ink flow. Furthermore, the inclined flow channel portion 165 has a larger cross-sectional area than the third connection flow channel portion 164*c*, and is inclined upward toward the outlet port 69. Therefore, air bubbles generated in the bent flow channel portion 163 move toward the outlet port 69 through the inclined flow channel portion 165, and out of the outlet port 69 together with the ink.

Next, an operation of the float valve 131 will be described.

FIG. 19 shows inside the ink chamber 137 when a liquid level line IL of the ink is considerably higher than a threshold value remaining amount line EL, that is, a state in which the remaining amount of the ink inside the ink chamber 137 is sufficient as needed to continue printing by ejecting the ink from the liquid ejecting head 24 onto the sheet S. Therefore, in the state illustrated in FIG. 19, because the sum of the second biasing force of the coil spring 195 and the buoyancy of the float member 181 is equal to or stronger than the first biasing force of the coil spring 184, the float member 181 will not be pressed downward by the first biasing force of the coil spring 184 and the valve body 182 will not be brought into abutment with the valve port 192.

That is, in this case, as illustrated in FIG. 19, the sum of buoyancy generated by the respective air chambers 187 of the float member 181 prevails against the first biasing force of the coil spring 184, and thus the float member 181 is in a floating state at a position separated upward from the valve body 182. On the other hand, the valve body 182 is not pressed downward from the coil spring 184 via the float member 181, so the valve body 182 receives only the second biasing force applied upward from the coil spring 195, and is separated upward from the valve port 192 into the opened position to open the outlet flow channel 138.

Then, by continuing printing from the state illustrated in FIG. 19, the remaining amount of ink inside the ink chamber 137 gradually decreases. When the liquid level line IL of the ink approaches the threshold value remaining amount line EL as illustrated in FIG. 28, the sum of the buoyancy of the float member 181 and the second biasing force of the coil spring 195 is balanced with the first biasing force of the coil spring 184. Therefore, the float member 181 is pressed downward by the first biasing force of the coil spring 184, so that the pressing portion 189 at the lower surface of the float member 181 abuts the valve body 182, which is located in the opened position, from above. At this time, the float member 181 abuts the valve body 182 from above, but does not cause the valve body 182 to be displaced into the lower opened position.

Then, by further continuing to print from the state illustrated in FIG. 28, the remaining amount of the ink inside the ink chamber 137 further decreases. When the liquid level line IL of the ink is below the threshold value remaining amount line EL as illustrated in FIG. 29, the sum of the buoyancy of the float member 181 and the second biasing force of the coil spring 195 is weaker than the first biasing force of the coil spring 184. Therefore, the float member 181 is further pressed downward by the first biasing force of the coil spring 184, and presses the valve body 182 located at the opened position downward using the pressing portion 189 at the lower surface of the float member 181. As a result, the valve body 182 is displaced to the closing position to close the valve port 192.

Since the valve port 192 is closed, the outlet flow channel 138 is closed, and the ink no longer flows downstream from the valve port 192. Therefore, the ink does not flow into the liquid chamber 53 arranged downstream from the outlet flow channel 138. Consequently, since a state is maintained where the remaining amount detection rod 45 moves to block the light between the light emitting portion and the light receiving portion of the sensor 68, the sensor 68 detects that the remaining amount of the ink is less than the threshold value remaining amount. When the detection result is received and ink is newly poured into the ink chamber 137 through the filler port 73, the liquid level line IL inside the ink chamber 137 is located again above the threshold value remaining amount line EL. Accordingly, the buoyancy of the float member 181 prevails against the first biasing force of the coil spring 184, and thereby the float member 181 is caused to float so as to separate upward from the valve body 182.

When the valve body 182 is pressed downward by means of the pressing portion 189 of the float member 181, which is biased downward due to the first biasing force of the coil spring 184, and so the valve body 182 is located in the closing position to close the valve port 192 for a prolonged time, the valve body 182 will sometimes cling to the valve port 192 even after the float member 181 is no longer pressed from above. In this regard, in a case of the embodiment, the second biasing force of the coil spring 195 urges the valve body 182, which is located in the closed position, upward toward the opened position. Accordingly, even if the valve body 182 is temporarily stuck to the valve port 192, the valve body 182 can be pulled away from the valve port 192 and such a stuck state can be taken care of.

In addition, if the ink is forcefully poured into the ink chamber 137 through the filler port 73, there is a possibility that during the pouring operation the inflow pressure of the ink to the ink chamber 137 may also increase. Therefore, the thin film member 186, which forms the air chamber 187 by closing off the opening portion 185*a* of the frame body 185 in the float valve 131, may directly receive this high inflow pressure and be damaged. In this regard, in the case of the embodiment, the float valve 131 is arranged inside the second ink chamber 152, which is partitioned by the partition wall 150 from the first ink chamber 151, which has the filler port 73. Therefore, the ink poured through the filler port 73 can be precluded from falling directly on the float valve 131 from above.

In addition, even in a case where the ink forcefully flows from the first ink chamber 151 through the wall communication opening 155 formed on the partition wall 150 toward the second ink chamber 152, the thin film member 186 of the float member 181 in the float valve 131 might suffer damage due to the inflow pressure. In this regard, in the embodiment, the float member 181 is arranged inside the second ink chamber 152 so as not to face the front/rear direction Y, which is the direction that ink flows into the second ink chamber 152 through the wall communication opening 155, that is, the film surface of the thin film member 186 is aligned with the front/rear direction Y. Therefore, the inflow pressure of the ink flowing from the wall communication opening 155 into the second ink chamber 152 follows the front/rear direction Y along the film surface of the thin film member 186 of the float member 181.

Incidentally, the thin film member 186 in the float member 181 may be partially damaged by aging, and some of the multiple (four in the embodiment) air chambers 187 may lose their sealed structure. In this case, the valve function of the float valve 131 might be hindered because the buoyancy of the entire float member 181 decreases. However, in the embodiment, even if only a single air chamber 187 remains, the sum of the buoyancy generated by the only one air chamber 187 and the second biasing force of the coil spring 195 is set to be equal to or greater than the first biasing force of the coil spring 184 at the time that the remaining amount of the ink is equal to or greater than the threshold value remaining amount. Therefore, even if only one air chamber 187 remains, the float valve 131 perform its valve function without any problem.

In addition, when the float member 181 floats in the vertical direction Z in accordance with a change in the remaining amount of the ink inside the ink chamber 137, the float member 181 is positioned in the front/rear direction Y and in the left/right direction X by the rod-shaped portion 190 being inserted into the insertion hole 198*a* of the cylindrical portion 198. Because the convex portions 188 protruding from both of the front and rear side surfaces of the frame body 185 are inserted into the long guide slots 201 of the regulating case 183, the rotation of the float member 181 about the center of the rod-shaped portion 190 is regulated. Furthermore, the float member 181 mounted with the coil spring 184 is regulated by the upper wall of the cylindrical portion 198 in the regulating case 183 from floating to a position higher than the opened position of the valve body 182.

Furthermore, when the float member 181 floats inside the ink chamber 137 in the front/rear direction Y and in the left/right direction X, for example, the cross-shaped plate-shaped portions 191 and the inner side surface of the cylindrical portion 198 are in contact with each other in the horizontal direction, which regulates surface contact of the thin film member 186 with the side wall 196*a* which the regulating case 183 opposes. That is, the float member 181 is designed so that with the rod-shaped portion 190 inserted into the insertion hole 198*a* of the cylindrical portion 198, the gap distance between the inner side surface of the cylindrical portion 198 and the radially leading edges of the plate-shaped portions 191 is shorter than the gap distance between the thin film members 186 and the inner surface of the respective left and right side walls 196*a* of the regulating case 183. Therefore, in the float member 181, surface contact of the thin film member 186 with both of the side walls 196*a* opposing the thin film member 186 in the regulating case 183 is regulated. In this regard, the plate-shaped portions 191 function as an example of a regulating contact portion regulating the surface contact of the opposing surfaces opposing each other in the horizontal direction between the regulating case 183 and the float member 181.

Damage to the side walls 196*a* of the regulating case 183 and the thin film member 186 of the float member 181 which oppose each other in the left/right direction X, caused by sliding of the thin film member 186 against the inner surface of the side walls 196*a* of the regulating case 183, can be suppressed because the rectangular notched portions 199 are formed in the side wall 196*a* of the regulating case 183.

In particular, when the float member 181 floats upward inside the regulating case 183, the ink inside the regulating case 183 may be pressed by the float member 181 from below, thereby increasing the ink pressure. With regards to such a problem of increased ink pressure, since the ink can flow out from the through holes 202 and the notched portions 199, these being formed at the multiple places of the regulating case 183, the ink pressure is less likely to increase to an unnecessary level.

According to the above-described embodiment, the following advantageous effects can be obtained.

(1) In the liquid container 21, the filler port 73 is formed in the first section (first containing body portion 37), which is the portion of the liquid containing body 33 located outside the printer 11. Accordingly, it is possible to pour in ink while the liquid container body 33 is fixed to the printer 11. Therefore, it is possible to suppress damage during the filling operation of the ink or spilling of the liquid remaining therein. In addition, because the second section (second containing body portion 38) is located inside the printer 11 in the liquid containing body 33, it is more likely that the liquid containing body 33 is held in the printer 11 without falling out, when released from its fixed state.

(2) With the liquid container 21, the circuit board 75, which has recorded therein relevant information about the ink filled into the immovably-fixed liquid containing body 33, can be moved from outside of the printer 11 to inside of the printer 11 by using the slider 34, which slides with respect to the liquid containing body 33. Therefore, when the circuit board 75 is moved into the printer 11, by, for example, designing the circuit board 75 to come into contact with the electrical terminals 78 disposed inside the printer 11, the relevant information about the ink filled into the liquid containing body 33 can be correctly transmitted to the printer 11. In addition, after the circuit board 75 is mounted, while outside the printer 11, onto the circuit board holder 76, which is provided in the moving portion of the slider 34, the mounted circuit board 75 can be easily inserted into the printer 11 by sliding the slider 34.

(3) Because the filler port 73 is covered with the slider 34, it is possible to reduce the possibility of foreign matter from entering the filler port 73 without providing a cover specially for the filler port 73.

(4) While the slider 34 covers the filler port 73, it is possible to cover and uncover the filler port 73 by displacing the opening/closing cover 74 even without sliding the slider 34.

(5) When the opening/closing cover 74 is displaced from the closed position to the opened position, the opening/closing cover 74 is located at the printer 11 side with respect to the filler port 73. Therefore, the opening/closing cover 74 can be kept out of the way when the ink is poured into the filler port 73.

(6) Since the opening/closing cover 74 can be stably maintained in the closing position, it is possible to reduce the possibility of exposing the filler port 73 due to inadvertent opening of the opening/closing cover 74.

(7) The circuit board holder 76 is positioned in a direction that intersects the movement direction of the moving portion inside the printer 11. Accordingly, the circuit board 75 mounted on the circuit board holder 76 is also accurately positioned inside the printer 11. Therefore, for example, the electrical terminals 78 provided in the printer 11 come into contact with the circuit board 75 while positional shift between them is suppressed. Accordingly, the relevant information recorded in the circuit board 75 is transmitted to the printer 11 with a high probability.

(8) Because the circuit board holder 76 is suppressed from moving in the sliding direction of the slider 34, the circuit board holder 76 is accurately positioned within the printer 11 in the sliding direction of the slider 34. In addition, the circuit board 75 mounted on the circuit board holder 76 is at a slant with respect to the sliding direction of the slider 34. Accordingly, for example, the electrical terminals 78 provided in the printer 11 scrape over the circuit board 75 (terminals (including the contact portions 75*b*) 75*a*) while the circuit board 75 moves into electrical connection with the electrical terminals 78. Therefore, the reliability of the electrical conduction is enhanced.

(9) When a user pours ink into the first ink chamber 151 (ink chamber 137) of the liquid containing body 33 through the filler port 73, even if the ink is spilled around the filler port 73, the ink can be received by the liquid receiving surface 116. Because the liquid receiving surface 116 slants downward (direction of gravity) toward the filler port 73, the ink received by the liquid receiving surface 116 is guided along on the inclined liquid receiving surface 116 to the filler port 73. Therefore, even if ink is spilled around the filler port 73 when ink is poured into the filler port 73 of the liquid container 21, it is possible to reduce the possibility of the ink around the injection port 73 travelling over the outer surface of the liquid container 21 and dirtying the surrounding area

(10) When the ink is poured into the first ink chamber 151 of the liquid containing body 33, the peripheral wall portion 117 surrounding the periphery of the liquid receiving surface 116 can suppress the ink from overflowing to the outside of the liquid receiving surface 116.

(11) When pouring ink from the liquid filler source 126 into the first ink chamber 151 through the filler port 73, a user can bring the liquid filler source 126 into contact with the notched groove 118 of the peripheral wall portion 117 to position the liquid filler source 126. Accordingly, the user can stably pour the ink when pouring the ink from the liquid filler source 126 into the first ink chamber 151.

(12) The covering body 120 covering the filler port 73 is fixed to the liquid containing body 33 by the connection portion 125 and the fixing portion 123. Therefore, it is possible to decrease a possibility of losing the covering body 120 when detaching the covering body 120 from the filler port 73. In addition, since the filler port 73 is covered with the covering body 120, it is possible to suppress evaporation of ink from the first ink chamber 151 or foreign matter from mixing into the first ink chamber 151.

(13) When pouring the ink, the covering body 120 can be mounted on the rear surface 74*a* of the opening/closing cover 74, which is in the opened position. Accordingly, when a user pours the ink into the first ink chamber 151, for example, the user need not perform the ink fill up operation with one hand occupied with holding the covering body 120.

(14) When placing the covering body 120 on the opening/closing cover 74 while the cover 74 is in the opened position, even if the ink is adhered to the covering body 120, by using the blocking portion it is possible to suppress leaking of ink to beyond the opening/closing cover 74.

(15) The covering body 120 can be placed so as to fit within the surface area of the rear surface 74*a* of the opening/closing cover 74 while the cover 74 is in the opened position. Furthermore, even if ink clings to the placed covering body 120, since the rear surface 74*a* of the opening/closing cover 74 slants downward (in the direction of gravity) to the filler port 73, it is possible to suppress the ink from spreading over the entire area of the rear surface 74*a*.

(16) Since the connection portion 125 of the covering member 121 is bent, it is possible to place the covering member 125 on the liquid receiving surface 116 with good storability. In addition, when ink clings to the covering body 120 while the covering body 120 is detached from the injection port 73, it is more difficult for ink to travel over the connection portion 125 than if the connection portion 125 were linearly formed.

(17) The fixing portion 123 is fixed at a higher location of the liquid receiving surface 116 than the filler port 73. Therefore, when pouring the ink into the liquid containing body 33, it is possible to make it more difficult for ink that flows over the liquid receiving surface 116 to cling to the fixing portion 123 of the covering member 121. Accordingly, for example, it is possible to reduce the possibility that the ink affects the fixed state of the fixing portion 123 by clinging and solidifying to the fixing portion 123.

(18) When a user attempts to pour multiple types of ink into the multiple liquid containers 21 (ink chamber 137), it is possible to reduce the possibility that the covering body 120 that corresponds to one liquid container 21 covers the filler port 73 of another liquid container 21 that is juxtaposed next to the one liquid container 21. Accordingly, it is possible to reduce the possibility of ink mixing into the ink chamber 137 of the other liquid container 21 by way of the covering body 120, by covering the filler port 73 of the other liquid container 21 with the covering body 120 corresponding to the one liquid container 21.

(19) The wall communication opening 155 is located at a position separated from the opposing surface 153, which is a position twisted away from the filler port 73. Therefore, whereas the ink poured through the filler port 73 flows into the second ink chamber 152 through the wall communication opening 155, foreign matter mixed in from the filler port 73 or foreign matter generated inside the first ink chamber 151 is less likely to pass through the wall communication opening 155 than is the ink. That is, because this configuration allows foreign matter to remain in the first ink chamber 151, this ink that is less likely to be mixed with foreign matter flows in the second ink chamber 152. Therefore, even if foreign matter mixes in from the filler port 73, or even if foreign matter is generated inside, excellent flow of the ink is possible, while decreasing the possibility that the mixed-in foreign matter may flow from the outlet port 69.

(20) Since the opposing surface 153 has the concave portion 154 recessed in the direction of gravity, even when foreign matter in the first ink chamber 151 precipitates out over time, the foreign matter can accumulate inside the concave portion 154. That is, when ink is poured through the filler port 73 after foreign matter has accumulated in the concave portion 154, it is possible to reduce the possibility that the deposited foreign matter is stirred up from inside the concave portion 154 to outside of the concave portion 154.

(21) The mixed-in or generated foreign matter can accumulate in the concave portion 154. Because the concave portion 154 is shifted from the filler port 73 in a direction that intersects the direction of gravity, it is possible to further reduce the possibility the foreign matter accumulated in the concave portion 154 from being stirred up when the ink is poured through the filler port 73.

(22) By making the distance L1 between the flow channel opening 162 and the partition wall 150 shorter than the distance L2 between the upper end of the concave portion 154 and the lower end of the wall communication opening 155, the flow channel opening 162 can be formed at the position close to the partition wall 150. Therefore, it is possible to decrease a possibility that foreign matter that has passed with ink from the first ink chamber 151, through the wall communication opening 155, into the second ink chamber 152 precipitates inside the flow channel opening 162 and enters the outlet flow channel 138.

(23) Even if foreign matter enters the second ink chamber 152, or even if foreign matter is generated inside the second ink chamber 152, the foreign matter that precipitates inside the second ink chamber 152 can accumulate on the laterally inclined rib portions 158*a* to 158*d*. Therefore, it is possible to further reduce the possibility of foreign matter mixing in the ink that flows to the outlet flow channel 138 from the flow channel opening 162, which is located lower in the direction of gravity than the laterally inclined rib portions 158*a* to 158*d*.

(24) The laterally inclined rib portions 158*a* to 158*d* extend in a direction that intersects the vertical direction Z and the front/rear direction Y. Accordingly, foreign matter accumulated on the laterally inclined rib portions 158*a* to 158*d* due to decrease in the ink contained in the second ink chamber 152 can collect in one direction.

(25) The float valve 131, which uses floating of the float member 181 in accordance with change in the remaining amount of the ink to displace the valve body 182, might for example malfunction by the weight of foreign matter accumulating in the float member 181. In this regard, foreign matter can accumulate on the laterally inclined rib portions 158*a* to 158*d* located in the opposite direction of gravity from the float valve 131. Accordingly, it is possible to reduce the possibility of foreign matter precipitated in the second ink chamber 152 from accumulating on the float member 181.

(26) Even if the foreign matter deposited on the third laterally inclined rib portion 158*c* and the fourth laterally inclined rib portion 158*d* moves due to the change in the remaining amount of ink contained in the second ink chamber 152, and drops from the third laterally inclined rib portion 158*c* and the fourth laterally inclined rib portion 158*d*, the foreign matter can fall so as to avoid the float valve 131.

(27) The ink flowing out from the flow channel opening 162 flows to the float valve 131 side after passing through the filter 166. That is, for example, relatively large size foreign matter of the foreign matter mixed in the ink inside the first ink chamber 151 from the filler port 73, stays in the first ink chamber 151 and accumulates on the laterally inclined rib portions 158*a* to 158*d* in the second ink chamber 152. Therefore, foreign matter mixed in the ink flowing out from the flow channel opening 162 to the outlet flow channel 138 is relatively small in size. Accordingly, even if the foreign matter enters from the flow channel opening 162, the outlet flow channel 138 is less likely to clog compared to if large size foreign matter entered. Further, since the ink passes through the filter 166 disposed in the outlet flow channel 138, it is possible to further decrease the foreign matter mixed in the ink flowing out from the outlet port 69.

(28) The area of the wall communication opening 155 is smaller than the area of the filler port 73. Accordingly, if the large size foreign matter mixes in through the filler port 73, it is possible to decrease a possibility that the foreign matter enters the second ink chamber 152 by crossing through the wall communication opening 155.

(29) Air bubbles in the ink are likely to stay in the bent portions of the outlet flow channel 138. In this regard, air bubbles located at the bent flow channel portion 163 are guided toward the outlet port 69 through the inclined flow channel portion 165. Therefore, for example, it is possible to decrease a possibility that the air bubbles in the bent flow channel portion 163 may increase in size to block up the outlet flow channel 138. Accordingly, it is possible for ink to flow while decreasing the influence of the air bubbles.

(30) It is possible to capture the already generated air bubbles in advance by passing the ink through the filter 166 before the ink flows to the bent flow channel portion 163 where the air bubbles are likely to stay.

(31) Because air bubbles generated in the ink chamber 137 move upward in the direction of gravity, by opening the flow channel opening 162 in the bottom surface 152*a*, it is possible to decrease a possibility that the air bubbles enter into the outlet flow channel 138 from the flow channel opening 162.

(32) It is possible to reinforce the ink chamber 137 by forming the laterally inclined rib portions 158*a* to 158*d*. Furthermore, the laterally inclined rib portions 158*a* to 158*d* extend in a direction that intersects the horizontal direction.

Accordingly, when air bubbles are generated in the ink contained in the ink chamber 137, the air bubbles can move along the laterally inclined rib portions 158*a* to 158*d*. That is, it is possible to decrease a possibility that the air bubbles may be trapped by the laterally inclined rib portions 158*a* to 158*d*.

(33) The bottom surface 152*a* of the ink chamber 137 can be inclined following the incline of the flow channel portion 165. That is, because the inclined flow channel portion 165 is formed with the flow channel opening 162 side lower, the ink inside the ink chamber 137 can collect at the flow channel opening 162 side.

(34) Since the cross-sectional area of the inclined flow channel portion 165 is large, it is possible to decrease a possibility that the inclined flow channel portion 165 becomes stopped up by air bubbles generated in the bent flow channel portion 163.

(35) Even if air bubbles are generated in the wall communication opening 155, since the upper surface 155*c* is inclined in the direction opposite the direction of gravity, it is possible to decrease the possibility that air bubbles stay in the wall communication opening 155.

(36) It is possible to decrease the difference in pressures between the first ink chamber 151 and the second ink chamber 152 using the wall ventilation opening 156 formed in the partition wall 150. Furthermore, the wall ventilation opening 156 formed in the partition wall 150 is formed nearer the ceiling surface 137*b* than the rib ventilation openings 160 formed in the intersecting rib portions 157*a* to 157*i*. Accordingly, it is possible to decrease a possibility that ink inside the second ink chamber 152 enters the first ink chamber 151 through the wall ventilation opening 156.

(37) Since the positioning rib 141 is formed, it is possible to reduce the possibility that the air passage forming film 147 will shift, and to easily adhere the air passage forming film 147 to the meandering grooves 142 and 143.

(38) It is possible to easily replace the filter 166 by attaching the filter 166 to the first flow channel forming concave portion 168*a* formed on the lower surface 40 of the containing body case 130.

(39) In the float valve 131 arranged inside the second ink chamber 152 of the liquid containing body 33, the thin film member 186, which closes the opening portion 185*a* of the air chamber 187, does not directly receive the inflow pressure of the ink from the filler port 73 flowing into the second ink chamber 152. That is, the inflow pressure of the ink is applied in the direction following the film surface of the thin film member 186. Therefore, even if the ink is forcefully poured into the first ink chamber 151 of the ink chamber 137 from outside through the filler port 73, it is possible to reduce the possibility that the inflow pressure of the ink from the first ink chamber 151 acts strongly, in the direction that presses against the thin film member 186, on the thin film member 186 of the float member 181 inside the second ink chamber 152. Accordingly, it is possible to maintain a proper valve operation without the float valve 131 arranged inside receiving damage from the inflow pressure of the ink poured in from outside.

(40) The float valve 131 is arranged in the second ink chamber 152, which is partitioned by the partition wall 150 from the first ink chamber 151, which is where the filler port 73 is located. Accordingly, it is possible to avoid that the ink poured from outside via the filler port 73 falls directly onto the float valve 131. In this regard, it is possible to further decrease a possibility that damage may occur to the float valve 131.

(41) Even if one of the multiple (four as an example) air chambers 187 is damaged so that the sealed state is broken, it is possible to properly maintain the function of the float valve 131 by designing the volume of the air chambers 187 such that the total sum of the volumes of the other remaining air chambers 187 generates desired buoyancy in the float member 181.

(42) In particular, when the remaining amount of ink stays at less than the threshold value remaining amount, wherein the valve body 182 is located in the closed position, for a long period of time, and then ink is poured through the filler port 73 so that the remaining amount of the ink becomes equal to or more than the threshold value remaining amount, it is possible to reduce the possibility that the valve body 182 is stuck in the closed position. Accordingly, it is possible to quickly displace the valve body 182 from the closed position to the opened position.

(43) The annular wall portion 196 of the regulating case 183 can reduce the possibility that the inflow pressure of the ink flowing in the second ink chamber 152 directly influences the float member 181, and it is possible to decrease a possibility of movement resistance being generated by the float member 181, when floating in the vertical direction Z, sliding against the annular wall portion 196 of the regulating case 183 while in surface contact therewith.

(44) It is possible to decrease a possibility that the thin film member may be damaged by sliding against the annular wall portion 196 of the regulating case 183 when the float member 181 floats in the vertical direction.

(45) The ink can flow through the passage holes 202, into and out from the annular wall portion 196 of the regulating case 183, when the float member 181 floats in the vertical direction Z. Accordingly, it is possible to ensure a smooth floating state of the float member 181, which depends on change in the remaining amount of the ink.

(46) It is possible to decrease a possibility that the opposing surfaces of the regulating case 183 and the float member 181 that oppose each other in the horizontal direction, that is, the thin film member 186 and the side wall 196*a*, may become fixedly adhered to each other due to the surface tension of the ink. Accordingly, it is possible to maintain a proper valve operation of the float valve 131.

(47) It is possible to displace the valve body 182 between the opened position and the closed position by the float member 181 simply pressing against the valve body 182 using a small stroke, which can contribute to the compactness of the float valve 131.

(48) The liquid container 21 has the first section located outside the printer 11 and the second section inserted to the printer 11, and the bottom portion of the first section having the filler port 73 is configured to be lower than the bottom portion of the second section. Accordingly, for example, compared to a case where the bottom surface of the first section and the bottom surface of the second section are configured to have the same height, and the first section is configured to be extended in the horizontal direction, it is possible to prevent a disadvantage that the overall size in the horizontal direction of the printer 11 including the liquid container 21 becomes larger. In addition, for example, if the first section located outside the printer 11 is extended in the horizontal direction, the distance from the second section, which is to be inserted to the printer 11, is farther than if the bottom portion of the first section is configured to be lower than the bottom portion of the second section (in the case where the first section is extended in the direction of gravity). There is a possibility that any force applied to the second section may be increased to the extent of the farther distance, so that the second section might be damaged. In addition, for example, there is a possibility that the printer 11 might tilt toward the first section for the same reason. Thus, if the bottom portion of the first section is configured to be lower than the bottom portion of the second section, the possibility of disadvantages such as damage to the second section and tilt of the printer 11 can be decreased.

(49) The first section, which has a larger volume than the second section, is located outside the printer 11. Accordingly, the user can more easily determine how much ink remains inside the liquid container 21 than if the second section, which has a smaller volume than the first section, were located outside the printer 11. Therefore, the possibility of disadvantages, such as ink overflowing from the liquid container 21 because of due to too much ink being filled, and continued printing even though little ink remains, can be decreased.

(50) The height of the ceiling surface of the first section and the height of the ceiling surface of the second section are equal to each other. Accordingly, while achieving a liquid container 21 with a large volume, it is possible to prevent the position of the filler port 73 from becoming too high, which could occur as a result of the liquid container 21 having a large volume. It is possible to prevent a disadvantage of the height of the filler port 73 being too high, and the user having to lift the container containing the ink to be poured, up to the height of the filler port 73 when a user fills ink.

(51) The lengths in the short direction of the first section and the second section are equal to each other. Accordingly, a user can easily estimate the amount of ink remaining inside the second section, which the user might have difficulty determining because the second section is inserted inside the printer 11. Further, a possibility of disadvantages, such as ink overflowing from the liquid container 21 because excessive ink was poured, and of continued printing even though only a little ink remains, can be decreased.

(52) The outlet port 52, which connects to the printer 11, is disposed in the second section, which is inserted in the printer 11. Accordingly, compared to a case in which the outlet port 52 is disposed in the first section, which is located outside the printer 11, the possibility of disadvantages such as being unable to connect the printer 11 and the outlet port 52 to each other can be decreased. Specifically, since the first section is located outside the printer 11, a user might apply a shock to the first section by placing objects on it or accidently bumping against it. If the outlet port 52 is disposed in the first section, such impacts might make the connection between the printer 11 and the outlet port 52 impossible. On the other hand, when the outlet port 52 is disposed in the second section, although an impact might be indirectly applied to the second section, the impact received can be weakened compared to a case in which the outlet port 52 is disposed in the first section.

(53) The fixed portion 37*a* engaging with the printer 11 is disposed in the first section on the first surface at the insertion direction side of the liquid container 21. Accordingly, it is possible to prevent an increase in the size of the printer 11 compared to a case in which the fixed portion 37*a* is disposed on the second surface opposing the first surface. In addition, since the first surface is located at the insertion direction side, a possibility of a disadvantage that the fixed portion 37*a* inhibits a user from observing from outside the amount of ink remaining inside the liquid container 21 can be decreased.

(54) The filler port 73 is formed at a position, in the first section, that is closer to the second surface, which is opposite from the first surface, than to the first surface of the second section side. Accordingly, even if a user, when pouring ink, erroneously spills ink outward from the filler port 73, a possibility of the disadvantage that the ink clings to and dirties the printer 11 can be decreased. In addition, the first surface is a surface that is closer to the liquid consuming apparatus than is the second surface. Accordingly, if the filler port 73 is disposed at a position close to the second surface, a possibility of a disadvantage that a user cannot visually confirm how pouring is proceeding because of the printer 11 can be decreased.

(55) The atmosphere communication hole 140 is formed in the first section at a position between the filler port 73 and the second section. Accordingly, a possibility of a disadvantage that when a user pours ink from an ink refill container containing ink for filling, the ink drips downward along a portion of the ink refill container that can be a blind spot to the user, and enter and close off the atmosphere communication hole 140, can be decreased.

(56) The second section of the liquid container 21 and the printer 11 are connected to each other so as to be swingable. Accordingly, it is possible to maintain the connection even if force is applied to the first section when the ink is poured in. Therefore, a possibility of a disadvantage such as inability to connect can be decreased.

The above-described embodiment may be modified to another embodiments as follows.

In the above-described embodiment, the second section (the portion of the liquid container 21 located inside the apparatus main body 14) may instead be the portion of the liquid container 21 that comes into contact with the guide groove 84 of the mounting section 31. Accordingly, the first section (the portion of the liquid container 21 located outside the apparatus main body 14) may instead be portions of the liquid container 21 other than the second section or portions of the liquid container 21 which do not come into contact with the guide groove 84 disposed of the mounting section 31.

In the embodiment, the attachment-purpose member 50 is swingable with respect to the liquid containing body 33. However, without being limited to an attachment-purpose member, it may be sufficient if the liquid containing body 33 and the printer 11 are swingably connected to each other, and not necessarily limited to the attachment-purpose member 50.

In the embodiment, the circuit board holder 76 may be provided to the slider 34 by being inserted to the slider 34 from the direction following the sliding direction that the slider 34 slides with respect to the liquid containing body 33, that is, from the direction following the longitudinal direction. In addition, the circuit board 75 attached to the circuit board holder 76 need not be in the inclined state with respect to the sliding direction of the slider 34, but for example, may be mounted on the circuit board holder 76 in a state in parallel with to the sliding direction or in a state orthogonal to the sliding direction.

In the embodiment, the groove-shaped portion 107 need not be disposed in the circuit board holder 76 as an example of the positioning shape portion for positioning in the printer 11 when the moving portion of the slider 34 moves into the printer 11. For example, the positioning shape portion is not necessary if the slider 34 is inserted to the mounting section 31 in a state in which the slider 34 is positioned with respect to the communication section 77.

In the embodiment, the opening/closing cover 74 and the engagement portion (groove portion 112) need not be disposed in the slider 34. For example, if the bearing portion 90 of the opening/closing cover 74 is configured to engage with the rotary shaft 89 of the slider 34 in a state of interference fit, the engagement portion is not necessary since a rotational load is obtained by the interference fit.

In the embodiment, the opening/closing cover 74 need not be configured to rotate about the rotation center of the axial line extending in the short direction of the liquid containing body 33. For example, the opening/closing cover 74 may be configured to be displaced from the closing position to the opened position by moving with respect to the slider 34 in parallel with the longitudinal direction.

In the embodiment, the opening/closing cover 74 need not be provided to the slider 34 that covers the filler port 73. In this case, the filler port 73 of the ink may be exposed by removing the slider 34 from the printer 11 (mounting section 31).

In the embodiment, the filler port 73 need not be disposed on the upper surface 39, which at the opposite side of the liquid containing body 33 than the gravity direction side. For example, the filler port 73 may be disposed on the side surface located in the horizontal direction side. In addition, the slider 34 need not be configured to cover the filler port 73. In this case, the filler port 73 may be covered with a member separate from the slider 34.

In the embodiment, the circuit board holder 76 is not necessarily limited to the configuration where the circuit board holder 76 is attached to the holder attachment portion 86 of the slider 34. For example, the circuit board holder 76 may be integrally formed with a portion of the slider 34. In addition, the circuit board 75 supported by the circuit board holder 76 may be a flexible circuit board. Furthermore, the circuit board may be configured in combination of flexible materials and the board. That is, the circuit board represents both situations, that is, one in which the circuitry of the circuit board, terminal, and memory to which the terminal is electrically connected, and the board on which the terminal and memory are arranged are structurally separate, and another in which all of the configuring elements are integral with each other. Therefore, the description that the circuit board is inclined represents a state in which at least one of these configuring elements is inclined. In addition, in the embodiment, the circuit board is inclined, but the circuit board may be inclined in a state in which at least the terminals or contact portions disposed on the circuit board are electrically connected to the electrical terminals 78 provided in the communication section 77. As described above, the circuit board 75 is an example of a storage unit, and the circuit board holder 76 is an example of a storage unit holding member. However, the circuit board 75 can be said to be the same as the storage unit, and the circuit board holder 76 can be said to be the same as the storage unit holding member.

In the embodiment, the medium is not limited to the sheet S, but may be a plate-shaped member made of a metal plate, resin plate, or cloth as the material. That is, as the medium, it is possible to adopt any member on which the recording (printing) can be performed using the liquid ejected by the liquid ejecting head 24.

In the embodiment, the liquid consuming apparatus is not limited to a serial type printer 11 in which the liquid ejecting head 24 movably reciprocates together with the carriage 25, but may be a line head type printer capable of printing on the maximum width range of the sheet even while fixing the liquid ejecting head 24.

In the embodiment, the covering member 121 need only be provided with at least the covering body 120.

In the embodiment, an absorber capable of absorbing the ink may be arranged on the rear surface 74*a* of the opening/closing cover 74.

In the embodiment, the connection portion 125 need not have a multiple-times folded shape on the liquid receiving surface 116. For example, the connection portion 125 may be formed in an L-shape in a plan view, by bending a portion of the connection portion 125 only once. In addition, the connection portion 125 may be formed from a metallic chain and the like, and mounted on the liquid receiving surface 116.

In the embodiment, the rear surface 74*a* of the opening/closing cover 74 need not be a surface that declines downward to the filler port 73 when the opening/closing cover 74 is located at the opened position. In this case, on the rear surface 74*a* of the opening/closing cover 74, it is preferable that the above-described ink absorber be arranged at the portion on which the covering body 120 is placed.

In the embodiment, the covering body 120 of the covering member 121 need not be mounted on the rear surface 74*a* of the opening/closing cover 74.

In the embodiment, the notched groove 118 may be provided at the peripheral position of the filler port 73 that has no peripheral wall portion 117. For example, the notched groove 118 may be formed at the opening edge 73*a* of the filler port 73. In addition, instead of the notched groove 118 as a concave portion, a convex portion protruding upward from the peripheral wall portion 117 may be provided. In this case, it is preferable that two convex portions be disposed to be capable of positioning the liquid filler source 126 from both sides.

In the embodiment, the area of the wall communication opening 155 may have the same size as the area of the filler port 73. In addition, the area of the wall communication opening 155 may be set to be larger than the area of the filler port 73.

In the embodiment, the configuration need not be provided with the filter 166. In addition, the filter 166 may be disposed so as to cover the flow channel opening 162 within the second ink chamber 152.

In the embodiment, the configuration need not be provided with the float valve 131.

In the embodiment, the configuration need not be provided with the laterally inclined rib portions 158*a* to 158*d*. In addition, the laterally inclined rib portions 158*a* to 158*d* may be individually provided to the configuration, and it is possible to optionally select whether to provide any of the laterally inclined rib portions 158*a* to 158*d*. For example, only one of any laterally inclined rib portion among the laterally inclined rib portions 158*a* to 158*d* need be provided to the configuration. In addition, for example, the configuration may include two of any of the laterally inclined rib portions, such as the third laterally inclined rib portion 158*c* and the fourth laterally inclined rib portion 158*d*, or alternately may include three of any of the laterally inclined rib portions, such as the first to third laterally inclined rib portions 158*a* to 158*c*.

In the embodiment, the laterally inclined rib portions 158*a* to 158*d* need not only extend in one direction, but also may be partially bent or curved. That is, for example, the laterally inclined rib portions 158*a* to 158*d* may have a portion extending in the direction of gravity in combination with a portion intersecting with the direction of gravity.

In the embodiment, the third laterally inclined rib portion 158*c* and the fourth laterally inclined rib portion 158*d* need not be line-symmetrical with each other. That is, for example, the third laterally inclined rib portion 158*c* and the fourth laterally inclined rib portion 158*d* may be formed by shifting one of them in the vertical direction Z. In addition, the axial line which is the reference of the line-symmetry of the third laterally inclined rib portion 158*c* and the fourth laterally inclined rib portion 158*d* may pass through any position of the float valve 131, if the axial line follows the direction of gravity. Then, portions of the third laterally inclined rib portion 158*c* and the fourth laterally inclined rib portion 158*d* may be line-symmetrical with each other, with reference to the axial line.

In the embodiment, the laterally inclined rib portions 158*a* to 158*d* may be formed so as to extend in the front/rear direction Y. In addition, the laterally inclined rib portions

158*a* to 158*d* may be formed so as to extend in a direction intersecting with the left/right direction X.

In the embodiment, the laterally inclined rib portions 158*a* to 158*d* may be disposed to be shifted from the flow channel opening 162 in the vertical direction Z.

In the embodiment, the flow channel opening 162 may be formed at a position other than on the bottom surface 152*a*. For example, the flow channel opening 162 may be formed in the side wall 130*b*. In addition, the flow channel opening 162 may be formed at a position remote from the partition wall 150. That is, the distance L1 may be longer than the distance L2.

In the embodiment, the concave portion 154 need not be disposed on the opposing surface 153 in the configuration. In addition, the concave portion 154 may be formed to be recessed to a direction intersecting with the direction of gravity. Furthermore, the concave portion 154 may be formed so as to match the imaginary filler line M. That is, the concave portion 154 may be formed at a position at the direction of gravity side of the filler port 73. The concave portion 154 and the filler port 73 have a different shape in a top view, and the size of the concave portion 154 in the left/right direction X is larger than the size of the filler port 73. Therefore, even if the concave portion 154 is formed at a position at the direction of gravity side of the filler port 73, a portion of the concave portion 154 is located at a position shifted from the filler port 73 in a direction intersecting with the direction of gravity. Thus, in a top view, the concave portion 154 may be formed to be smaller than the filler port 73, and further the filler port 73 and the concave portion 154 may be formed to have the same shape as each other.

In the embodiment, the liquid container 21 may be configured not to include the slider 34. That is, the liquid container 21 may be configured to have only the liquid containing body 33.

In the embodiment, the partition wall 150 may be provided so as to intersect with the vertical direction Z.

In the embodiment, the containing body case 130 may be configured without the intersecting rib portions 157*a* to 157*i*.

In the embodiment, the containing body case 130 may be configured not to include the partition wall 150.

In the embodiment, the upper surface 155*c* of the wall communication opening 155 may be formed in the horizontal direction.

In the embodiment, the cross-sectional area of the inclined flow channel portion 165 may have the same size as the cross-sectional area of the connection flow channel portion 164. In addition, the cross-sectional area of the inclined flow channel portion 165 may be larger than the cross-sectional area of the bent flow channel portion 163. In addition, the cross-sectional area of the inclined flow channel portion 165 may be smaller than the cross-sectional area of the connection flow channel portion 164 and the cross-sectional area of the bent flow channel portion 163.

In the embodiment, the inclined flow channel portion 165 may be disposed at the position shifted from the lower side position of the ink chamber 137 in the direction of gravity. That is, for example, the inclined flow channel portion 165 may be located adjacent to the ink chamber 137 via the side wall 130*b*.

In the embodiment, the valve body 182 fixed to the bottom surface 152*a* of the second ink chamber 152 may be omitted, and the pressing portion 189 protruding vertically downward from the lower surface of the float member 181 may function as the valve body capable of closing the valve port 192 when moving downward.

In the embodiment, the plate-shaped portion 191 functioning as an example of a regulating contact portion with respect to the regulating case 183 in the float member 181, may have a different cross-sectional shape other than a cross shape. In short, the shape can be optionally changed if there is a relationship in which the gap distance between the portion configuring the regulating contact portion and the inner surface of the cylindrical portion 198 is shorter than the gap distance between the thin film member 186 and the inner surface of the annular wall portion 196.

In the embodiment, the shape of the passage hole 202 in the regulating case 183 may be a circular shape, triangular shape, or notched shape without being limited to the rectangular shape. In short, the shape can be optionally changed if the shape allows the ink to be circulated when the float member 181 floats.

In the embodiment, the notched portion 199 formed in the side wall 196*a* in the front/rear direction Y of the regulating case 183 may be omitted. Alternatively, the notched portion 199 may be formed in the side wall 196*b* in the left/right direction X. Even in this case, the notched portion 199 can perform the function of allowing the ink to flow by communicating the inside and the outside of the regulating case 183, and additionally the function of decreasing the possibility that the float member 181 may slide when floating.

In the embodiment, the coil spring 195 having the second biasing force biasing the valve body 182 toward the upper opened position may be omitted.

In the embodiment, the float member 181 may have at least one air chamber 187. That is, the number of the air chambers 187 is not necessarily limited to four, but may be one or more, such as two, three and five.

In the embodiment, the partition wall 150, which partitions the ink chamber 137 into the first ink chamber 151 and the second ink chamber 152, need not be provided. That is, the ink chamber 137 of the liquid containing body 33 may be a single chamber, and the float valve 131 configured to be arranged inside the single ink chamber 137.

In the embodiment, the shape of the regulating case 183 is not limited to a box shape. The shape can be arbitrarily changed if the regulating case 183 has the annular wall portion 196 surrounding the float member 181, so as to protect the float member 181 against the inflow pressure of the ink flowing into the second ink chamber 152.

In the embodiment, the regulating member need not have a box shape such as the regulating case 183, but may have a frame shape. In short, the shape can be optionally changed if the regulating member has a structure coming into contact with and regulating the float member 181 to stop the upward floating at a lower position than the ceiling of the ink chamber 137, when the float member 181 floats upward due to rise in the liquid surface of the ink.

In the embodiment, the thin film member 186 forming the air chambers 187 by closing the opening portion 185*a* of the float member 181 may be a thin resin sheet or plate, for example, instead of a film.

In the embodiment, the state in which the liquid container 21 is used, may be a type of use where the liquid container 21, while mounted in the side of the printer 11, is connected thereto so as to be capable of supplying liquid using a tube, instead of a state in which the liquid container 21 is mounted on the mounting section 31 of the printer 11 and is immovably fixed to the printer 11.

In the embodiment, the liquid container and the liquid filler source have been described, but both of them can be considered as the liquid receptacle.

In the embodiment, the liquid consuming apparatus may be a liquid ejecting apparatus ejecting or discharging liquids other than ink. The shape of liquid discharged from the liquid ejecting apparatus by forming minute-amount droplets may be a granular shape, tear shape, or thread shape leaving a trail. In addition, the liquid described herein may be any material that can be ejected from the liquid ejecting apparatus. For example, the substance need only be in a liquid phase, and may be a liquid state body such as a high or low viscous liquid state body, sol, gel water, another inorganic solvent, organic solvent, solution, a liquid state resin, or a liquid state metal (metallic melt). In addition, besides the liquid as one state of the substance, the liquid may include particles of a functional material consisting of solid materials, such as pigments and metal particles that are dissolved in a solvent, dispersed, or mixed. A representative example of the liquid includes an ink described in the embodiments and a liquid crystal. Here, the ink includes various types of liquid compositions, such as a general water-based ink, oil-based ink, gel ink, or hot melt ink. A specific example of the liquid ejecting apparatus includes a liquid ejecting apparatus ejecting a liquid, in a dispersed or dissolved form, containing materials such as electrode materials and color materials used in manufacturing, for example, a liquid crystal display, electroluminescence (EL) display, surface emitting display and color filter. In addition, the apparatus may be a liquid ejecting apparatus ejecting living organic materials used in manufacturing a biochip, a liquid ejecting apparatus ejecting the liquid formed from a sample used as a precision pipette, printing equipment, and a micro-dispenser. Furthermore, the apparatus may be a liquid ejecting apparatus ejecting a lubricant onto a precision machine such as a timepiece and a camera using a pinpoint, and a liquid ejecting apparatus ejecting a transparent resin liquid such as a UV-curing resin onto a substrate in order to form a minute hemispherical lens (optical lens) used for an optical communication element. In addition, the apparatus may be a liquid ejecting apparatus ejecting an etchant such as acid or alkali in order to etch a substrate.

In the embodiment, the storage unit is assumed as one in which the ink information is recorded, but may be any one if the ink information can be stored.

What is claimed is:

1. A storage unit holding member which is mountable to a liquid receptacle for containing a liquid and holds a storage unit, the storage unit holding member comprising:

a storage unit that stores information relating to the liquid contained in the liquid receptacle, a support portion which supports the storage unit, an engagement portion engaging with a communication section that is included in a liquid consuming apparatus and that reads the information stored in the storage unit, wherein the engagement portion is a concave portion; and wherein the storage unit supported by the support portion is inclined with respect to a horizontal direction when in the state of attachment.

2. The storage unit holding member according to claim 1, wherein the information stored in the storage unit is read by a communication section of a liquid consuming apparatus by insertion of the storage unit holding member into the liquid consuming apparatus, and wherein the storage unit supported by the support portion is inclined with respect to a direction of the insertion.

3. The storage unit holding member according to claim 1, wherein a label of the same color as a color of the liquid for containing in the liquid receptacle is attached to the storage unit holding member.

4. The storage unit holding member according to claim 1, wherein the information stored in the storage unit is read by a communication section of a liquid consuming apparatus while the storage unit holding member is in a mounted state on a subsidiary holding member, and wherein the storage unit holding member is located inside the liquid consuming apparatus and a part of the subsidiary holding member is located outside the liquid consuming apparatus when in a state in which the information stored in the storage unit is being read by the communication section.

5. The storage unit holding member according to claim 1, wherein the liquid receptacle is a liquid filler source containing the liquid to be filled into a liquid container mounted on a liquid consuming apparatus.

6. The storage unit holding member of claim 1, wherein the liquid receptacle has a first surface defining a substantially vertical plane when in the state of attachment and a second surface that is opposed to the first surface; a third surface defining a horizontal plane, substantially perpendicular to the first surface, that intersects with the first surface and the second surface; a fourth surface that is opposed to the third surface; and wherein the storage unit is inclined relative to the horizontal plane when in the state of attachment.

7. A storage unit holding member which is mountable to a liquid receptacle for containing a liquid and holds a storage unit, the storage unit holding member comprising:

a storage unit that stores information relating to the liquid contained in the liquid receptacle, a support portion which supports the storage unit, a plurality of walls, wherein regardless of an orientation at which the storage unit holding member is placed on a horizontal surface, the walls protrude further in a direction of gravity than the storage unit; and wherein the storage unit supported by the support portion is inclined with respect to a horizontal direction when in the state of attachment.

8. The storage unit holding member according to claim 7, comprising: a plurality of walls, and an engagement portion formed on a surface of the surfaces configuring the walls that faces the storage unit, the engagement portion engages with a communication section that is provided in a liquid consuming apparatus and that reads the information stored in the storage unit.

* * * * *